US011723477B2

(12) United States Patent
Rogers et al.

(10) Patent No.: US 11,723,477 B2
(45) Date of Patent: Aug. 15, 2023

(54) CONVERTIBLE HIGHCHAIR

(71) Applicant: KIDS2, INC., Atlanta, GA (US)

(72) Inventors: Bradford Rogers, Decatur, GA (US); Frank M. Tyneski, Roswell, GA (US); John A. McMillan, Lilburn, GA (US); Jacob Sclare, Dacula, GA (US); Chaitanya Tadipatri, Alpharetta, GA (US)

(73) Assignee: KIDS2, INC., Atlanta, GA (US)

( * ) Notice: Subject to any disclaimer, the term of this patent is extended or adjusted under 35 U.S.C. 154(b) by 156 days.

(21) Appl. No.: 17/082,136

(22) Filed: Oct. 28, 2020

(65) Prior Publication Data

US 2021/0037989 A1 Feb. 11, 2021

Related U.S. Application Data

(60) Continuation-in-part of application No. 16/782,174, filed on Feb. 5, 2020, now Pat. No. 11,426,008, which
(Continued)

(51) Int. Cl.
*A47D 1/04* (2006.01)
*A47D 1/10* (2006.01)
(Continued)

(52) U.S. Cl.
CPC ..... *A47D 1/04* (2013.01); *A47D 1/004* (2013.01); *A47D 1/008* (2013.01); *A47D 1/02* (2013.01); *A47D 1/10* (2013.01); *A47D 1/103* (2013.01)

(58) Field of Classification Search
CPC ..... A47C 12/02; A47D 1/004; A47D 1/008; A47D 1/0083; A47D 1/0085; A47D 1/02;
(Continued)

(56) References Cited

U.S. PATENT DOCUMENTS 451,058 A 4/1891 Koeser
1,456,800 A 5/1923 Hagger
(Continued)

FOREIGN PATENT DOCUMENTS

CA 2396076 A1 6/2003
CN 203776507 U 8/2014
(Continued)

OTHER PUBLICATIONS

Partial European Search Report for EP App. No. 17159748.7; dated Sep. 6, 2017; 12 pgs.
(Continued)

*Primary Examiner* — James M Ference
(74) *Attorney, Agent, or Firm* — Gardner Groff & Greenwald, PC

(57) ABSTRACT

A children's accessory that is convertible between a highchair configuration and a stepstool. In the highchair configuration the device generally includes a first child seat supported above a floor by a highchair frame, and a second child seat configured for being removably coupled to the first child seat. The second child seat is configured such that, when detached from the highchair's first child seat, it can be used as a booster seat. In certain embodiments, the second child seat includes a base surface configured to stably support the second child seat on a separate support surface. In the stepstool configuration a support step platform is supported above the floor by the frame, and a back rail at the top of the frame provides further support for the user.

23 Claims, 41 Drawing Sheets

Related U.S. Application Data is a division of application No. 15/450,359, filed on Mar. 6, 2017, now Pat. No. 10,588,424, said application No. 16/782,174 is a continuation-in-part of application No. 15/137,335, filed on Apr. 25, 2016, now abandoned.

(60) Provisional application No. 62/394,958, filed on Sep. 15, 2016, provisional application No. 62/304,653, filed on Mar. 7, 2016, provisional application No. 62/215,943, filed on Sep. 9, 2015, provisional application No. 62/152,845, filed on Apr. 25, 2015.

(51) Int. Cl.
*A47D 1/00* (2006.01)
*A47D 1/02* (2006.01)

(58) Field of Classification Search
CPC . A47D 1/023; A47D 1/04; A47D 1/06; A47D 1/10; A47D 1/103; A47D 11/00
See application file for complete search history.

(56) References Cited

U.S. PATENT DOCUMENTS 2,491,465 A 12/1949 Johnson
2,496,205 A 1/1950 Charles
2,504,897 A 4/1950 Stanton
2,516,774 A 7/1950 Louis
2,529,687 A 11/1950 Greenbaum
2,530,474 A 11/1950 Keene
2,535,563 A 12/1950 Boyer et al.
2,619,152 A 11/1952 Lane
2,667,207 A 1/1954 Andrew
2,669,285 A 2/1954 Young
2,672,182 A 3/1954 Gwin et al.
2,731,072 A 1/1956 Post
2,799,324 A 7/1957 Anderson
2,919,748 A 1/1960 Alden, Sr.
2,952,301 A 9/1960 Corp
2,963,076 A 12/1960 Hyman
2,971,567 A 2/1961 Kimmel
2,984,291 A 5/1961 Kostenborder et al.
3,146,738 A 9/1964 Telarico
3,181,483 A 5/1965 Devitt et al.
3,649,074 A 3/1972 McDonald
D229,999 S 1/1974 Blazey
4,109,961 A 8/1978 Opsvik
4,130,316 A 12/1978 Rossi
4,165,123 A 8/1979 Hutson
4,258,827 A * 3/1981 Klose ..... E06C 1/393 297/130
4,276,955 A * 7/1981 Hickman ..... A47C 12/00 269/244
4,288,123 A 9/1981 Cone
4,591,206 A 5/1986 Pribble
4,600,255 A 7/1986 Dubarko
4,645,261 A 2/1987 Bourne et al.
4,722,570 A 2/1988 Bertoli
4,795,209 A 1/1989 Quinlan, Jr. et al.
4,854,638 A 8/1989 Marcus et al.
4,927,024 A 5/1990 Lloyd
4,955,571 A 9/1990 Lorence et al.
4,968,091 A 11/1990 Mariol
D327,200 S 6/1992 Szablak et al.
5,183,311 A 2/1993 Meeker et al.
5,238,292 A 8/1993 Golenz et al.
5,265,931 A 11/1993 Ryan
5,332,241 A 7/1994 Rho
5,348,374 A 9/1994 Kuo
5,375,869 A 12/1994 Hsiao
D358,730 S 5/1995 Meeker et al.
5,421,636 A 6/1995 Gamble
5,474,355 A 12/1995 Lerner et al.
5,507,549 A 4/1996 Cope
5,507,550 A 4/1996 Maloney
5,509,719 A 4/1996 Cone, II
5,527,090 A 6/1996 Cone, II
5,562,049 A 10/1996 Hoffman et al.
5,564,778 A 10/1996 Shimer et al.
5,586,800 A 12/1996 Triplett
5,586,804 A 12/1996 Burroughs
5,588,697 A 12/1996 Yoshida et al.
5,634,687 A 6/1997 Gamble
5,658,047 A 8/1997 Ratza et al.
5,692,815 A 12/1997 Murphy
5,707,104 A 1/1998 Perego
5,720,226 A 2/1998 Padovano
5,765,909 A 6/1998 Catrinar
5,772,279 A 6/1998 Johnson, Jr.
5,806,922 A 9/1998 Mendelovich
5,810,432 A 9/1998 Haut et al.
5,820,207 A 10/1998 Wang
5,823,615 A 10/1998 Haut
5,836,652 A 11/1998 Wexler et al.
5,876,007 A 3/1999 Lancaster et al.
5,951,102 A 9/1999 Poulson et al.
5,984,791 A 11/1999 Fair et al.
5,992,932 A 11/1999 Kain et al.
6,007,400 A 12/1999 Lan
6,026,933 A * 2/2000 King ..... E06C 1/393 182/161
6,036,268 A 3/2000 Larson
6,050,643 A 4/2000 Kain et al.
6,082,814 A 7/2000 Celestina-Krevh et al.
6,089,653 A 7/2000 Hotaling et al.
6,089,666 A 7/2000 Rosko
D428,715 S 8/2000 Brevi
6,129,414 A 10/2000 Brevi
D435,196 S 12/2000 Gregor et al.
6,161,898 A 12/2000 Brevi
6,189,973 B1 2/2001 Wu
6,212,706 B1 4/2001 Rossman et al.
6,237,996 B1 5/2001 Chen et al.
6,283,042 B1 9/2001 Wargo et al.
6,298,793 B1 10/2001 Turner et al.
6,318,804 B1 11/2001 Brown
6,347,830 B1 2/2002 Chen
6,347,833 B1 2/2002 Chen
D454,007 S 3/2002 Huang
6,367,875 B1 4/2002 Bapst
6,398,304 B1 6/2002 Chen et al.
6,415,460 B1 7/2002 Rossman et al.
6,416,124 B1 7/2002 Chen et al.
6,419,312 B1 7/2002 Flannery et al.
6,421,901 B2 7/2002 Sitarski et al.
6,428,099 B1 8/2002 Kain
6,484,989 B1 11/2002 Connery
6,497,452 B2 12/2002 Catelli
6,511,123 B1 1/2003 Sitarski et al.
6,550,579 B2 * 4/2003 Gibson ..... E06C 1/387 182/161
6,578,496 B2 6/2003 Guard et al.
6,595,583 B2 7/2003 Hou
D478,219 S 8/2003 Greger
6,634,712 B2 10/2003 Gamble
6,659,544 B2 12/2003 Hollett et al.
6,666,505 B2 12/2003 Greger et al.
6,715,827 B1 4/2004 Chen
6,773,064 B2 8/2004 Treen et al.
6,832,813 B2 12/2004 Tomas et al.
6,851,375 B2 2/2005 Guard et al.
6,877,801 B2 4/2005 Asbach et al.
6,899,394 B2 5/2005 Wang
6,902,035 B2 * 6/2005 Baumgartner ..... E06C 1/393 182/165
6,920,830 B1 7/2005 Asbach et al.
6,932,426 B2 8/2005 Greger
6,938,952 B2 * 9/2005 Dauterive ..... A47D 1/004 297/283.1
6,951,371 B2 10/2005 Wang
7,011,363 B1 3/2006 Connery
7,029,064 B2 4/2006 Chen

(56) References Cited

U.S. PATENT DOCUMENTS 7,066,542 B2 6/2006 Wang
7,104,603 B2 9/2006 Keegan et al.
7,128,367 B2 10/2006 You et al.
7,134,714 B1 11/2006 Connery
7,201,445 B1 4/2007 Dubiel et al.
7,261,370 B1 8/2007 Whitesell, Jr.
7,300,103 B1 11/2007 Grays
7,314,247 B1 1/2008 Chen et al.
7,318,380 B2 1/2008 Guard et al.
7,328,941 B2 2/2008 Asbach et al.
7,334,836 B2 2/2008 Chen et al.
7,364,235 B2 4/2008 Chen et al.
7,393,050 B2 7/2008 Li
7,441,835 B2 10/2008 Chen et al.
D579,673 S 11/2008 Mancuso et al.
7,472,959 B1 1/2009 Ratza et al.
7,490,558 B2 2/2009 Asbach et al.
7,490,895 B2 2/2009 Yeh
D594,667 S 6/2009 Wang
7,540,560 B1 6/2009 Connery
7,568,758 B2 8/2009 Troutman et al.
7,571,925 B2 8/2009 Pike et al.
7,614,640 B2 11/2009 Dean et al.
7,658,446 B2 2/2010 Meeker et al.
7,673,934 B2 3/2010 Bearup et al.
7,673,942 B2 3/2010 Tuckey et al.
7,695,060 B2 4/2010 Dubiel et al.
7,703,843 B2 4/2010 Chen et al.
7,735,911 B2 6/2010 Chen
D618,925 S 7/2010 Fiore, Jr. et al.
7,753,448 B2 7/2010 Chen et al.
7,810,885 B2 10/2010 Chen et al.
7,832,801 B2 11/2010 Driessen
7,871,125 B2 1/2011 Asbach et al.
7,878,584 B2 2/2011 Hu et al.
7,883,145 B2 2/2011 Troutman et al.
7,896,431 B2 3/2011 Cui et al.
7,918,497 B2 4/2011 Keegan
7,922,244 B2 4/2011 Bearup
D642,815 S 8/2011 Kelly et al.
7,988,228 B2 8/2011 Cui et al.
7,992,714 B1 8/2011 Devault
8,007,043 B1 8/2011 Vuong
8,011,722 B2 9/2011 Cui et al.
8,029,053 B2 10/2011 Troutman et al.
8,043,988 B2 10/2011 Guillou et al.
8,100,470 B1 1/2012 Hu
8,141,943 B2 3/2012 Hu et al.
8,157,327 B2 4/2012 Tomasi
8,162,390 B2 4/2012 Zhong
8,172,253 B2 5/2012 Song
8,201,879 B2 6/2012 Hartenstine et al.
8,226,161 B2 7/2012 Fiore, Jr. et al.
8,256,833 B2 9/2012 Hu et al.
8,287,044 B2 10/2012 Chen et al.
8,292,365 B2 10/2012 Lu et al.
8,308,229 B2 11/2012 Galley
8,308,230 B2 11/2012 Zhong
8,360,514 B2 1/2013 Chen et al.
8,376,375 B2 2/2013 Mival et al.
8,376,461 B2 2/2013 Chen
D677,912 S 3/2013 Gillett et al.
8,419,121 B2 4/2013 Hu et al.
8,454,049 B2 6/2013 Chen et al.
8,540,312 B2 9/2013 Asbach et al.
8,567,866 B2 10/2013 Carimati Di Carimate et al.
8,567,867 B2 10/2013 Arnold, IV et al.
8,602,490 B2 12/2013 Tsai et al.
D699,955 S 2/2014 Chen
8,646,838 B2 2/2014 Fiore, Jr. et al.
8,651,572 B2 2/2014 Medeiros et al.
8,678,491 B2 3/2014 Chen et al.
8,684,139 B2 * 4/2014 Leng ..... E06C 1/387 182/20
8,696,055 B2 4/2014 Stolarz et al.
8,752,903 B2 6/2014 Ponticelli
8,789,882 B2 7/2014 Bergkvist
8,833,854 B2 9/2014 Lu et al.
D722,779 S 2/2015 Gov
8,960,787 B2 2/2015 Warncke et al.
8,967,710 B2 3/2015 Hu et al.
8,997,931 B2 * 4/2015 Parker ..... E06C 1/387 182/180.1
9,033,417 B2 5/2015 Mo
9,101,225 B2 8/2015 Kostyniak et al.
9,119,481 B2 9/2015 Varney et al.
9,127,709 B2 9/2015 Shan
9,161,636 B2 10/2015 Stokke
D746,071 S 12/2015 Haley
9,200,746 B2 12/2015 Xiao
9,254,048 B2 2/2016 Chen
9,339,118 B2 5/2016 Gubitosi et al.
D764,818 S 8/2016 Nassif
9,420,899 B2 8/2016 Merlo
9,439,517 B2 9/2016 Cheng
9,480,343 B2 11/2016 Haut et al.
9,554,657 B2 1/2017 Taylor et al.
9,554,658 B2 1/2017 Horst et al.
9,565,929 B2 2/2017 Flannery et al.
9,603,464 B2 3/2017 Sclare et al.
9,635,955 B2 5/2017 Greger
9,693,636 B2 7/2017 Yang
9,750,351 B2 9/2017 Sack et al.
9,756,961 B2 9/2017 Haut
9,756,962 B2 9/2017 Perrin et al.
9,788,662 B1 * 10/2017 Hollett ..... A47D 1/10
9,844,278 B2 12/2017 Winterhalter
9,877,598 B2 1/2018 Fine
9,883,749 B2 2/2018 Kostyniak et al.
9,895,005 B2 2/2018 Castilla
9,918,561 B2 3/2018 Perrin et al.
9,936,817 B2 4/2018 Horst et al.
9,986,850 B2 6/2018 Haut et al.
10,051,975 B2 8/2018 Taylor et al.
10,159,358 B2 12/2018 Wells
10,306,996 B1 6/2019 Sima
10,413,085 B2 9/2019 Haut
10,492,621 B2 12/2019 Ingraham et al.
10,588,424 B2 3/2020 Sclare et al.
2001/0035112 A1 11/2001 Guard et al.
2002/0036416 A1 3/2002 Mendenhall et al.
2002/0074835 A1 6/2002 Chalender
2003/0067198 A1 4/2003 Treen et al.
2003/0197403 A1 10/2003 Greger
2003/0218366 A1 11/2003 Rho
2004/0026976 A1 2/2004 Chen et al.
2005/0017549 A1 1/2005 Chen
2005/0242632 A1 11/2005 Asbach
2005/0248192 A1 11/2005 Schaller
2006/0138827 A1 6/2006 Kassai
2006/0220349 A1 10/2006 Wolf et al.
2007/0024095 A1 2/2007 Chen
2007/0029845 A1 2/2007 Riedl
2007/0069566 A1 3/2007 Li
2007/0145790 A1 6/2007 Ventrola
2007/0290528 A1 12/2007 Chen et al.
2008/0122270 A1 5/2008 Dubiel
2008/0179921 A1 7/2008 Lake et al.
2008/0203779 A1 8/2008 Cheng
2008/0217983 A1 9/2008 Cheng
2008/0290699 A1 11/2008 Golias
2009/0001776 A1 1/2009 Bearup
2009/0029845 A1 1/2009 Guillou
2009/0039692 A1 2/2009 Tuckey et al.
2009/0206639 A1 8/2009 Bearup
2009/0315374 A1 12/2009 Hu
2010/0264719 A1 10/2010 Burns et al.
2011/0062753 A1 3/2011 Kennedy
2011/0074187 A1 3/2011 Zhong
2012/0025569 A1 2/2012 Bergkvist
2012/0026000 A1 2/2012 Chen et al.
2012/0286545 A1 11/2012 Cheng
2013/0099545 A1 4/2013 Cheng
2013/0214103 A1 8/2013 Wu et al.

(56) References Cited

U.S. PATENT DOCUMENTS

| | | | |
|---|---|---|---|
| 2013/0241248 | A1 | 9/2013 | Kostyniak et al. |
| 2013/0292984 | A1 | 11/2013 | You et al. |
| 2014/0054936 | A1 | 2/2014 | Varney et al. |
| 2014/0077534 | A1 | 3/2014 | Stolarz et al. |
| 2014/0208987 | A1 | 7/2014 | Varney et al. |
| 2014/0265487 | A1 | 9/2014 | Michelson |
| 2014/0368006 | A1 | 12/2014 | Taylor et al. |
| 2014/0368014 | A1 | 12/2014 | Haut et al. |
| 2015/0108123 | A1 | 4/2015 | Linehan et al. |
| 2015/0157140 | A1 | 6/2015 | Yang |
| 2015/0272341 | A1 | 10/2015 | Perrin et al. |
| 2015/0289674 | A1 | 10/2015 | Winterhalter |
| 2015/0335170 | A1 | 11/2015 | Castilla |
| 2015/0359354 | A1 | 12/2015 | Greger |
| 2015/0366371 | A1 | 12/2015 | Kostyniak et al. |
| 2016/0007766 | A1 | 1/2016 | Sack et al. |
| 2016/0174727 | A1 | 6/2016 | Haut et al. |
| 2016/0192787 | A1 | 7/2016 | Perrin et al. |
| 2016/0242565 | A1 | 8/2016 | Van Den Akker |
| 2016/0309910 | A1 | 10/2016 | Sclare |
| 2016/0324330 | A1 | 11/2016 | Xu |
| 2016/0331152 | A1 | 11/2016 | Wells |
| 2016/0338517 | A1 | 11/2016 | Snowden |
| 2016/0367044 | A1 | 12/2016 | Horst et al. |
| 2017/0112294 | A1 | 4/2017 | Taylor et al. |
| 2017/0251826 | A1 | 9/2017 | Sclare et al. |
| 2019/0231087 | A1 | 8/2019 | Dziak et al. |
| 2020/0383490 | A1 | 12/2020 | Tackaberry et al. |
| 2021/0037989 | A1 * | 2/2021 | Rogers ..... A47C 12/02 |

FOREIGN PATENT DOCUMENTS

| | | | | |
|---|---|---|---|---|
| CN | 208403879 | U | 1/2019 | |
| DE | 102015122122 | A1 | 6/2016 | |
| DE | 102012203967 | B4 | 2/2017 | |
| EP | 0097733 | A1 * | 6/1982 | ..... E06C 1/387 |
| EP | 1163868 | A1 | 12/2001 | |
| EP | 1396216 | A1 | 3/2004 | |
| EP | 2008550 | B1 | 3/2011 | |
| EP | 2671471 | A1 | 12/2013 | |
| EP | 2305076 | B1 | 10/2014 | |
| GB | 639528 | A | 6/1950 | |
| TW | M396781 | U | 1/2011 | |
| WO | 2009158134 | A1 | 12/2009 | |

OTHER PUBLICATIONS

European Search Report for EP App. No. 16166939.5; dated Sep. 1, 2016; 6 pgs.

International Search Report and Written Opinion for PCT/US2021/056138; dated Jan. 12, 2022; 13 pgs.

* cited by examiner

CONVERTIBLE HIGHCHAIR

CROSS-REFERENCE TO RELATED APPLICATIONS

This application is a continuation-in-part of U.S. Non-Provisional patent application Ser. No. 16/782,174 filed Feb. 5, 2020, which is a divisional of U.S. Non-Provisional patent application Ser. No. 15/450,359 filed Mar. 6, 2017, now U.S. Pat. No. 10,588,424 issued Mar. 17, 2020, which claims the benefit of U.S. Provisional Patent Application Ser. No. 62/304,653 filed Mar. 7, 2016 and U.S. Provisional Patent Application Ser. No. 62/394,958 filed Sep. 15, 2016; U.S. Non-Provisional patent application Ser. No. 16/782,174 filed Feb. 5, 2020 is also a continuation-in-part of U.S. Non-Provisional patent application Ser. No. 15/137,335 filed Apr. 25, 2016, which claims the benefit of U.S. Provisional Patent Application Ser. No. 62/152,845 filed Apr. 25, 2015 and U.S. Provisional Patent Application Ser. No. 62/215,943 filed Sep. 9, 2015, the entireties of which are hereby incorporated herein by reference for all purposes.

TECHNICAL FIELD

The present disclosure relates generally to the field of child support devices, and more particularly to child highchairs and accessories, including a highchair that is convertible between two or more configurations including, for example, an infant highchair, a toddler highchair, a booster seat, and/or a step stool.

BACKGROUND

Conventional children's highchairs typically include a child seat elevated above a floor by a frame. Certain highchairs, however, are provided with an additional seat that can be removably secured to the highchair's child seat in order to convert the highchair for use by children of different ages. In some previously known devices, when the booster seat is detached from the highchair, it is typically coupled to a separate base member and can then be secured to a standard highchair for use as a booster.

Accordingly, it can be seen that needs exist for an improved convertible highchair that is easier and more convenient for users to convert and that includes a removable booster seat capable of stably supporting itself on a support surface (e.g. a standard chair) without the need to be secured to a separate component (e.g. a separate base member).

It is to the provision of a children's highchair meeting these and other needs that the present disclosure is primarily directed.

SUMMARY

In example embodiments, the present disclosure provides a convertible children's highchair providing improved functionality and convenience for parents and other adult caregivers. According to various embodiments, the convertible highchair generally includes a first child seat supported above a floor by a highchair frame, and a second child seat configured to be removably coupled to the first child seat. The second child seat is configured such that, when detached from the highchair's first child seat, it can be used independently as a booster seat. In certain embodiments, the second child seat includes a base surface configured to stably support the second child seat on a separate support surface.

In one aspect, the present disclosure relates to a convertible seating and stepstool system including a support frame, at least one seat configured for removable attachment to the support frame, and a support step assembly affixed to the support frame. The system is preferably convertible between a seating configuration with the at least one seat attached to the support frame, and a stepstool configuration with the at least one seat removed from the support frame. The support step assembly is preferably affixed to the support frame at the same location in both the seating configuration and the stepstool configuration.

In another aspect, the present disclosure relates to a convertible seating and stepstool system. The system preferably includes a support frame having first and second front legs, first and second back legs, a first hub pivotally coupling the first front leg and the first back leg, a second hub pivotally coupling the second front leg and the second back leg, a front frame crossbar extending between the first and second front legs, a rear frame crossbar extending between the first and second back legs, and an upper cross-frame support bar extending between the first hub and the second hub. The system preferably also includes at least one seat configured for removable attachment to the support frame. The system preferably also includes a support step assembly having a first portion affixed to one of the front frame crossbar and the rear frame crossbar, and a second portion configured for supporting engagement with the other of the front frame crossbar and the rear frame crossbar.

In another aspect, the present disclosure relates to a method of use of a convertible seating and stepstool system. The method preferably includes configuring the system in a first seating configuration by positioning a first seat assembly on a frame at a first elevated position above a supporting surface upon which the frame rests. The frame preferably includes first and second front legs, first and second back legs, a front frame crossbar extending between the first and second front legs, and a rear frame crossbar extending between the first and second back legs. The method preferably further includes alternatively configuring the system in a stepstool configuration by supporting a support step assembly on the frame at a second elevated position above the supporting surface, with the support step assembly having a first portion affixed to one of the front frame crossbar and the rear frame crossbar, and the support step assembly having a second portion configured for supporting engagement with the other of the front frame crossbar and the rear frame crossbar.

In still another aspect, the present disclosure relates to a convertible children's highchair including a frame configured to rest on a support surface, a first child seat defining a first seating surface and a second child seat defining a second seating surface. The first child seat is repositionably coupled to the frame and supported above the support surface. The second child seat is configured to be removably attached to the first child seat and includes a base configured to rest on a flat support surface to support the second child seat when the second child seat is decoupled from the first child seat.

In another aspect, the present disclosure relates to a convertible highchair including a frame configured to rest on the floor, a first child seat defining a first seating portion and a second child seat defining a second seating portion. The first child seat is coupled to the frame and supported above the floor and the second child seat is configured to be removably coupled to the first child seat. The second child seat includes a base with a downward extending skirt. The skirt is configured to extend substantially around the entirety of the first seating portion of the first child seat when the second child seat is coupled to the first child seat.

In still another aspect, the present disclosure relates to a convertible highchair including a frame configured to rest on the floor, a first child seat defining a first seating surface, a second child seat defining a second seating surface and a tray assembly. The first child seat is coupled to the frame and supported above the floor and the second child seat is configured to be removably coupled to the first child seat. The tray assembly includes a base tray pivotally coupled to the second child seat and a detachable tray removably coupled to the base tray.

In still another aspect, the present disclosure relates to a tray assembly for a children's highchair including a base tray, a detachable tray removably coupled to the base tray, and an auxiliary tray extensible and retractable relative to the detachable tray.

In another aspect, the disclosure relates to a child seat for supporting a child above a support surface. The child seat preferably includes a seat assembly having a seating surface and first and second shoulder portions extending upwardly from opposed lateral side portions of the seating surface. The child seat preferably also includes a tray assembly including a base tray and a detachable tray. The base tray preferably includes a first arm pivotally coupled to the first shoulder portion of the seat assembly, a second arm releasably coupled to the second shoulder portion of the seat assembly, and a release mechanism configured for user actuation to disengage a releasable coupling between the second arm of the base tray and the second shoulder portion of the seat assembly. The detachable tray is preferably configured for detachable and adjustable coupling with the base tray, whereby the detachable tray can be attached to and removed from the base tray, and whereby the position of the detachable tray relative to the seat assembly can be adjusted when the detachable tray is attached to the base tray.

In still another aspect, the disclosure relates to a child seat for supporting a child above a support surface. The child seat preferably includes a seat assembly having a seating surface and first and second shoulder portions extending upwardly from opposed lateral side portions of the seating surface. The child seat preferably also includes a base tray having a first arm pivotally coupled to the first shoulder portion of the seat assembly and a second arm releasably coupled to the second shoulder portion of the seat assembly. The child seat preferably also includes a detachable tray configured for detachable coupling with the base tray whereby the detachable tray can be attached to and removed from the base tray. The pivotal coupling between the first arm of the base tray and the first shoulder portion of the seat assembly preferably allows the second arm of the base tray to pivot away from the seat assembly with or without the detachable tray attached to the base tray.

In another aspect, the disclosure relates to a child seat for supporting a child above a support surface. The child seat preferably includes a seat assembly having a seating surface, a first seat coupling element on a first side of the seating surface, and a second seat coupling element on an opposite second side of the seating surface. The child seat preferably also includes a base tray having a first tray coupling element pivotally coupled to the first seat coupling element, and a second tray coupling element detachably coupled to the second seat coupling element, whereby the base tray can pivot away from the seat assembly when the second tray coupling element is detached from the second seat coupling element. The child seat preferably also includes a detachable tray configured for selective attachment to and removal from the base tray, wherein the base tray can pivot away from the seat assembly with or without the detachable tray attached to the base tray.

These and other aspects, features and advantages of the disclosure will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the disclosure, and are not restrictive of the invention, as claimed.

BRIEF DESCRIPTION OF THE DRAWINGS

FIG. 48 shows a side view of the convertible highchair of FIG. 47.

FIG. 49 shows a side view of the convertible highchair of FIG. 47 in a folded position.

DETAILED DESCRIPTION OF EXAMPLE EMBODIMENTS

The present disclosure may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Various embodiments of the present disclosure are directed to a convertible children's highchair. According to various embodiments, the convertible highchair generally comprises a first child seat supported above a floor by a highchair frame, and a second child seat configured for being removably coupled to the first child seat. The second child seat is configured such that, when detached from the highchair's first child seat, it can be used apart from the highchair as a booster seat (e.g., secured to the seating surface of a standard chair or another support surface) in a different mode of use independent of the frame. In certain embodiments, the convertible highchair is convertible for use by children of varying ages. For example, when the second child seat is coupled to the first child seat, the highchair functions in a first configuration as an infant highchair. In a second configuration, when the second child seat is detached, the highchair functions as a toddler booster seat. In a third configuration, the second child seat can also include a base surface configured to stably support the second child seat on a separate support surface (e.g., without the need to be attached to or mounted to a separate base or support member). In the third configuration, the second child seat functions on its own as an infant or toddler booster seat.

Figure 2:
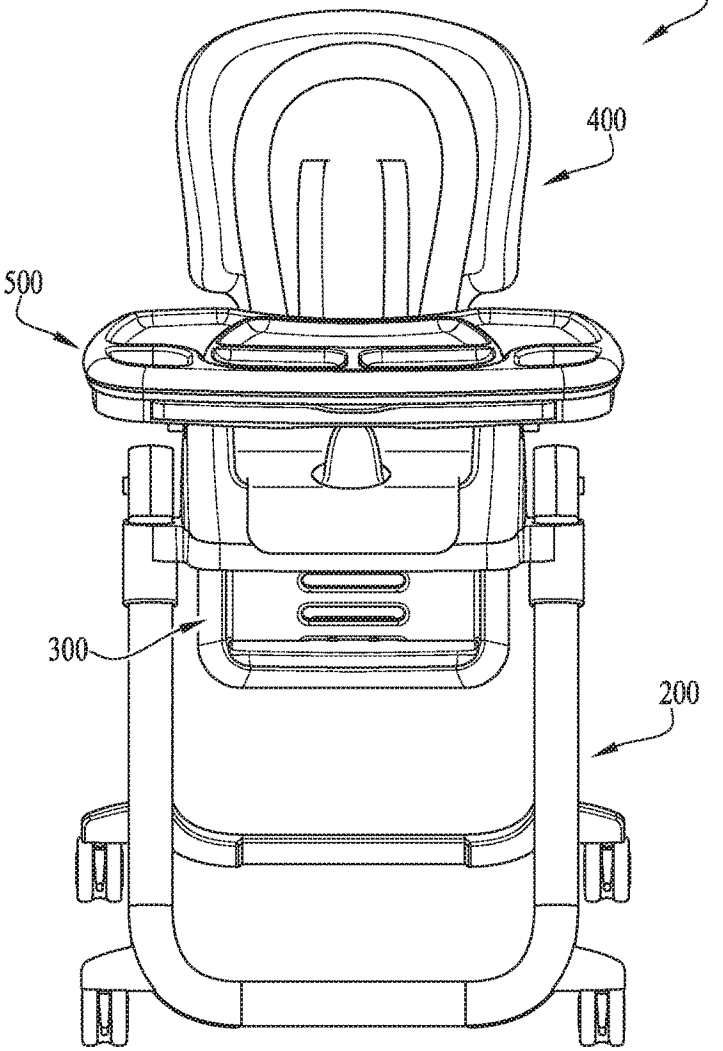
FIG. 2 shows a front view of the convertible highchair of FIG. 1.
Figure 1:
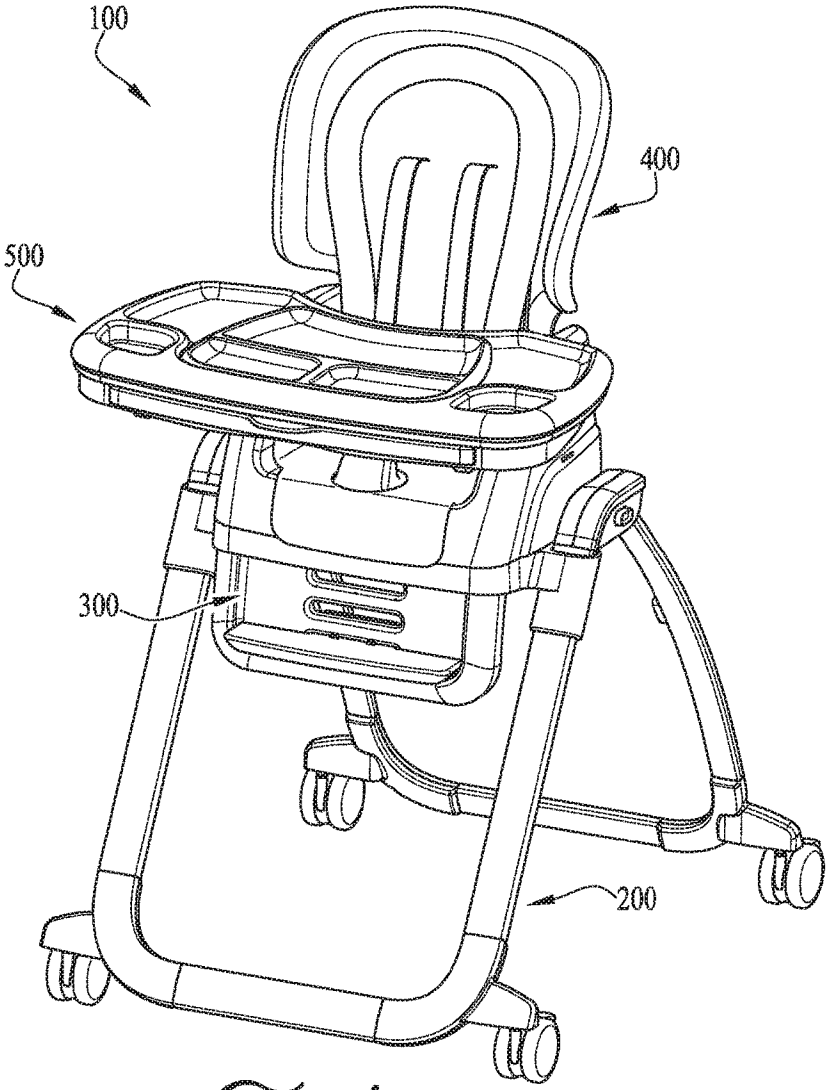
FIG. 1 is a perspective view of a convertible highchair in a first configuration according to an example embodiment.
Figure 3:
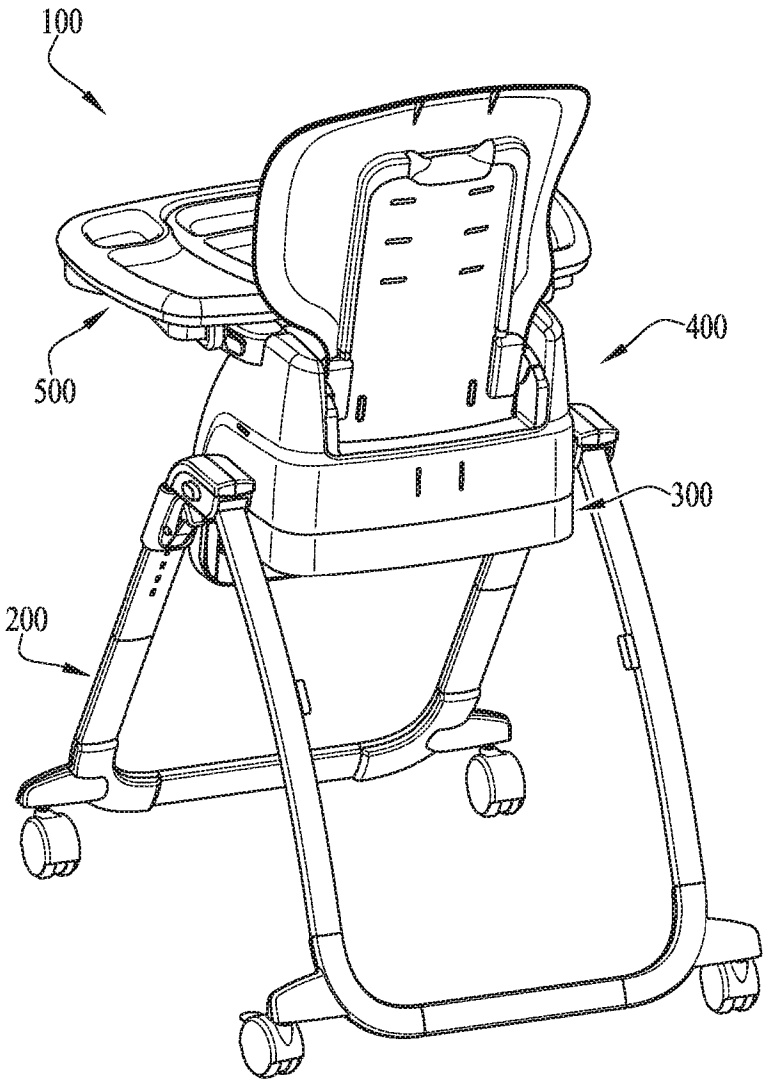
FIG. 3 shows a back view of the convertible highchair of FIG. 1.

With reference now to the drawing figures, wherein like reference numbers represent corresponding parts throughout the several views, FIGS. 1-49 show a convertible highchair 100 according to an example embodiment. The highchair 100 generally includes a frame 200, a first child seat 300 and a second child seat 400 that includes a tray assembly 500. FIGS. 1-3 illustrate the convertible highchair 100 in a first configuration or mode of use as an infant highchair, in which the second child seat 400 is coupled to the first child seat 300 and thereby supported by the frame 200 in a highchair configuration.

Figure 4:
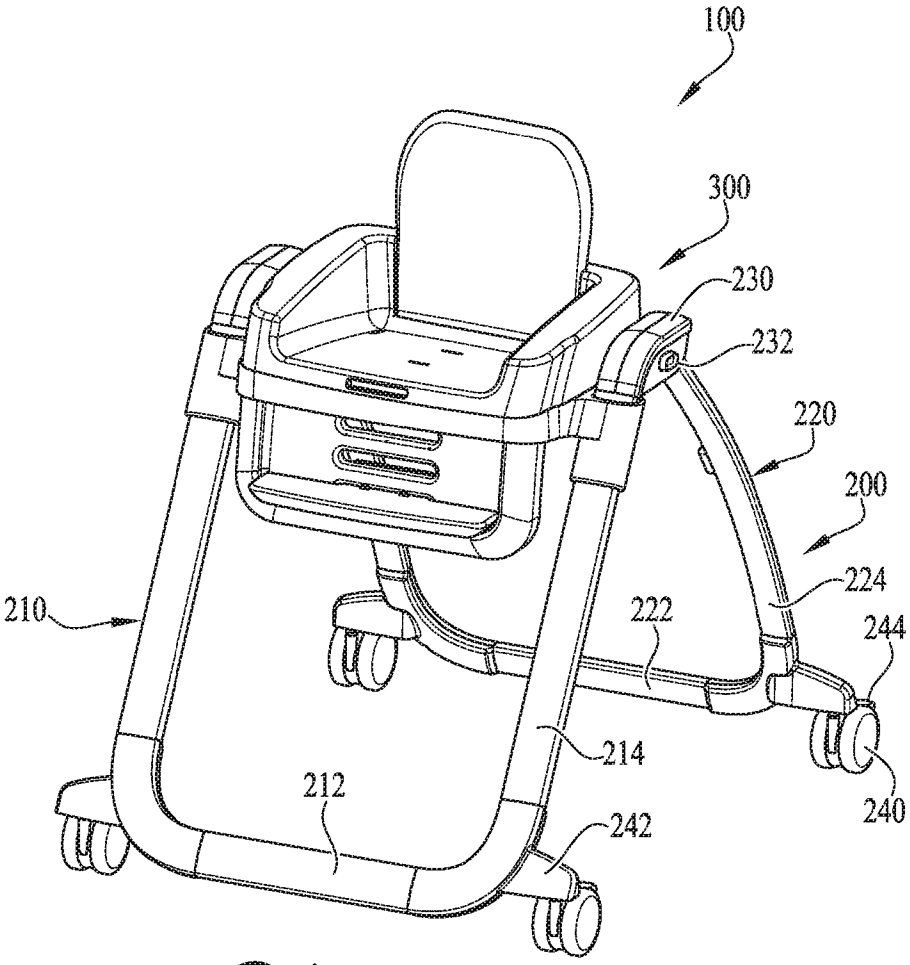
FIG. 4 is a perspective view of a convertible highchair in a second configuration according to an example embodiment.

FIG. 4 illustrates the second configuration in which the convertible highchair 100 is adapted for a second mode of use as a stand-alone toddler booster seat. In this configuration, the second child seat 400 is decoupled from the first child seat 300 and is removed from the highchair 100 to expose the seat portion 310 of the first child seat. The first child seat 300 is supported a distance above the floor by the frame 200.

Figure 6:
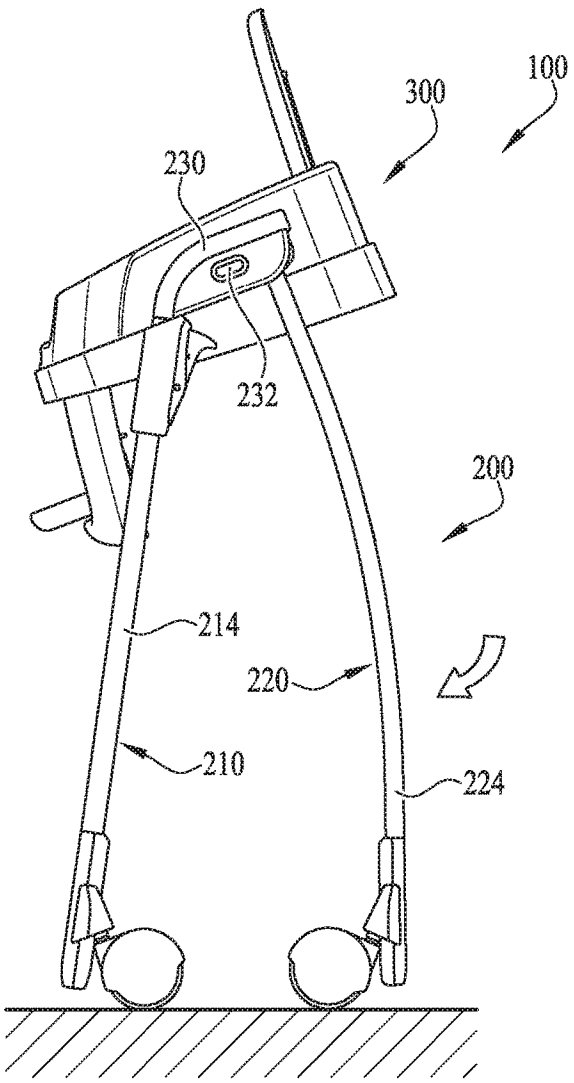
FIG. 6 shows a side view of the convertible highchair of FIG. 4 in a folded position.
Figure 5:
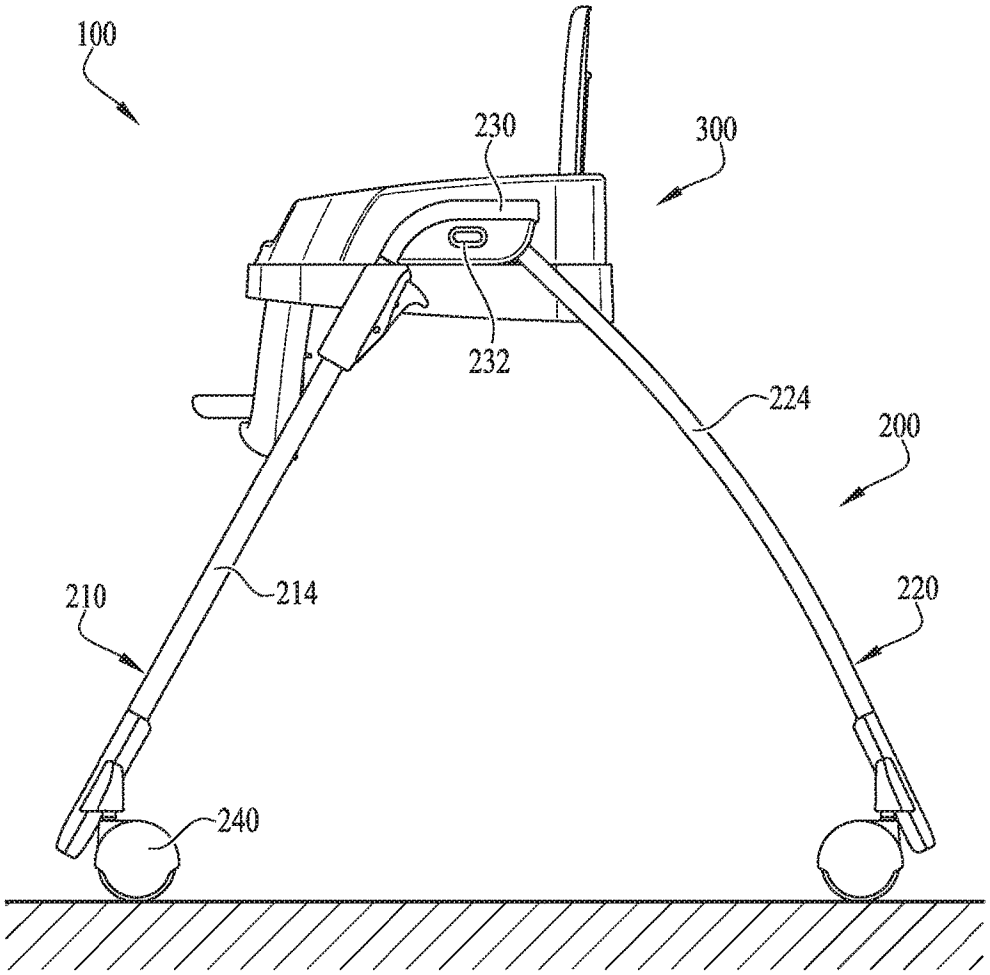
FIG. 5 shows a side view of the convertible highchair of FIG. 4.
Figure 7:
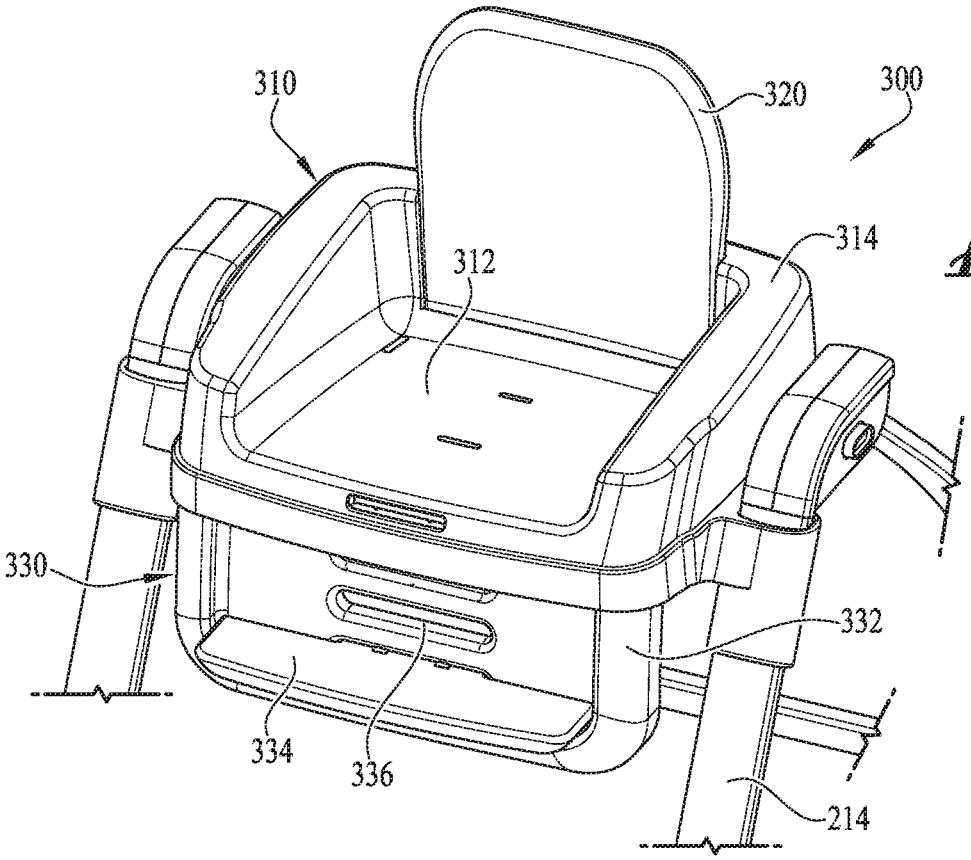
FIG. 7 shows a detailed view of the first child seat of the convertible highchair of FIG. 4.
Figure 8:
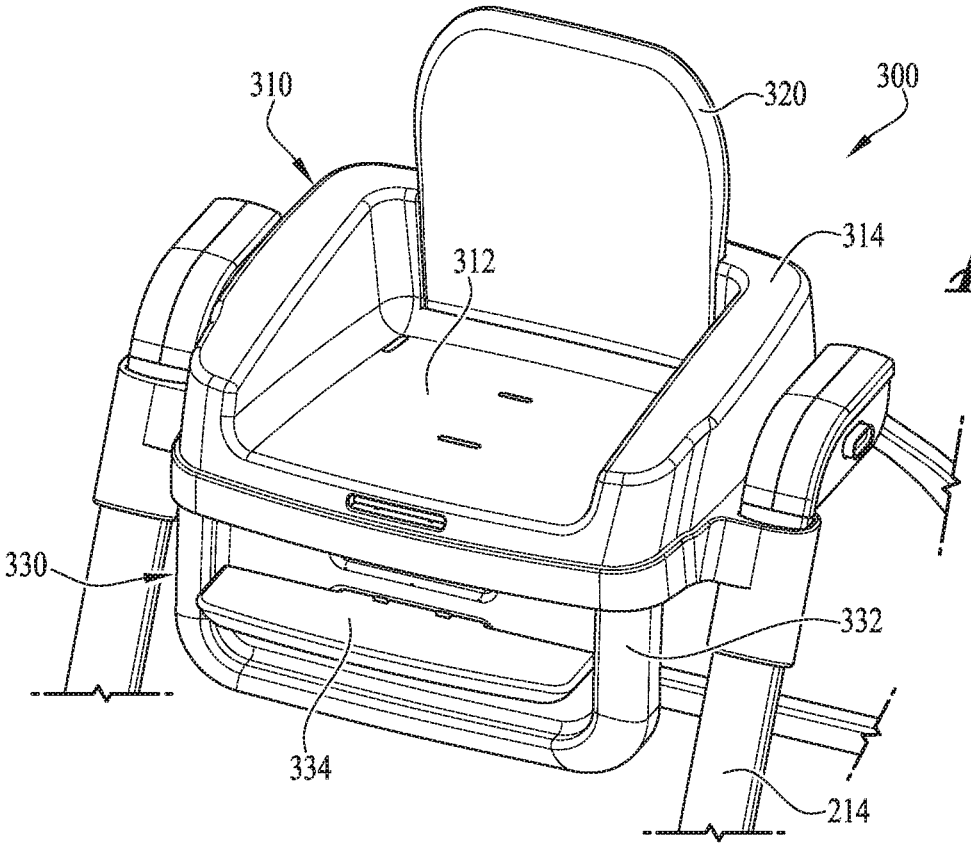
FIG. 8 shows a detailed view of the first child seat of the convertible highchair of FIG. 4.
Figure 9:
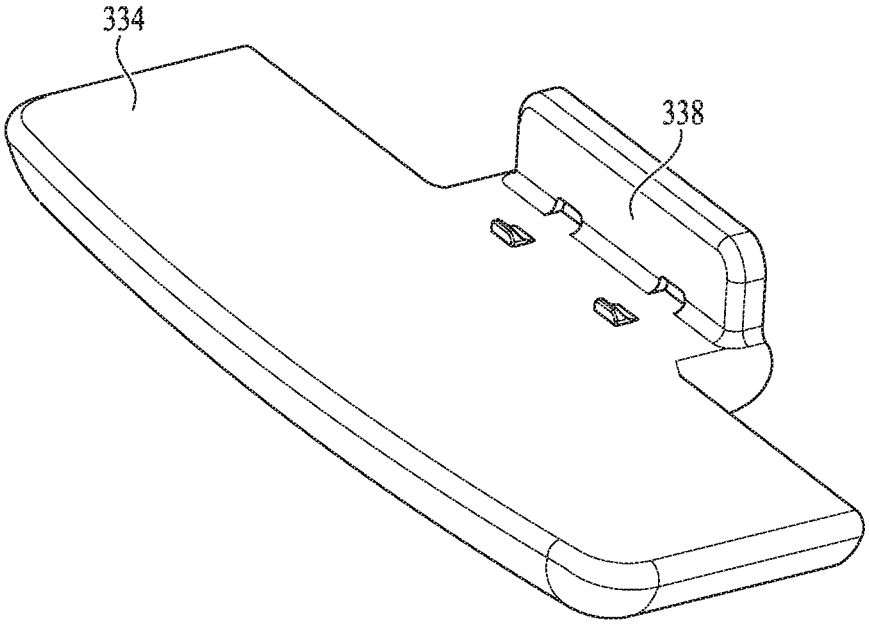
FIG. 9 is a perspective view of a foot rest ledge of a children's highchair according to an example embodiment.
Figure 10:
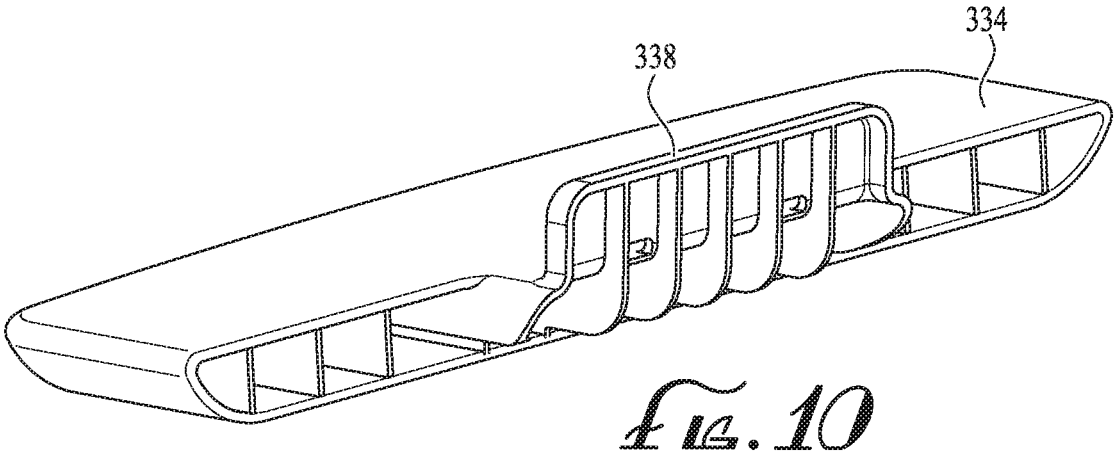
FIG. 10 shows a back view of the foot rest ledge of FIG. 9.

The frame 200, shown in FIGS. 4-6, is generally configured for resting on a floor or other support surface. The frame 200 generally includes a front U-shaped frame member 210 and a back U-shaped frame member 220 connected at a hubs 230 positioned on either side of the frame. The frame members 210, 220 each include a cross frame member 212, 222 and generally upright frame members or legs 214, 224 angled in the form of an A-frame support structure. The cross frame members 212, 222 extend generally parallel with the support surface or floor. The upright frame members 214, 224 extend at an upward angle from the cross frame members 212, 222 to the hub 230. In the depicted embodiment, the front upright frame members 214 are attached to the hubs 230 in a fixed position, whereas the back upright frame members 224 are pivotally attached to the hubs. This pivotal attachment allows a user to fold the frame 200 from an expanded in-use position, shown in FIG. 5, to a more compact storage position, shown in FIG. 6. The hubs 230 can each include a locking mechanism that locks the frame in the in-use and/or storage position. In the example embodiment, the locking mechanism locks the back frame member 220 in both the in-use and folded position. The hubs 230 each include a button 232 that, when pressed, unlocks the locking mechanism and allows the back frame member 220 to pivot between the in-use and folded position. In example embodiments, two-handed operation by an adult is utilized to fold the mechanism, to prevent inadvertent release. In alternate embodiments, another release mechanism, such as a handle or switch, can be used. In alternate embodiments, the front frame member 210 or both frame members are able to pivot. In the depicted embodiment, the frame 200 also includes a plurality of wheels 240 (e.g., castors) that permit the frame 200 to be rolled by a user along the floor. In example embodiments, the wheels 240 have a diameter of at least about 1.5 inches to help the frame roll along a thick carpet. The wheels 240 optionally include caster mechanisms for rotation and turning. In alternate embodiments, larger or smaller wheel diameters can be used. In the depicted embodiment, wheel attachment protrusions 242 attach the wheels 240 to the frame members 210, 220. The protrusions 242 position the wheels 240 a distance outwardly away from the frame members 210, 220 for improved stability. In alternate embodiments, the wheels 240 attach directly to the frame members 210, 220. The wheels 240 can include a lock and release or braking mechanism 244 for selectively locking the wheels to prevent rolling or releasing the wheels to allow rolling. In alternate embodiments, the frame 200 can include other sliding or rolling means.

Figure 51:
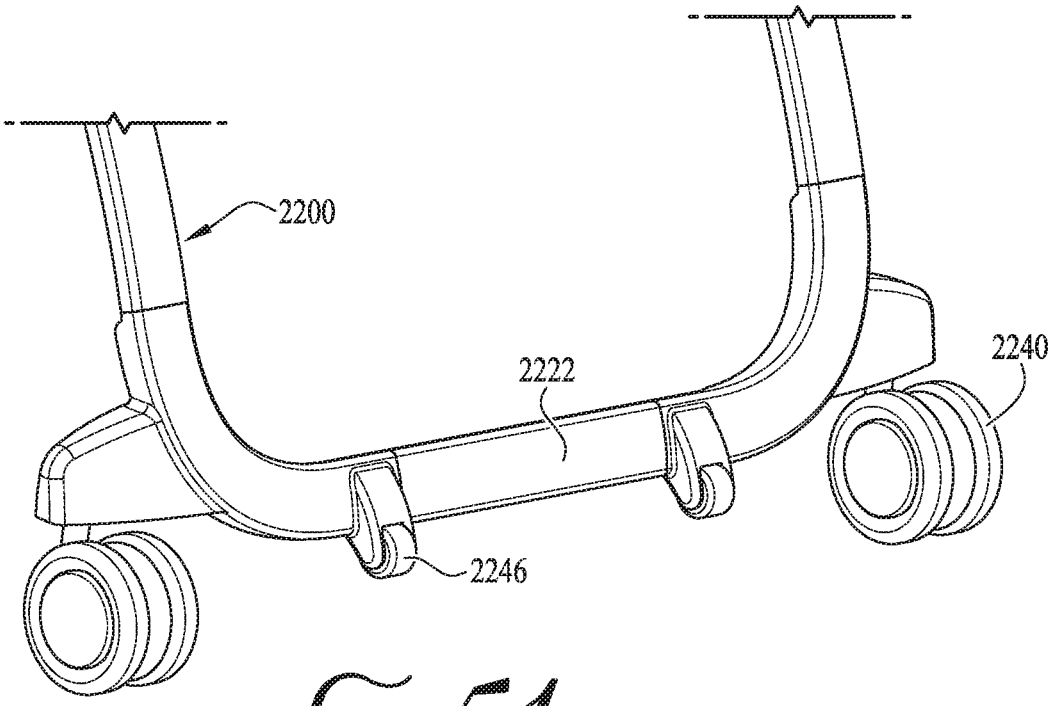
FIG. 51 is a detailed perspective view of a frame of a convertible highchair according to another example embodiment.
Figure 52:
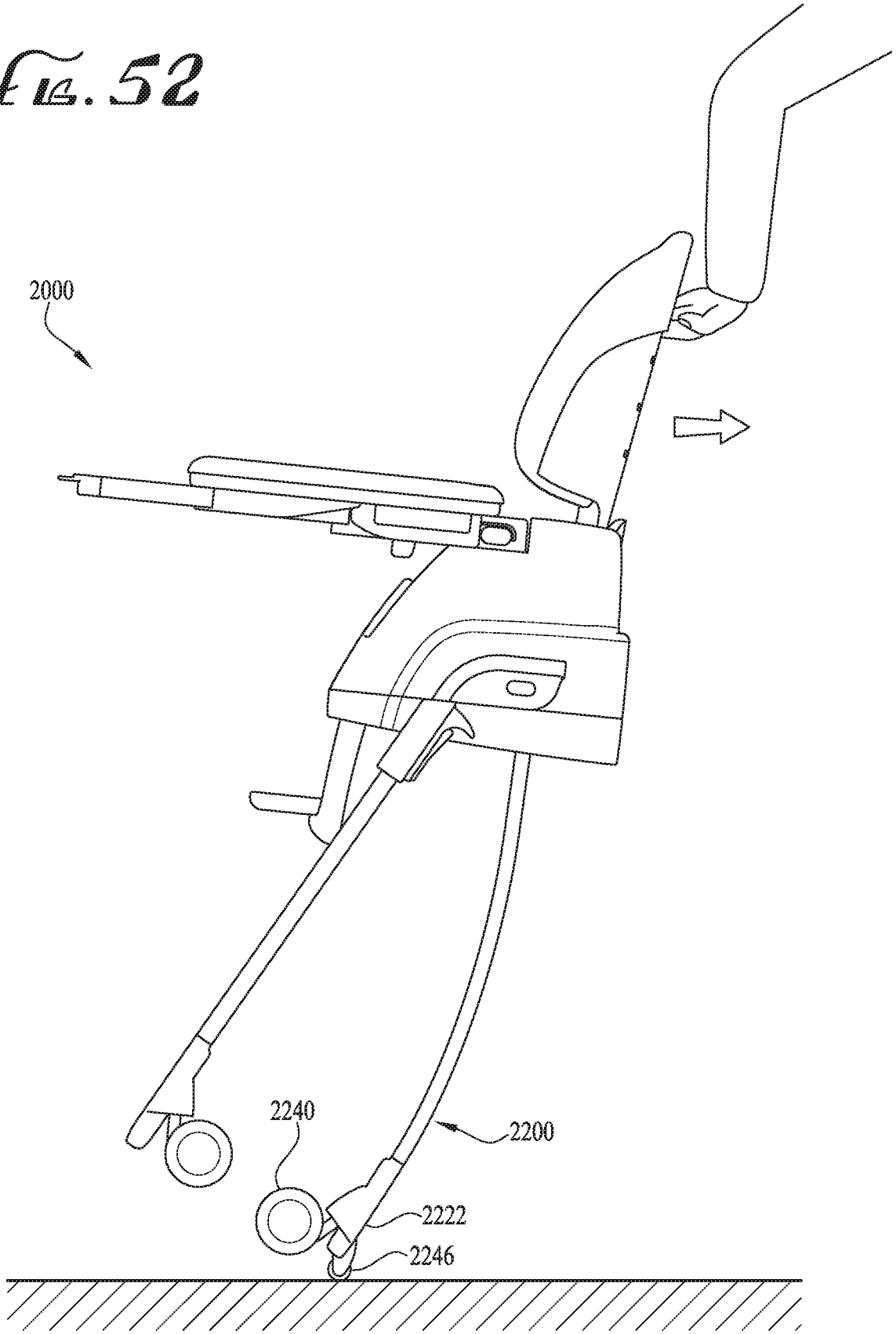
FIG. 52 is a perspective view of the convertible highchair of FIG. 51 in a folded position.

In example embodiments, the frame 2200 of the highchair 2000 can also include additional rolling elements 2246, as shown in FIGS. 51 and 52. In the depicted embodiment, the back cross frame member 2222 can include one or more rollers positioned in between the wheels 2240. The rollers 2246 are configured to not engage the support surface when the frame 2200 is in the unfolded use position, as shown in FIG. 51. In example embodiments, the rollers 2246 have a smaller diameter than the wheels 2240. The rollers 2246 are configured to engage the support surface when the frame 2200 is pulled by a caregiver in the folded position, as shown in FIG. 52. The rollers 2246 help the caregiver move the highchair 2000 in this folded, angled position.

The first child seat 300, shown in FIGS. 7-15, is attached to the front vertical frame members 214 of the frame 200 and supported a distance above the support surface. The first child seat 300 generally includes a seat portion 310, a backrest 320 and optionally a footrest 330. In the depicted embodiment, the seat portion 310 includes a seating surface 312 and shoulders or armrests 314. The seating surface 312 provides a surface substantially parallel to the floor or support surface configured to support a child seated thereon. The shoulders 314 extend upwardly from lateral sides and back of the seating surface 312. The shoulders 314 can act as armrest for a child seated therein. The backrest 320 extends upward from the seating surface 312 to provide back support to a child seated thereon. In the example embodiment, the back rest 320 is pivotally attached to the seating surface 312 and is able to be moved between an in-use position, shown in FIG. 7, and a folded position, discussed further below. In alternate embodiments, the back rest 320 is detachable from the first child seat 300 or fixed in position. In the depicted embodiment, the first child seat 300 is generally dimensioned to accommodate a toddler-age child. As such, the convertible highchair 100 is well suited to function as a stand-alone toddler highchair or booster in the second configuration. However, as will be appreciated from the description herein, various other embodiments of the first child seat 300 can be dimensioned for supporting children of any age.

Figure 50:
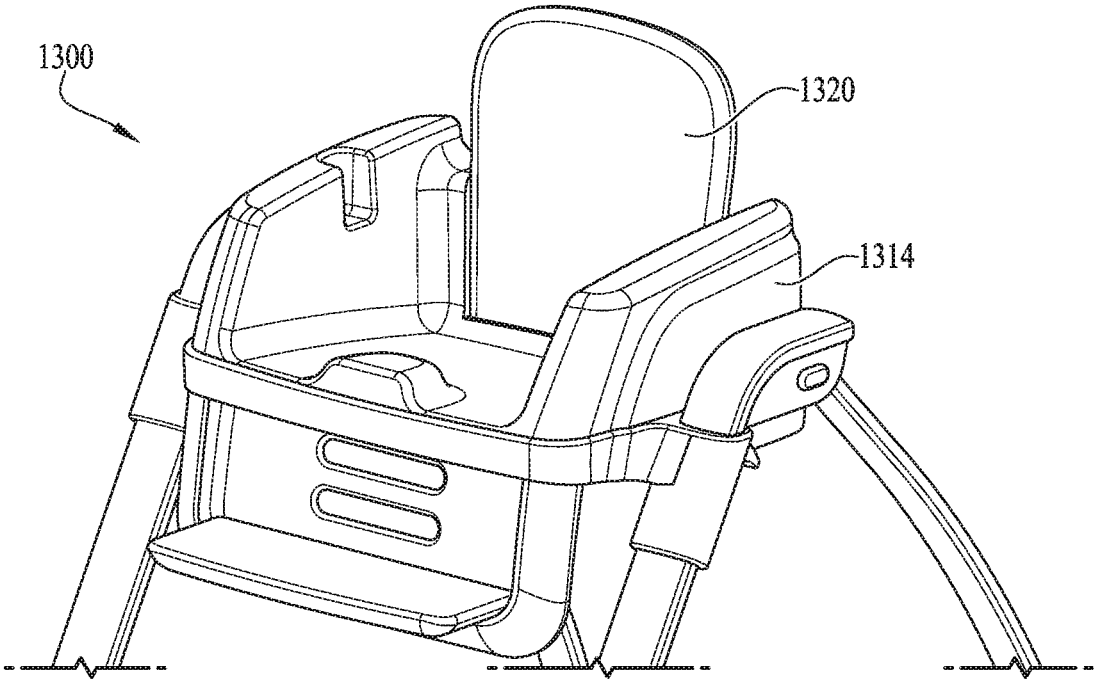
FIG. 50 is a perspective view of a first child seat of a convertible highchair according to another example embodiment.

In example embodiments of the first child seat 1300, the shoulders 1314 are dimensioned to comply with applicable safety standards, as shown in FIG. 50. For example, the European Committee for Standardization's requirements for Children's Highchairs includes minimum dimensions for lateral protections. In example embodiments, the shoulders 1314 are configured such that the distance between the top of the shoulder and the bottom of the back rest 1320 is at least about 145 mm. The distance between the top of the shoulder 1314 and the bottom of the back rest 1320 can also be at least about 150 mm. In other embodiments, the distance between the top of the shoulder 1314 and the bottom of the back rest 1320 can be smaller than 145 mm or larger than 150 mm.

Figure 11:
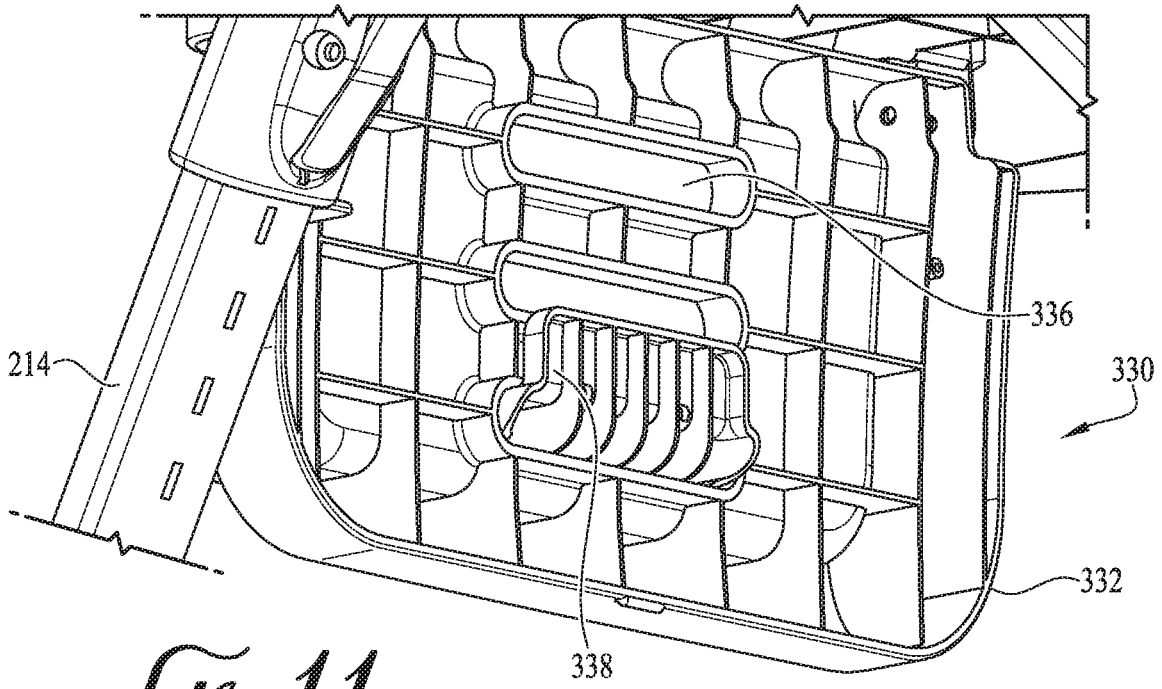
FIG. 11 is a detailed view of the back of the foot rest of the convertible highchair of FIG. 4.
Figure 12:
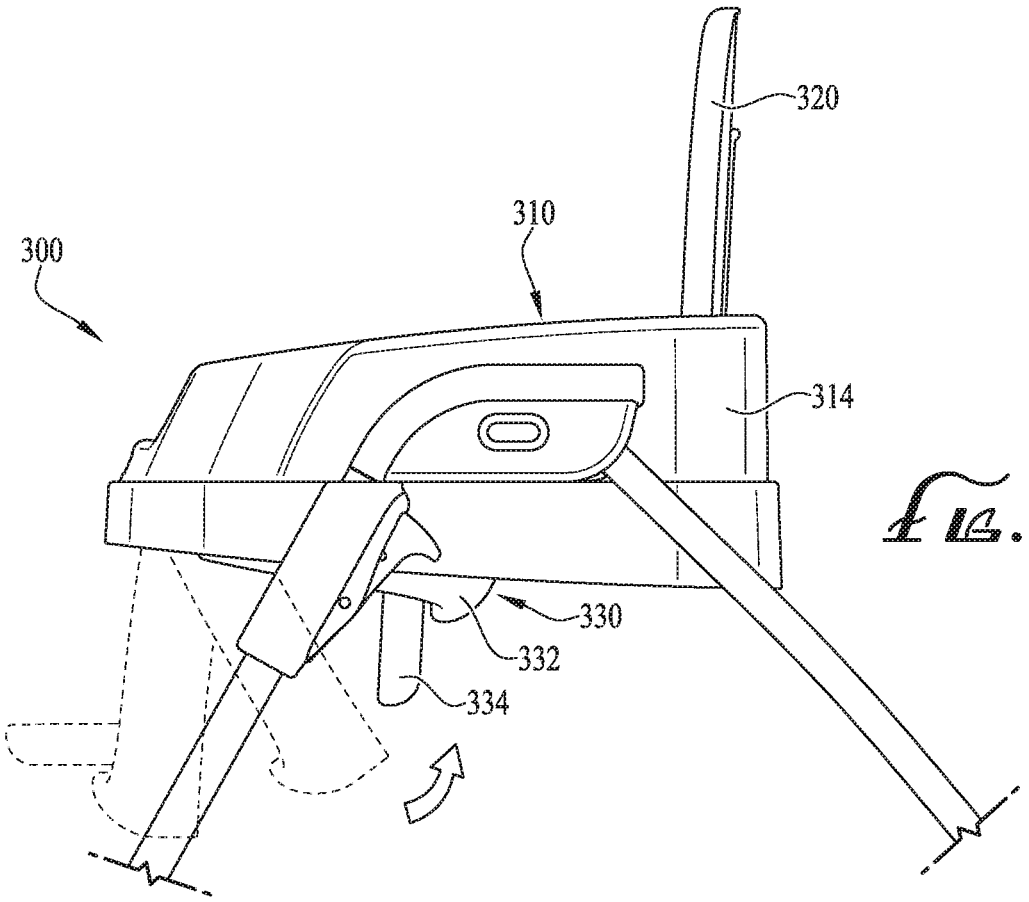
FIG. 12 shows a side view of the foot rest of the convertible highchair of FIG. 4.

The footrest 330, shown in detail in FIGS. 8-12, includes a footrest base 332 and a ledge 334. The foot rest base 332 is formed from a panel that, in the in-use position shown in FIG. 7, extends downward from the substantially front edge of the bottom of the seat portion 310 of the first child seat 300. In the in-use position, the footrest base 332 is positioned substantially perpendicular to the seating surface 312. The ledge 334 is removably attached to the footrest base 332 such that the flat surface of the ledge is substantially perpendicular to the foot rest base 332. The ledge 334 is configured to, in the in-use position, provide a surface to support the feet of a child seated in the first child seat 300. The footrest ledge 334 can be positioned on the footrest base 332 at a variety of distances relative to the seating surface 312 to accommodate different leg lengths of the child seated therein. In the depicted embodiment, the footrest base 332 includes a plurality of receiving slots 336 and the ledge 334 includes a tab 338 extending perpendicularly from the ledge surface. To removably attach the ledge 334 to the footrest base 332, the tab 338 of the ledge is inserted through a slot 336 in the foot rest base and positioned such that a flat portion of the tab abuts the back of the footrest base, as shown in FIG. 11. To adjust the distance of the ledge 334 relative to the seating surface 312, the ledge is attached to different slots 336 in the footrest base 332. In alternate embodiments, the footrest ledge 334 can be repositionably attached to the footrest base 332 using other attachment means. In the depicted embodiment, the footrest 330 is movable between the in-use position, shown in FIG. 7, and a folded position, shown in FIG. 12. The footrest base 332 is pivotally attached to the bottom of the seat portion 310, allowing the footrest 330 to be folded to a position underneath and parallel to the bottom of the seat portion, shown in FIG. 12. In alternate embodiments, the foot rest 330 removable from the first child seat 300. In other embodiments, the footrest is repositionably attached to the frame 200.

Figure 13:
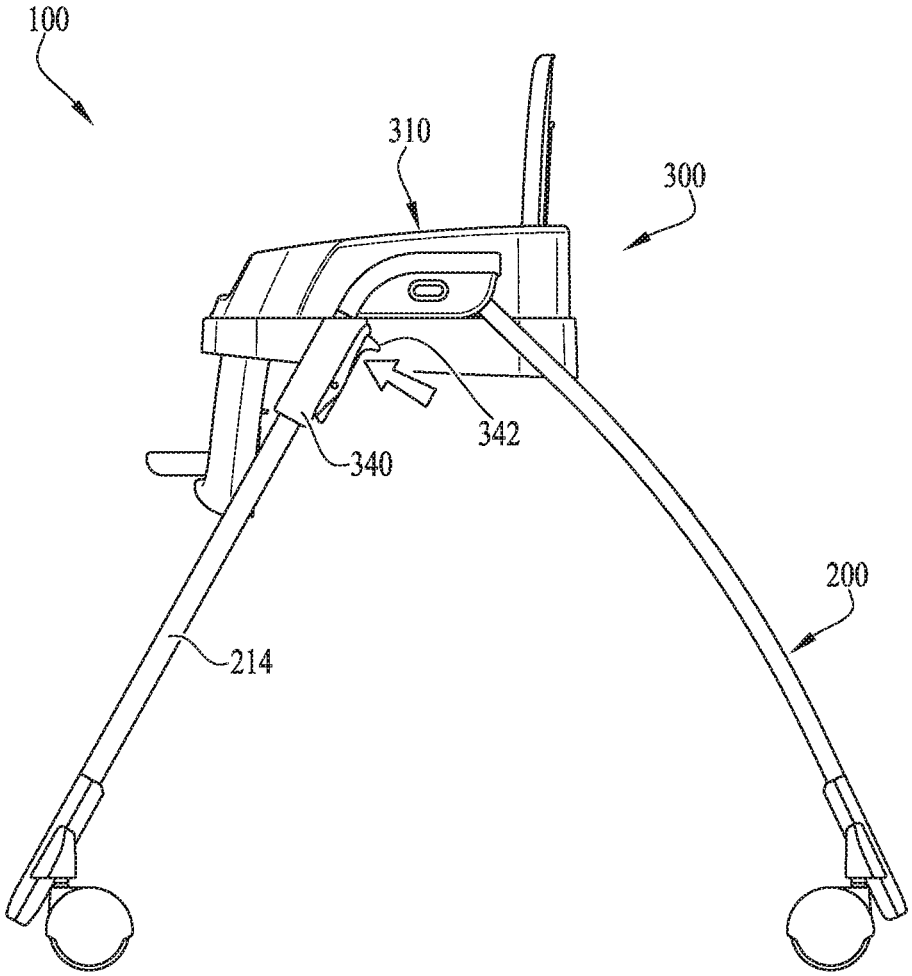
FIG. 13 shows a side view of the convertible highchair of FIG. 4.
Figure 14:
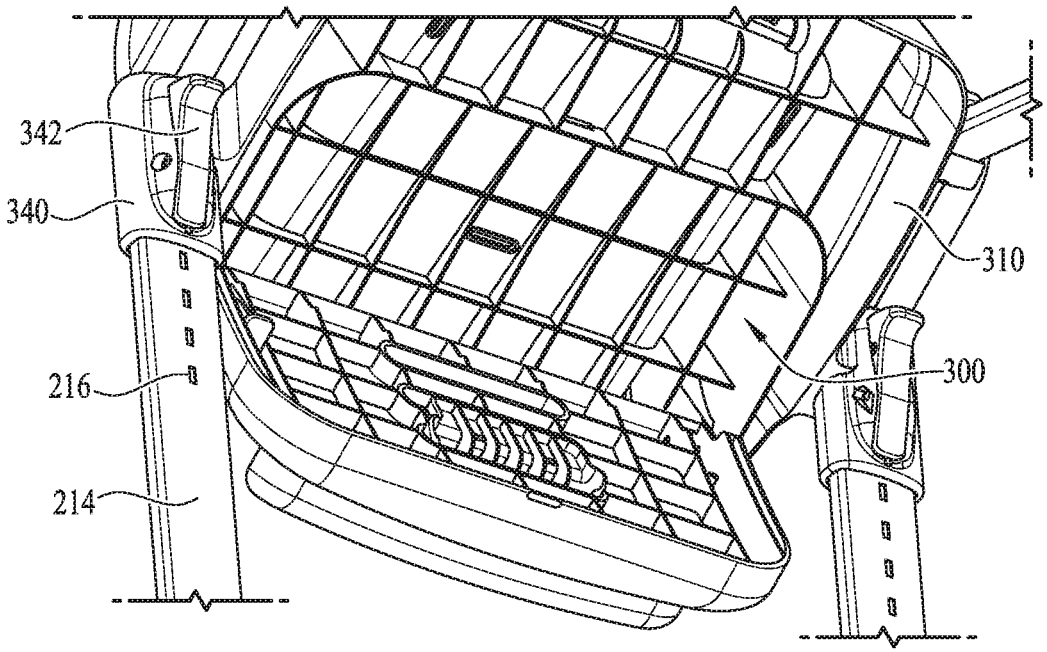
FIG. 14 shows a bottom view of the convertible highchair of FIG. 4.
Figure 15:
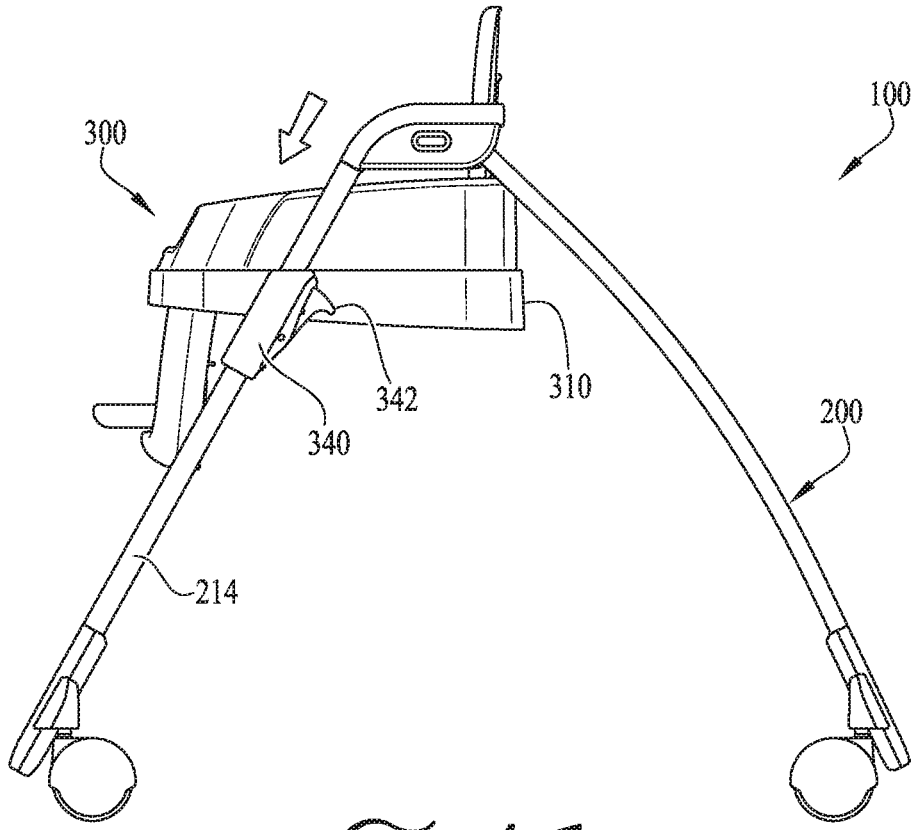
FIG. 15 shows a side view of the convertible highchair of FIG. 4.
Figure 16:
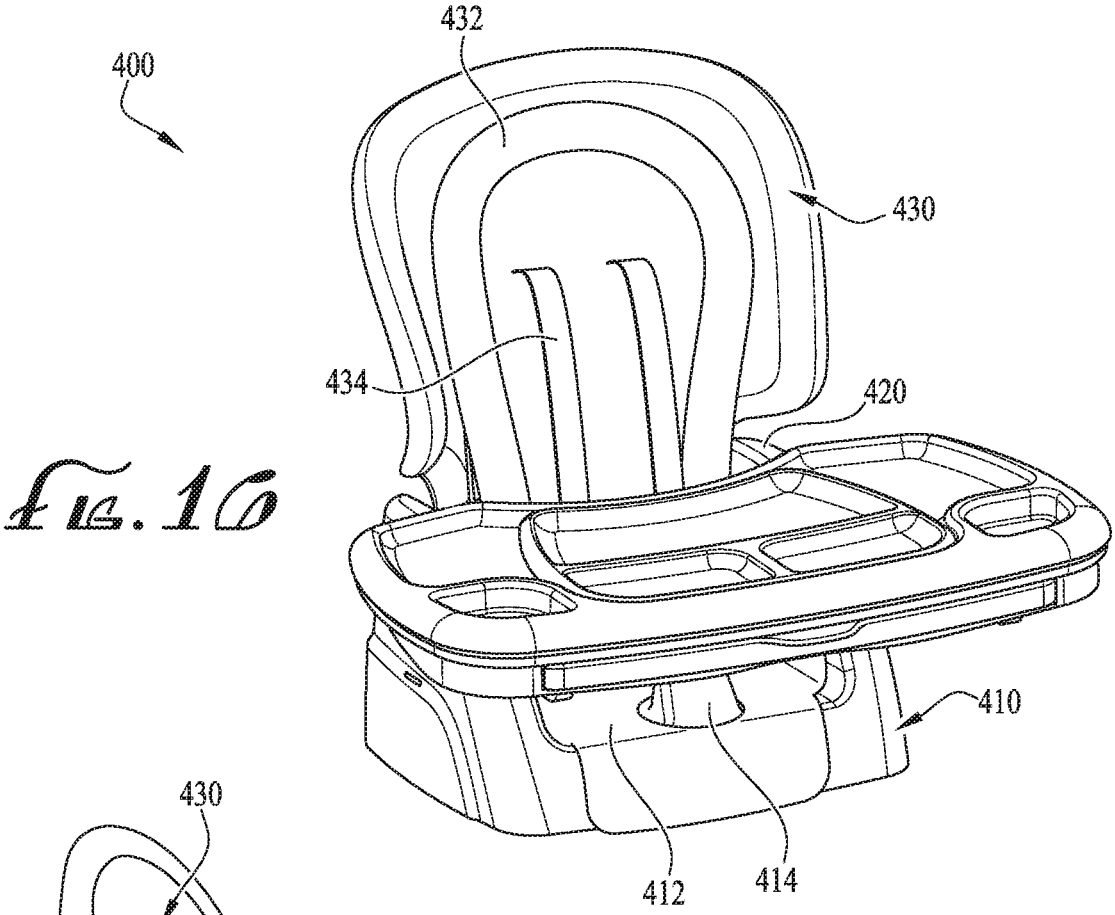
FIG. 16 is a perspective view of a second child seat of a convertible highchair according to an example embodiment.
Figure 17:
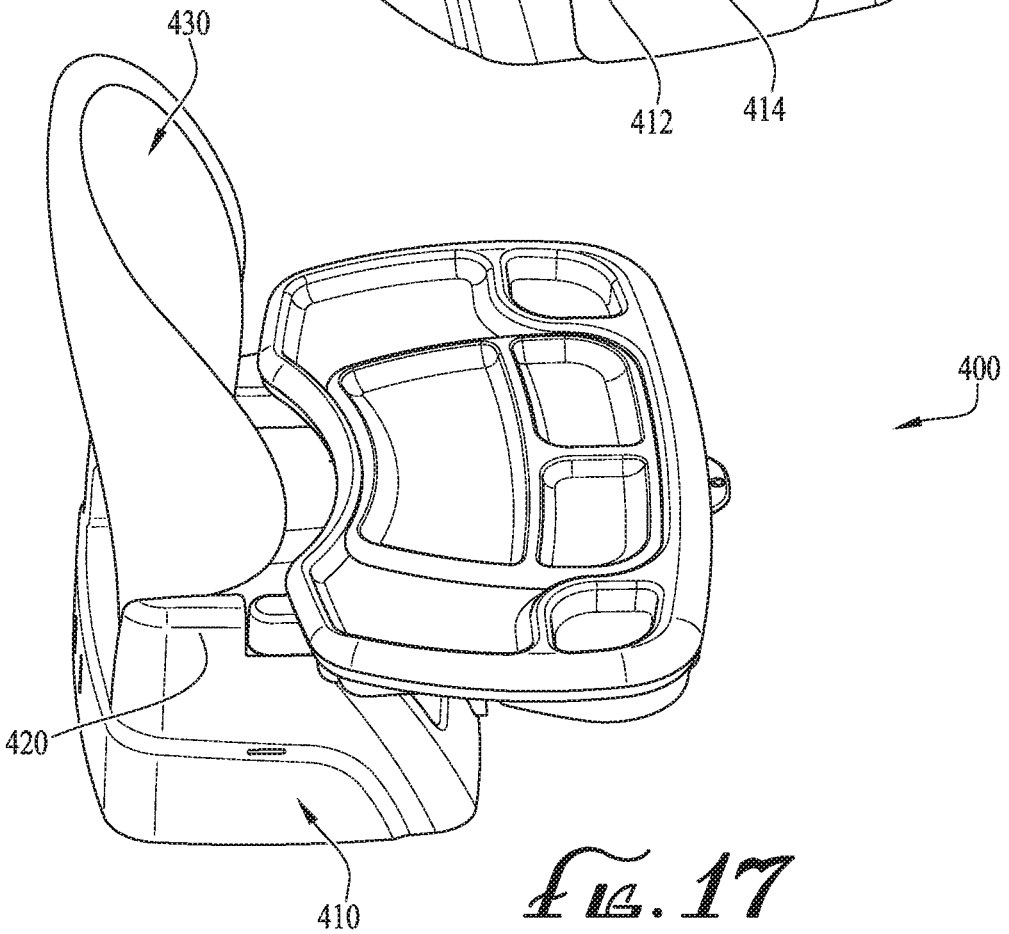
FIG. 17 shows a side view of the second child seat of FIG. 16.

The first child seat 300 is repositionably attached to the front upright frame members 214 of the frame 200 to provide height adjustment, as shown in FIGS. 13-15. In the depicted embodiment, the first child seat 300 includes attachment collars 340 positioned either side of the seat portion 310. The collars 340 are configured to surround and couple to the front upright frame members 214. This coupling is configured to be height adjustable in order to allow an adult caregiver to selectively raise and lower the first child seat 300. The attachment collars 340 each include a spring biased lever 342 with a first end configured to engage a series of notches or holes 216 on the back side of the front upright frame members 214, as shown in FIG. 14. The levers 342 are spring biased such that the first end remains engaged with the holes 216. To adjust the height of the first child seat 300, the adult caregiver can push the second end of the levers 342 to disengage the holes and the collars can be slid along the front vertical frame member 214 to the desired height. The first end of each lever 342 is released to reengage the holes 216 corresponding to the desired height. In the depicted embodiment, the second end of the lever 342 includes a hook portion configured to assist the caregiver when lifting or lowering the first child seat 300 to a different height. In alternate embodiments, alternate height adjustment mechanisms can be used. In alternate embodiments, the first child seat can be repositionably attached to the back upright frame members 224. In example embodiments, two-handed operation prevents inadvertent release and movement, and positioning the actuators away from access by a child seated in the seat prevents the child from accidentally releasing and moving the seat position.

Figure 53:
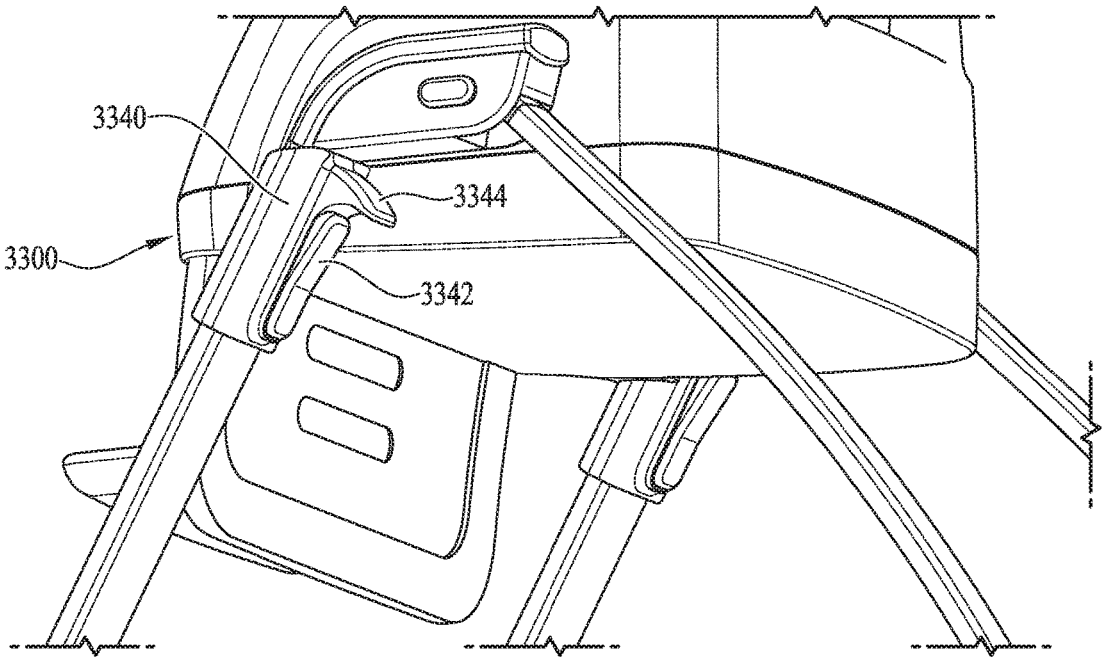
FIG. 53 is a detailed perspective view of a first child seat of a convertible highchair according to another example embodiment.

In other embodiments of the first child seat 3300, the attachment collars 3340 include a hook-shaped portion 3344 independent of the lever 3342, as shown in FIG. 53. The hook-shaped portion 3344 is generally positioned above the lever 3342. The hook-shaped portion 3344 is configured to assist the caregiver when lifting or lowering the first child seat 3300 to a different height. In this configuration, the caregiver can use the hook-shaped portion 3344 to support the weight of the first child seat 3300 independent of the pushing or releasing of the lever 3342.

In alternate embodiments of the highchair 5000, the first child seat 5300 is attached to the front upright frame member 5214 in a fixed position. In this embodiment, shown in FIG. 55, the front upright frame members 5214 can include a telescoping feature configured to adjust the height of the first child seat 5300. For example, the front upright frame members 5214 can include a base collar 5216 and an upper leg 5218. The upper leg 5218 is configured to slidingly engage with the base collar 5216. The position of the upper leg 5218 within the base collar 5216 can be adjusted to adjust the length of the upright frame member 5214 and thereby the height of the first child seat 5300. In alternate embodiments, both the front upright frame member 5214 and the back upright frame member 5224 include telescoping features.

The second child seat 400, shown in FIGS. 16-19, generally includes a base 410 and a seat back 430. The base 410 includes a seating surface 412 that provides a surface substantially parallel to the floor and is configured to support a child or infant seated thereon. In the depicted embodiment, the seating surface 412 includes an upwardly extending crotch restraint 414 configured to prevent a child from sliding off the seating surface. The base 410 also includes shoulders 420 that extend upwardly from the lateral sides of the seating surface 412 and can function as armrest for a child seated therein. The seat back 430 is configured for supporting the back of child seated on the seating surface 412. In example embodiments, the seating surface 412, crotch restraint 414, shoulders 420 and seat back 430 are generally dimensioned to accommodate and infant-age child. Various other embodiments of the second child seat 400 can be dimensioned for supporting children of any age. The seat back 430 can include attached soft goods 432. In the depicted embodiment, the soft goods 432 are configured to extend over the seating surface 412. The seat back 430 can also include a safety harness 434 configured to secure an infant or child within the second child seat 400. In alternate embodiments, the second child seat 400 includes handles configured to provide an easy gripping surface for a user to grasp and move the second child seat.

Figure 18:
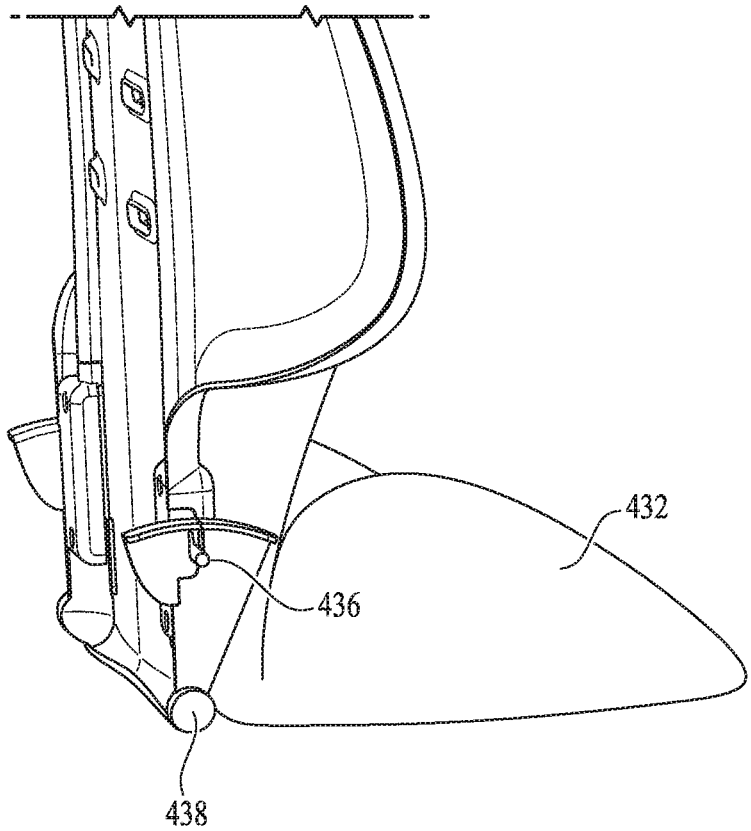
FIG. 18 shows a side view of the seat back of the second child seat of FIG. 16.
Figure 19:
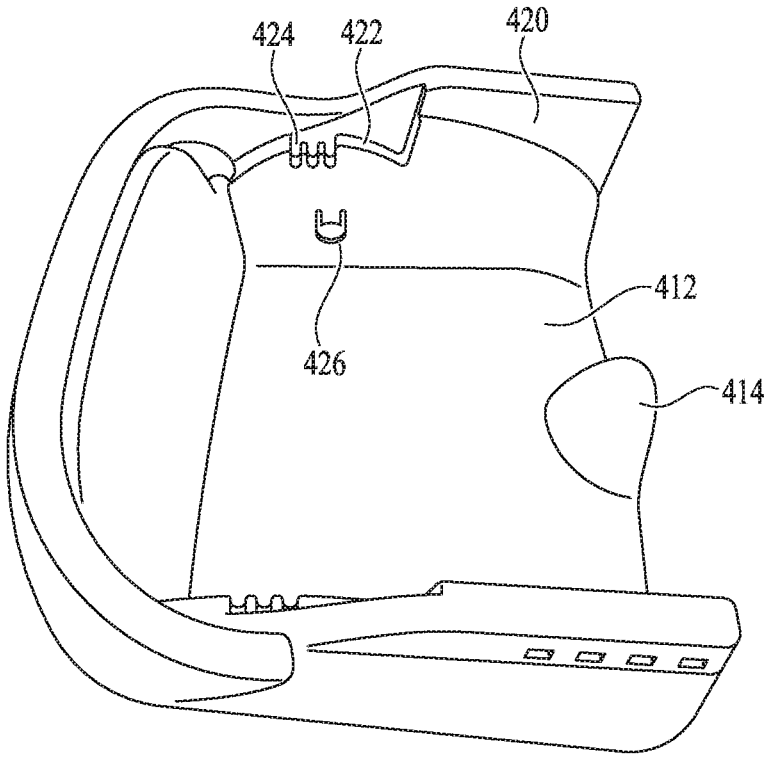
FIG. 19 shows a top view of the base of the second child seat of FIG. 16.

In example embodiments, the angle of recline between the seat back 430 and the seating surface 412 can be adjusted. As shown in FIGS. 18 and 19, the shoulder 420 of the seat base 410 includes a curved surface 422 with a series of positioning notches 424, corresponding to a series of recline angles, and a receiver 426. The seat back 430 includes a positioning pin 436 and a pivot projection 438. The pivot projection 438 is configured to pivotally couple with the receiver 426 such that the seat back 430 can pivot relative to the seating surface 412. The positioning pin 436 is configured to engage with a positioning notch 424 to hold the seat back 430 at a certain recline angle. To adjust the recline angle of the seat back 430, the user can lift the seat back to disengage the positioning pin 436 from a positioning notch 424 and slide the positioning pin along the curved surface 422 to engage the positioning notch corresponding to the desired recline angle.

Figure 20:
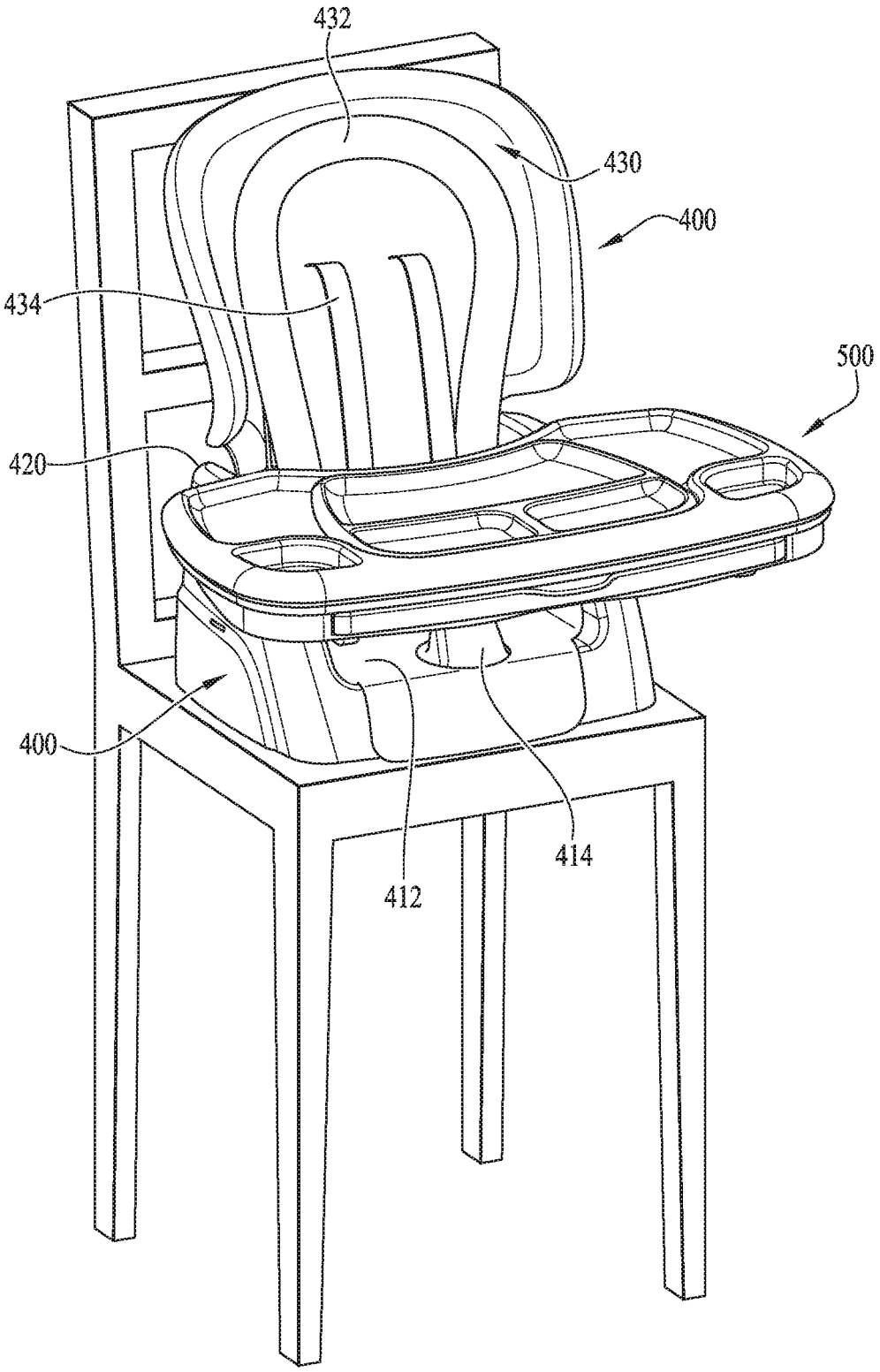
FIG. 20 is a perspective view of the second child seat of a convertible highchair in a third configuration and mode of use according to an example embodiment.
Figure 21:
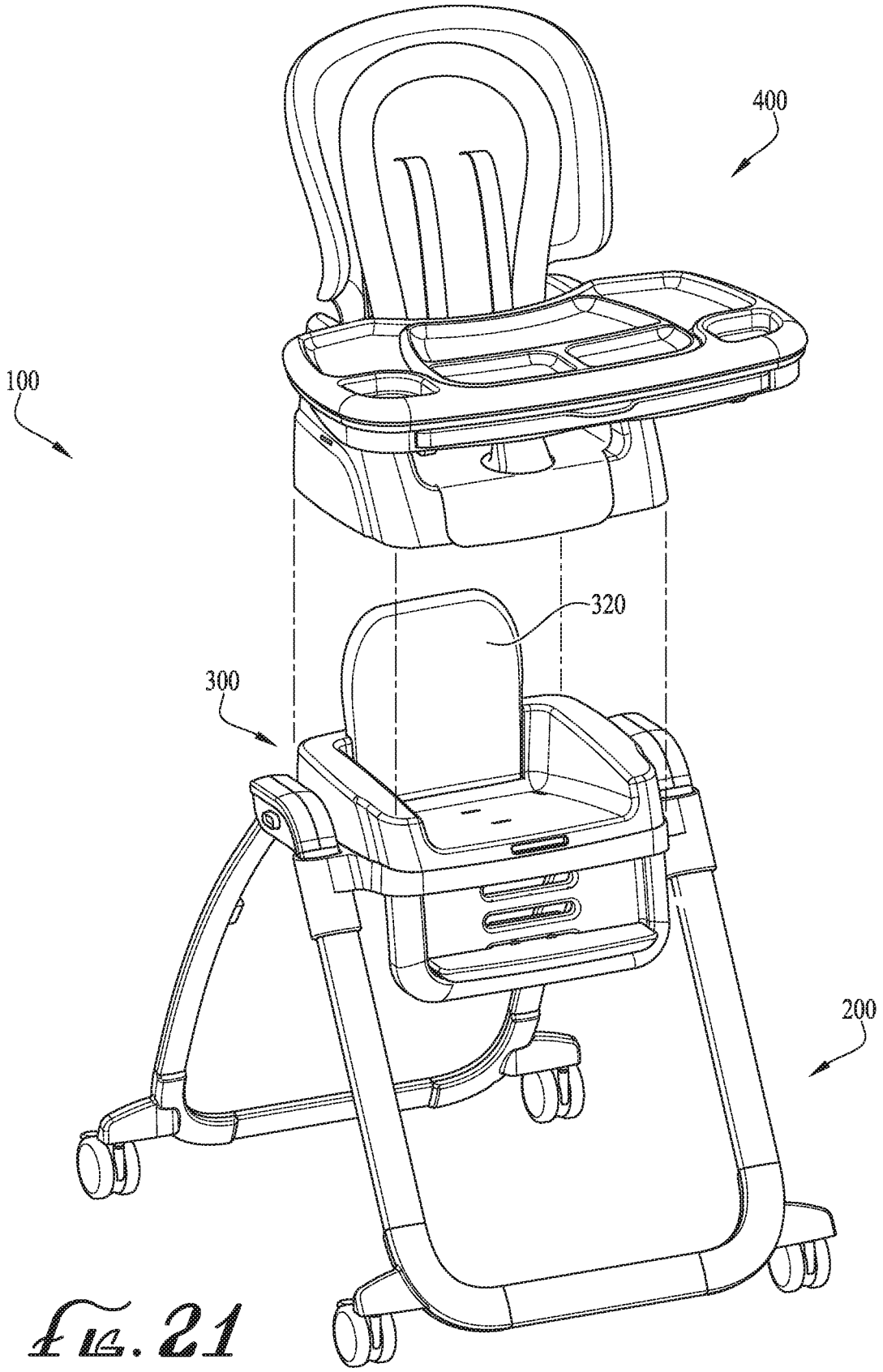
FIG. 21 is an exploded view of a convertible highchair in a first configuration according to an example embodiment.

The second child seat 400 can be attached to the first child seat 300 in a first configuration of the convertible highchair 100 as shown in FIGS. 1-3, for example for use as a highchair for an infant. FIG. 20 depicts the third configuration of the convertible highchair 100 in which the second child seat 400 is adapted as an infant booster seat. In this configuration, the second child seat 400 is configured for independent use apart from the highchair frame 200. The second child seat 400 is configured to rest on a separate support surface, for example, a generally flat seat surface of an adult dining chair. The bottom of the second child seat base 410 is configured to rest directly on the support surface, without the need for a separate base component. In example embodiments, straps are provided to secure the second child seat 400 to the adult dining chair or other support surface.

Figure 22:
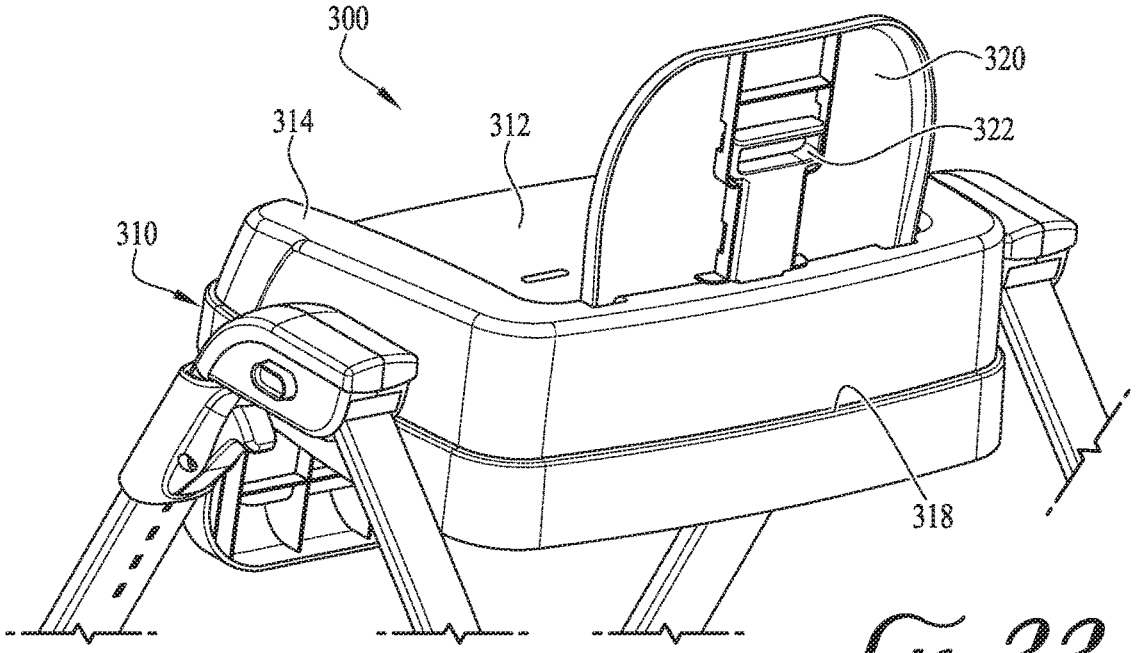
FIG. 22 shows a back view of the first child seat of the convertible highchair of FIG. 21.
Figure 23:
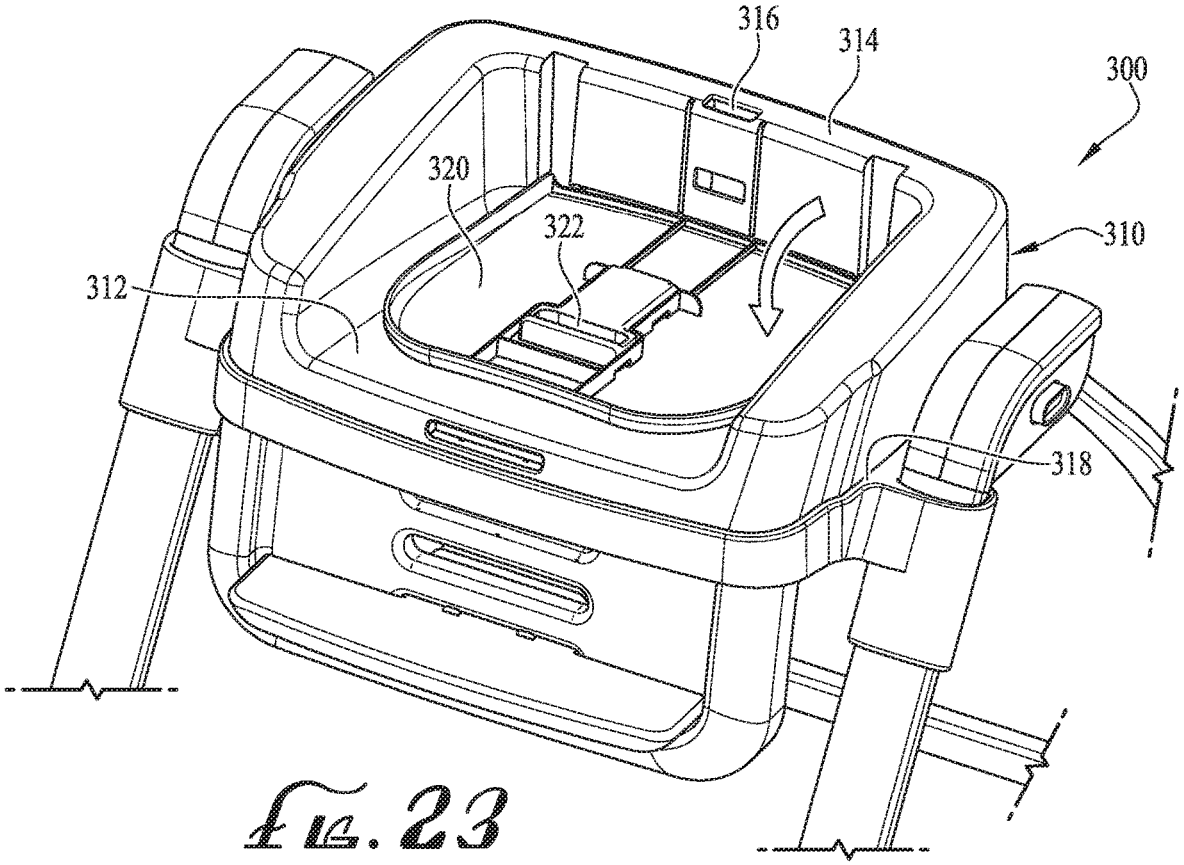
FIG. 23 shows a perspective view of the first child seat of the convertible highchair of FIG. 21.
Figure 24:
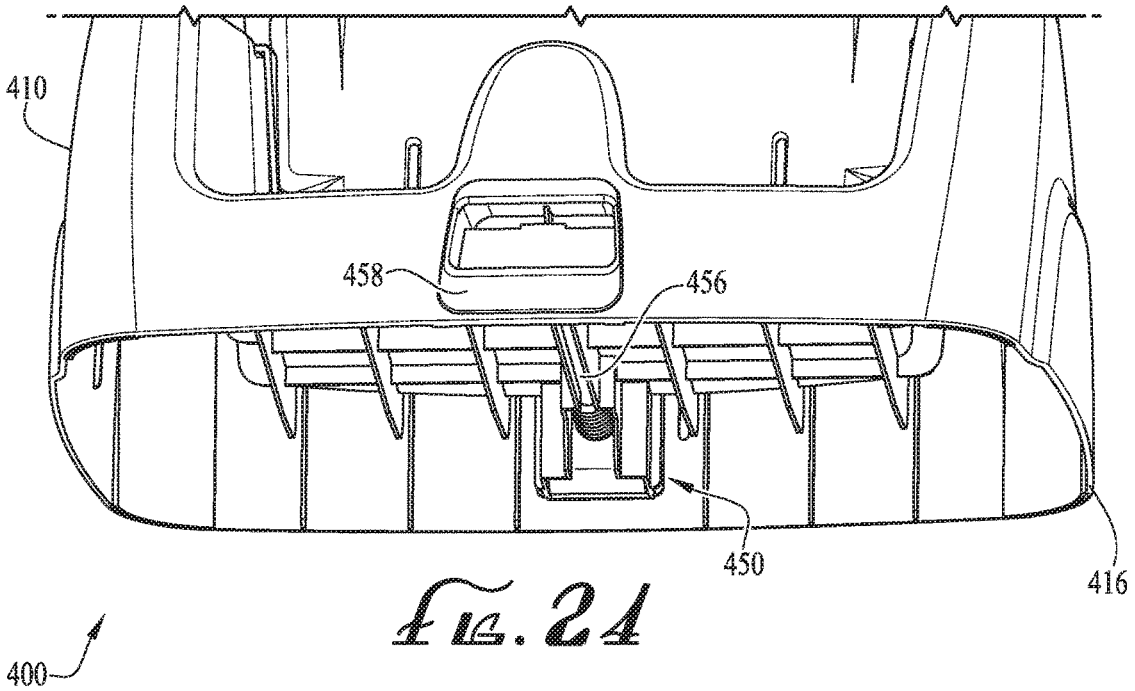
FIG. 24 shows a detailed view of the second child seat base of FIG. 21.
Figure 25:
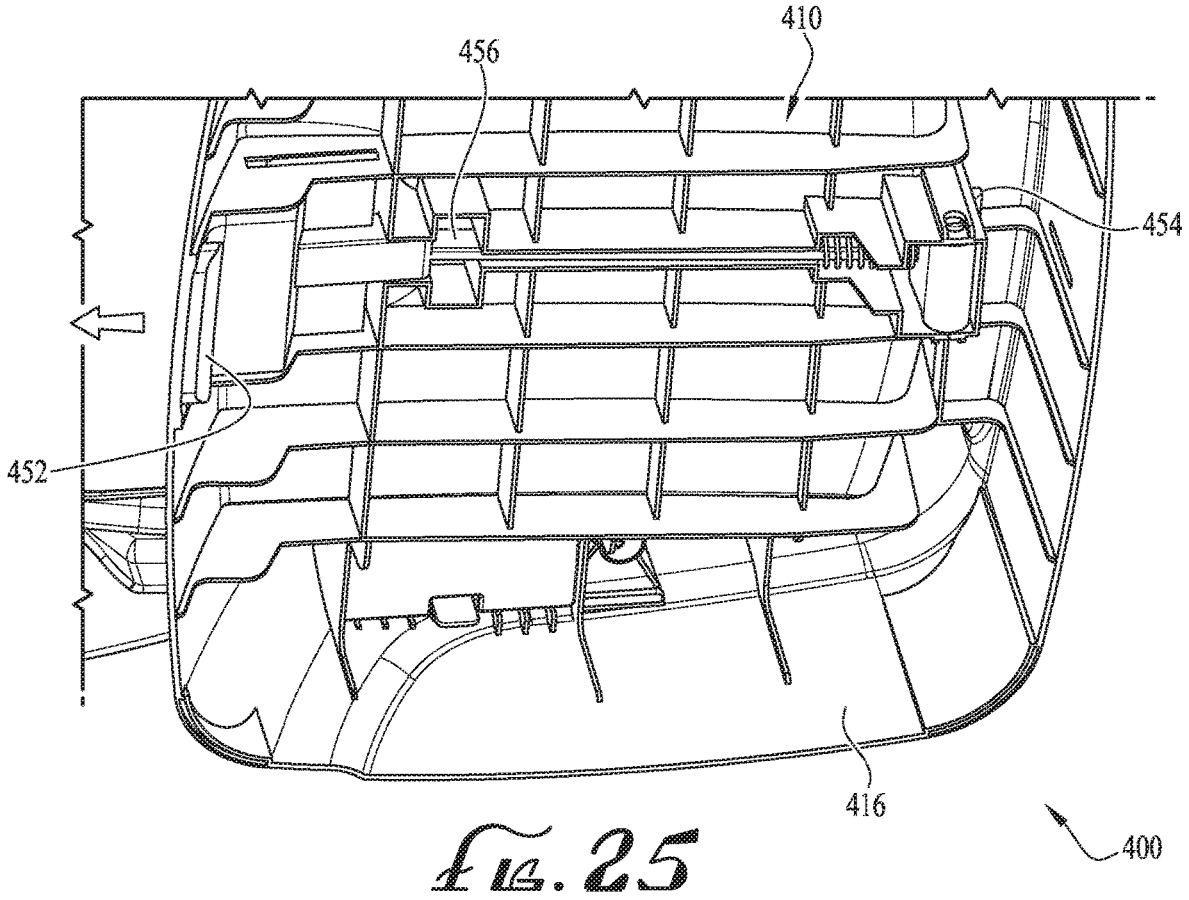
FIG. 25 shows a bottom view of the second child seat base of FIG. 26.
Figure 26:
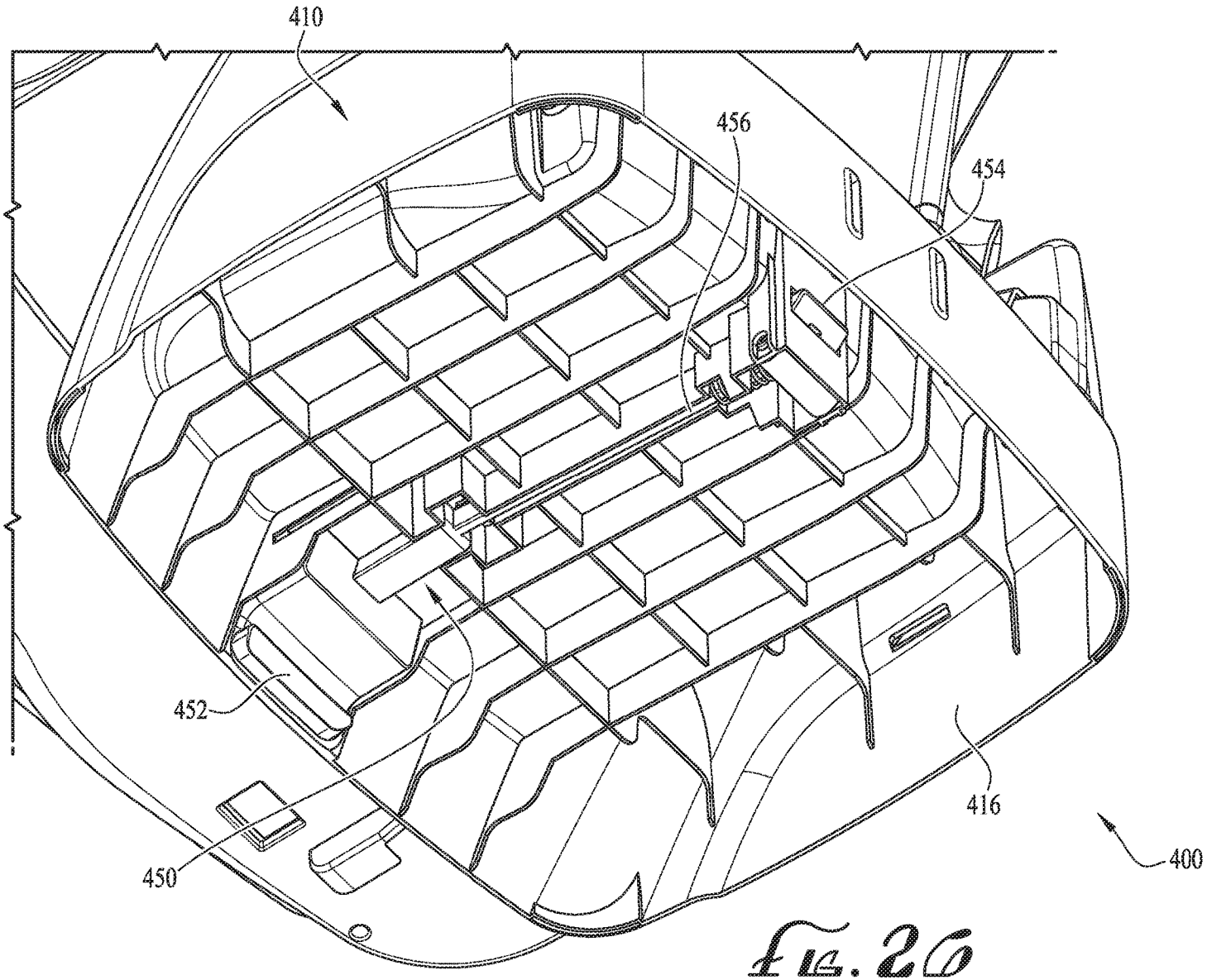
FIG. 26 shows a bottom view of the second child seat base of FIG. 26.
Figure 27:
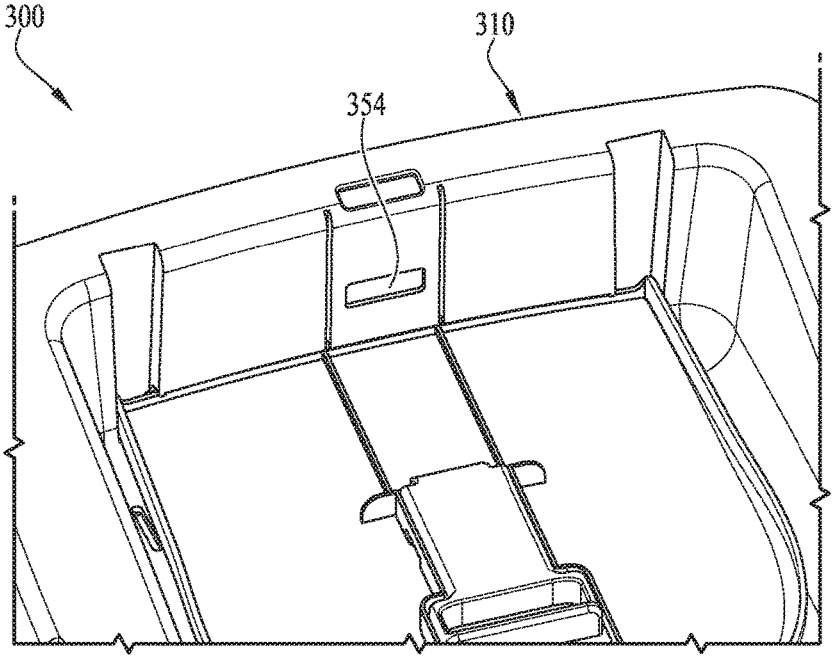
FIG. 27 shows a detailed view of the first child seat of FIG. 23.
Figure 28:
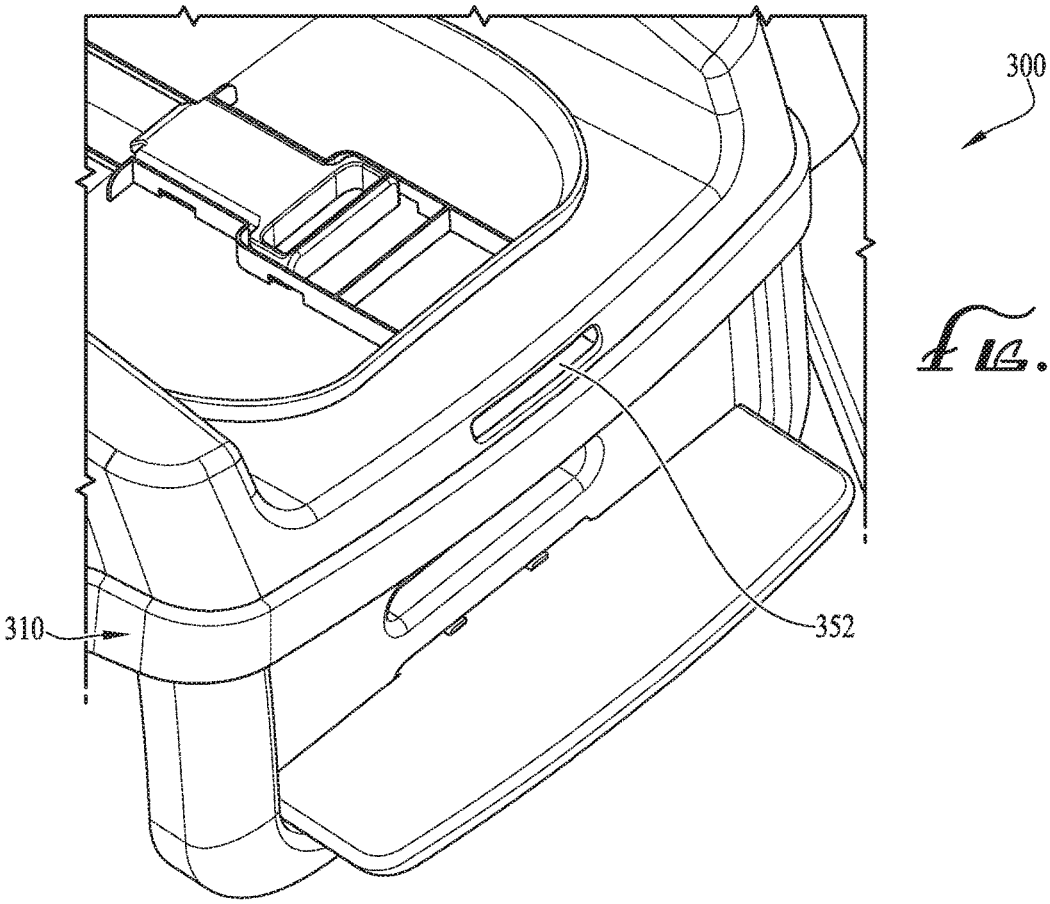
FIG. 28 shows a detailed view of the first child seat of FIG. 23.
Figure 29:
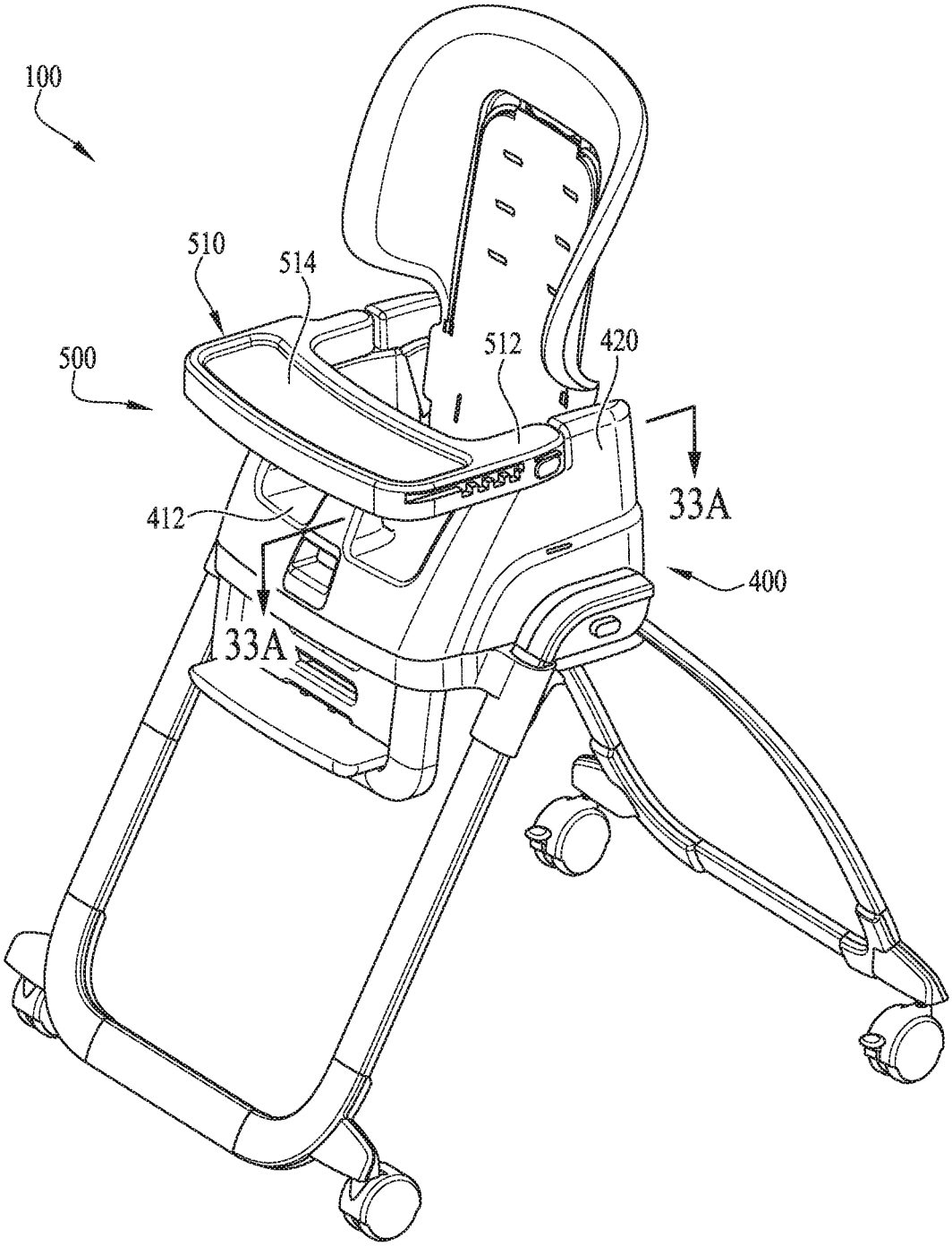
FIG. 29 is a perspective view of a convertible highchair in a first configuration according to an example embodiment.
Figure 31:
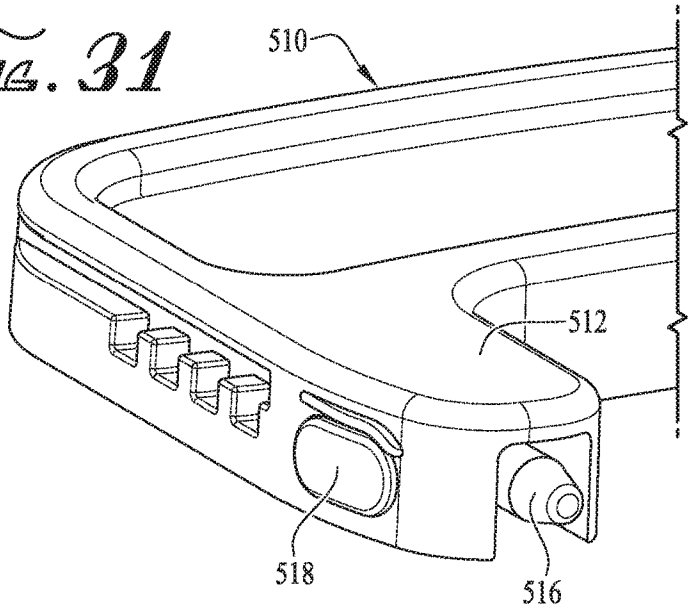
FIG. 31 shows a detailed view of a first arm of the tray of FIG. 30.
Figure 30:
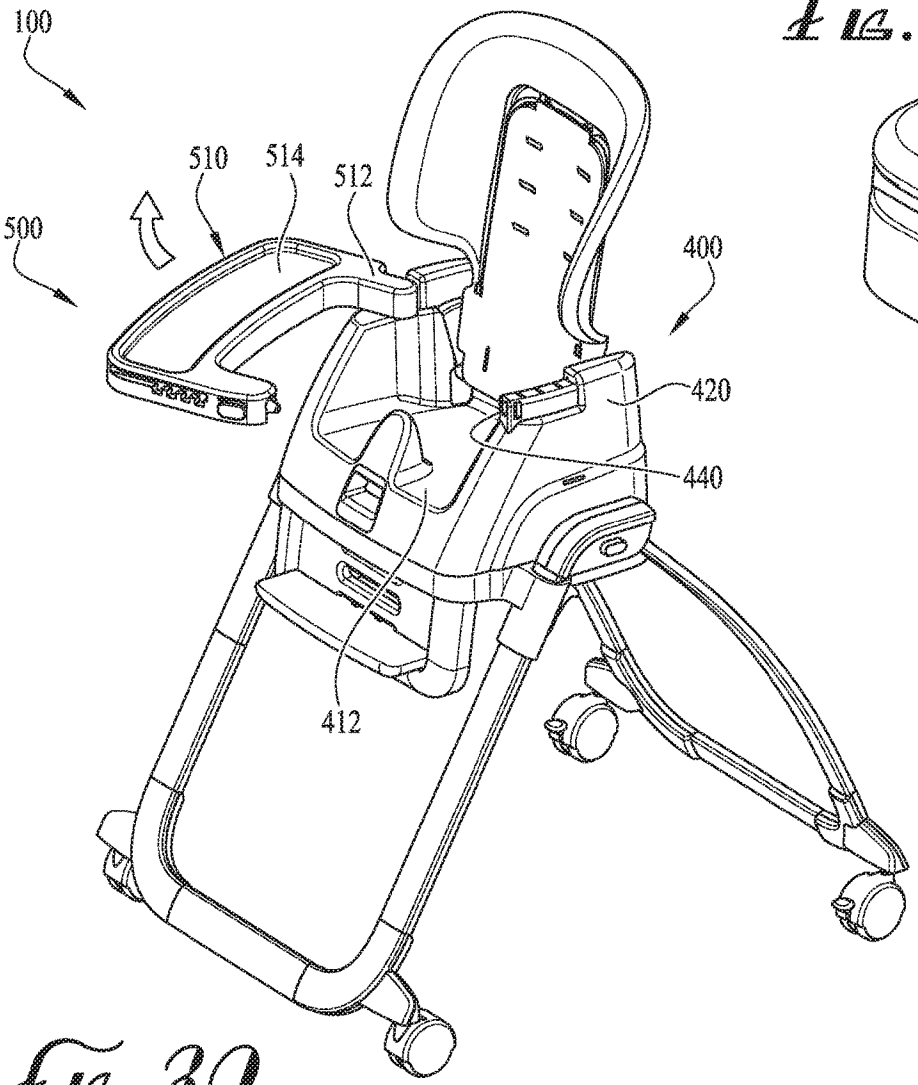
FIG. 30 shows the convertible highchair of FIG. 29 with the tray in an open pivoted position.

FIGS. 21-28 illustrate the mechanisms used to removably couple the second child seat 400 to the first child seat 300, and thereby to the frame 200. In the depicted embodiment, the back rest 320 of the first child seat 300 is moved to the folded position before the second child seat 400 is attached. As shown in FIGS. 22 and 23, the back rest 320 of the first child seat 300 includes a spring biased locking handle 322 configured to engage a slot 316 in the first child seat shoulder 314 which holds the back rest in the in-use position. To move the back rest 320 to the folded position, the user can pull the handle 322 to release it from the slot 316 and fold the back rest down such that it is substantially parallel to and abuts the seating surface 312. In alternate embodiments, the second child seat 400 can be coupled with first child seat 300 when the back rest 320 is in the in-use position or the back rest can be removed from the first child seat. In the depicted embodiment, the bottom of the base 410 of the second child seat 400 is dimensioned to fit over the first child seat 300. The base 410 of the second child seat 400 includes a downwardly extending lip or skirt 416 around its outer periphery, shown in FIG. 24, and the seat portion 310 of the first child seat 300 includes a ledge 318 around its outer periphery, shown in FIGS. 22 and 23. The lip 416 is configured to cover the seating surface 312 and shoulder 314 of the first child seat 300 and rest on ledge 318, as shown in FIG. 30. In example embodiments, the skirt 416 extends entirely around or substantially entirely around the outer periphery of the second child seat base 410. When coupled to the first child seat 300, the skirt 416 of the second child seat 400 extends around the entirety of the seat portion 310 of the first child seat 300, covering the front, back, and both sides of the first child seat. In the depicted embodiment, the first child seat 300 and second child seat 400 are dimensioned to have a flush outer surface when coupled together. Having the second child seat base 410 wider than the first child seat 300 creates stability, both when the second child seat 400 is in the first configuration or in use as a booster seat in the third configuration.

Figure 55:
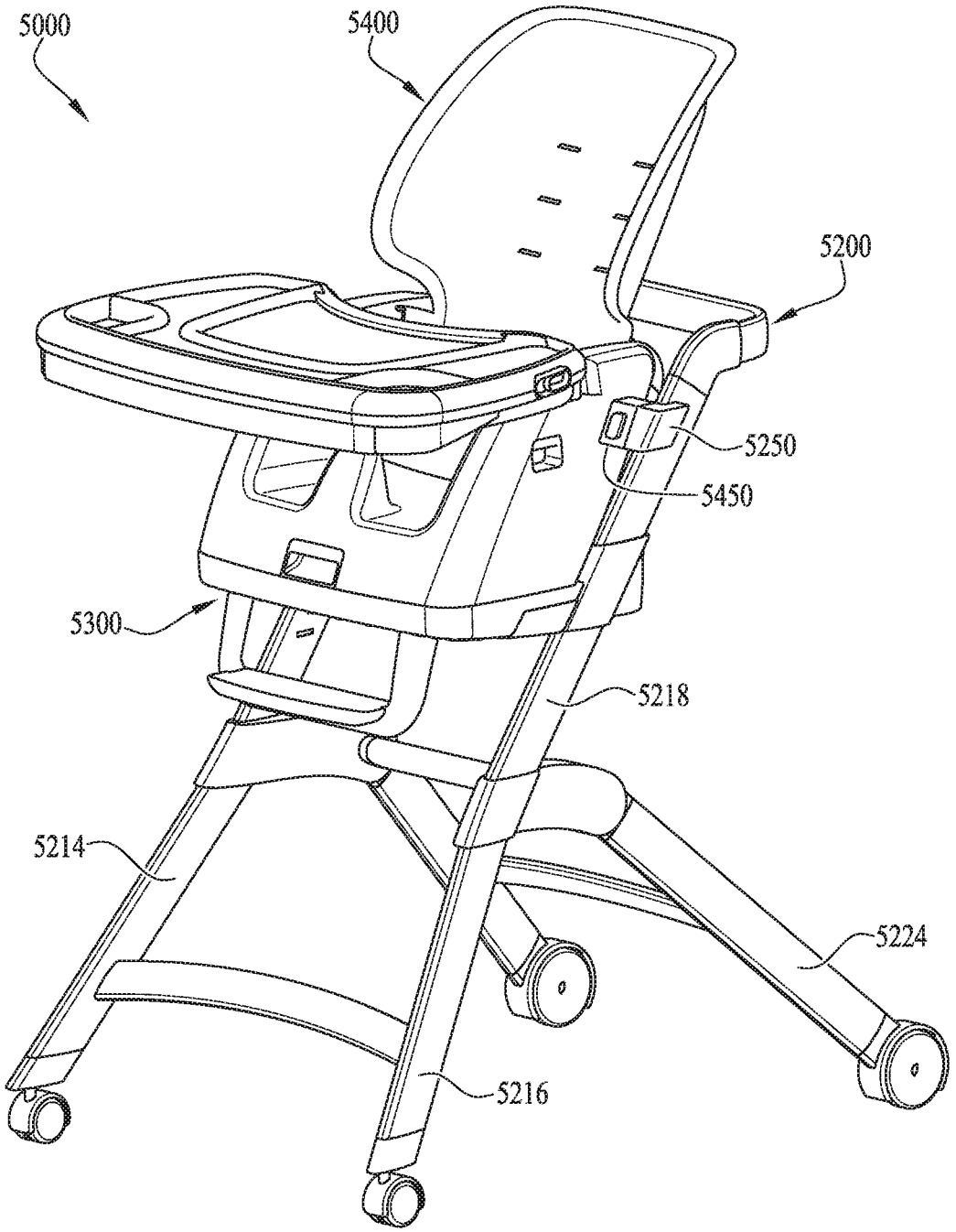
FIG. 55 is a perspective view of a convertible highchair according to another example embodiment.

In alternate embodiments of the highchair 5000, the second child seat 5400 attaches directly to the frame 5200, as opposed to attaching to the first child seat. As shown in FIG. 55, the frame can include attachment mechanisms 5250 configured to releasably engage with cooperating attachment mechanisms 5450 on the second child seat 5400. This highchair 5000 can also include the telescoping front upright frame member 5214 discussed above.

The second child seat 400 includes a locking latch and release mechanism 450, shown in FIGS. 24-28, configured to hold the second child seat 400 coupled to the first child seat 300. The locking mechanism 450 includes a first and second spring biased ridge 452, 454 coupled by a connecting rod 456 positioned on the bottom of the second child seat base 410 within the lip 416. The first ridge 452 in positioned adjacent the front of the base 410 and the second ridge 454 is positioned adjacent the back of the base. The first ridge 452 is connected to a release handle 458 that extends through the lip 416 at the front of the base. The first child seat 300 includes a first slot 352 positioned on the front of seat portion 310 and a second slot 354 positioned on the portion of shoulder 314 adjacent the back of the seating surface 312. The first and second ridge 452, 454 are configured to engage the first and second slot 352, 354 respectively when the second child seat 400 is coupled to the first child seat 300, thereby locking the second child seat to the first child seat. To release the second child seat 400 from the first child seat 300, the user pulls the release handle 348 which laterally moves and retracts the first and second ridge 452, 454 from the first and second slot 352, 354 and enables the second child seat 400 to be removed from the first child seat 300.

Figure 54:
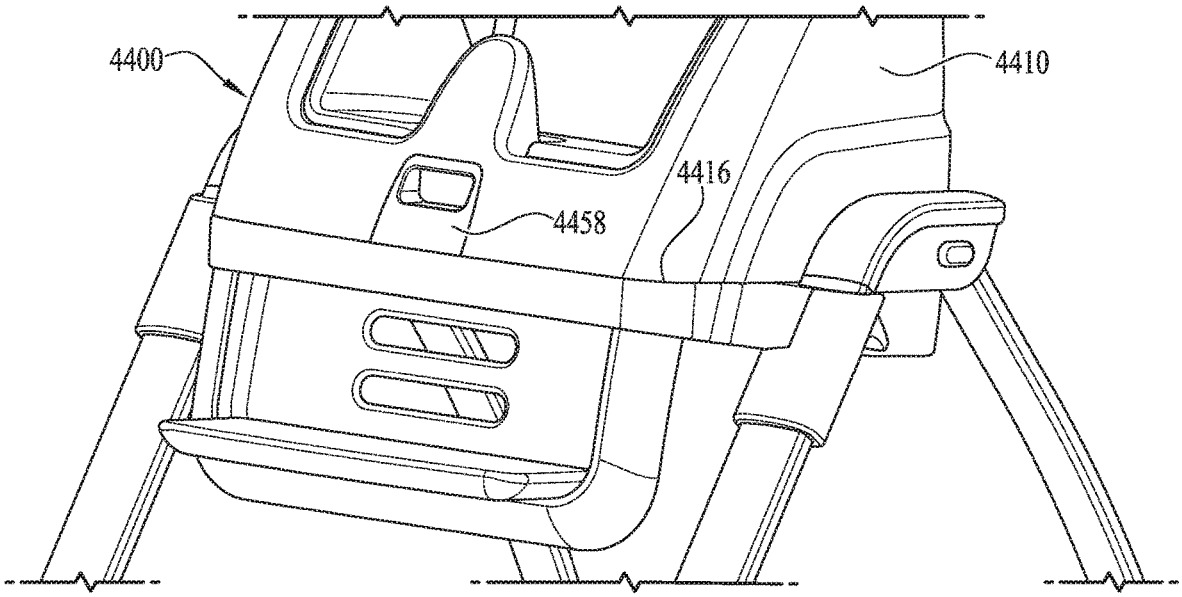
FIG. 54 is a detailed perspective view of a second child seat of a convertible highchair according to another example embodiment.

In other embodiments, the second child seat 4400 includes a locking latch and release mechanism as discussed above. But in this embodiment, the seat release handle 4458 extends to the bottom edge of the skirt 4416 of the second child seat 4400, as shown in FIG. 54. This configuration strengthens the base 4410 of the second child seat 4400 and makes the base easier to manufacture.

Figure 32:
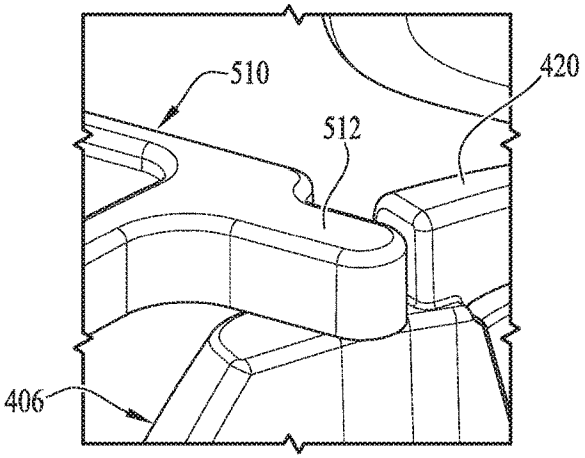
FIG. 32 shows a detailed view of the second arm of the tray of FIG. 30
Figure 33A:
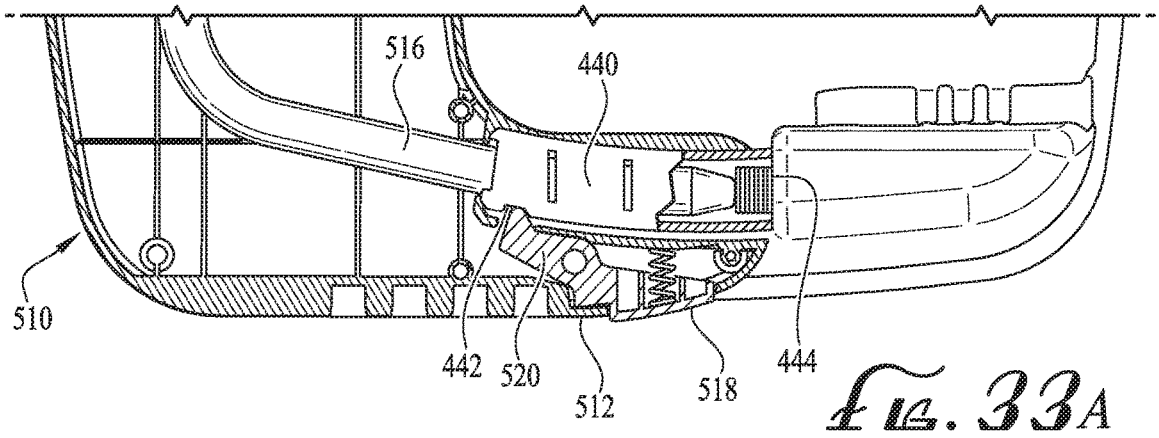
FIGS. 33A-C show a cut-away view of the first arm of tray of FIG. 29, and a sequence of operation of its release mechanism.
Figure 33B:
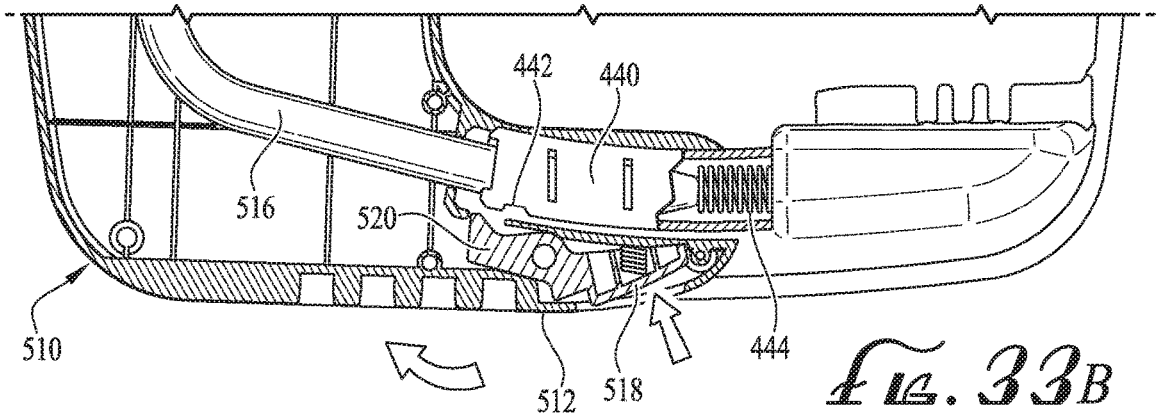
Figure 33C:
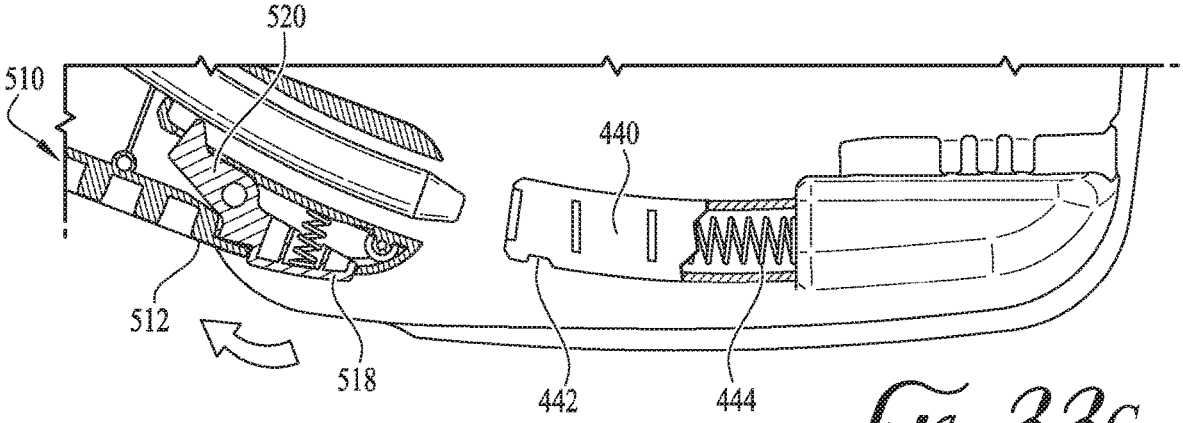
Figure 34:
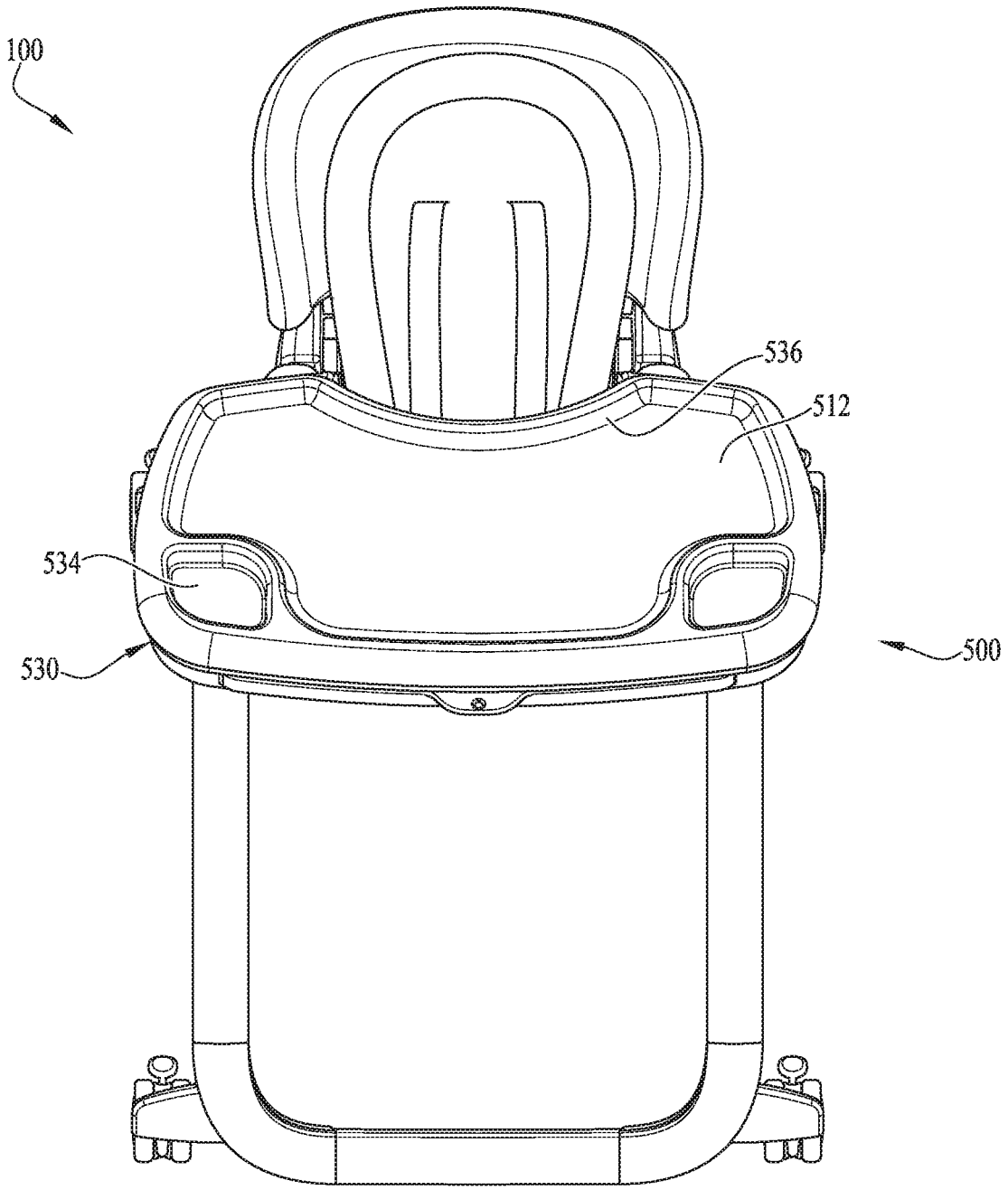
FIG. 34 is a top view of a convertible highchair in a first configuration with a detachable tray according to an example embodiment.
Figure 35:
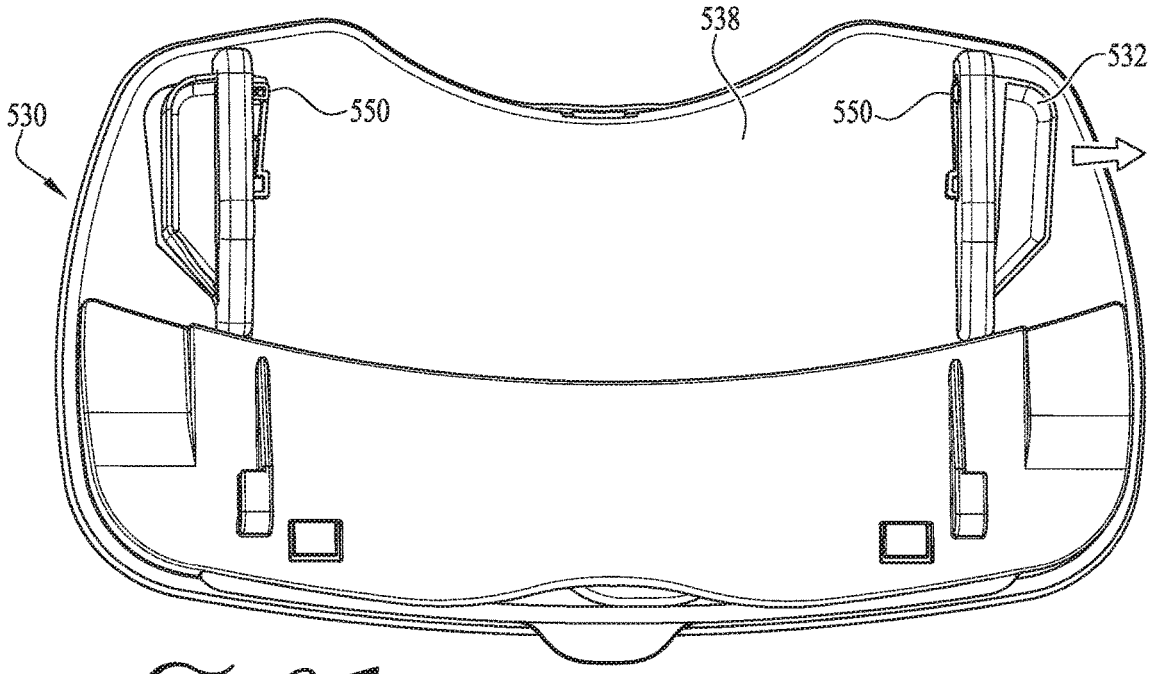
FIG. 35 shows a bottom view of the detachable tray of FIG. 34.

A multi-tray tray assembly 500 is shown according to example embodiments in FIGS. 29-47, and generally includes a base tray 510 and a larger detachable tray 530. Optionally, the tray assembly 500 includes an auxiliary tray 540, a tray liner 560 and a plate 570. The base tray 510, shown in FIGS. 29-33 generally includes two arms 512 and a substantially rectangular work surface 514. The base tray 510 can include a lip around the outer periphery of the upper surface, but generally provides a substantially flat planar surface for holding food, toys or other items in a location accessible by the child seated in the highchair 100. The arms 512 of the base tray 510 are coupled to the shoulder 420 of the second child seat 400. The base tray 510 is positioned such that the seating surface 412 of the second child seat 400 is between the arms 512 of the base tray 510. One arm 512 is pivotally coupled to the shoulder 420, as shown in FIG. 32, and the other arm is releasably coupled to the shoulder so that the base tray 510 can be pivoted away from the second child seat 400, as shown in FIG. 30. This feature helps the caregiver access the second child seat 400 when seating or removing the child. The arm 512 with the releasable coupling includes a plunger 516. The plunger 516 is configured to fit within a channel 440 in the shoulder 420. The plunger 516 includes a locking mechanism comprising a spring biased button 518 coupled to an arm 520. The arm 520 is configured to engage a notch 442 on the outside of the channel 440 to lock the plunger 516 in engagement with the channel, as shown in FIG. 33A. The user can depress the button 518 to move the arm 520 out of engagement with the notch 442 in order to release the plunger 516 from the channel, as shown in FIGS. 33B and 33C. In example embodiments, the channel includes a spring 444 biasing the plunger 516 away from the channel 428 such that when the locking mechanism is unlocked, the plunger is spring-ejected from the channel. In the depicted embodiment, the button 518 is positioned on the side of the arm 512 such that it is not easily visible to or accessible by a child seated in the second child seat 400. In alternate embodiments, various other forms of release mechanism can be provided.

Figure 36:
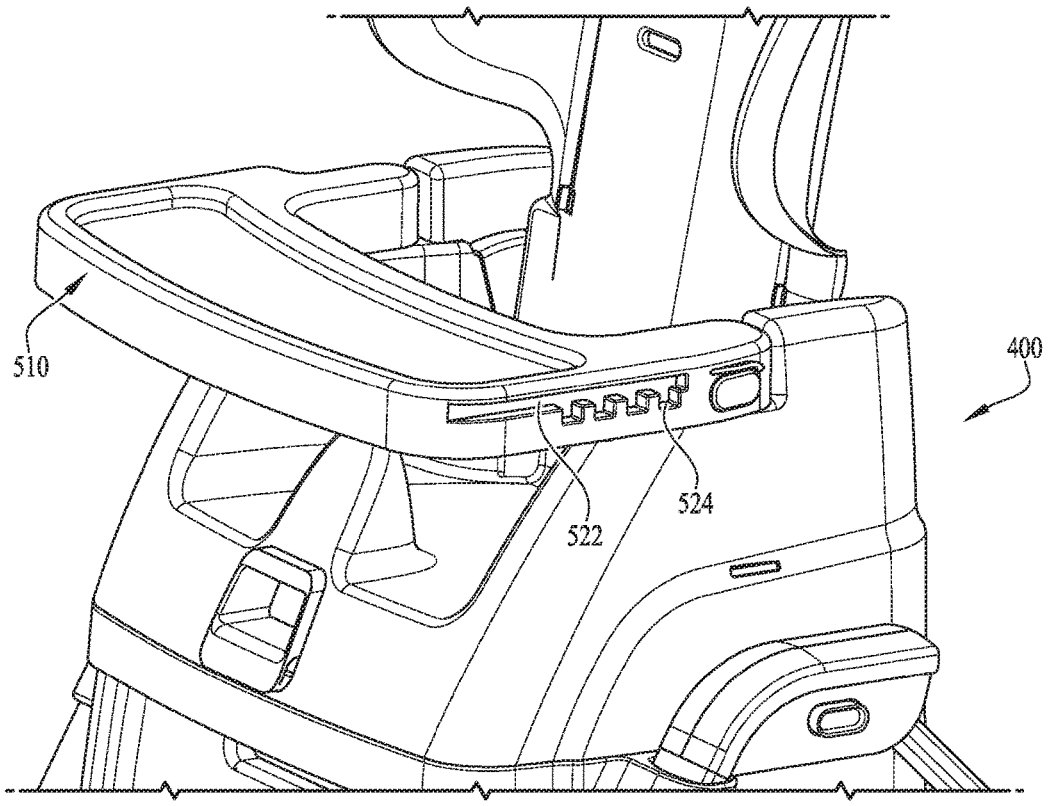
FIG. 36 shows a detailed side view of the base tray of FIG. 34.
Figure 38:
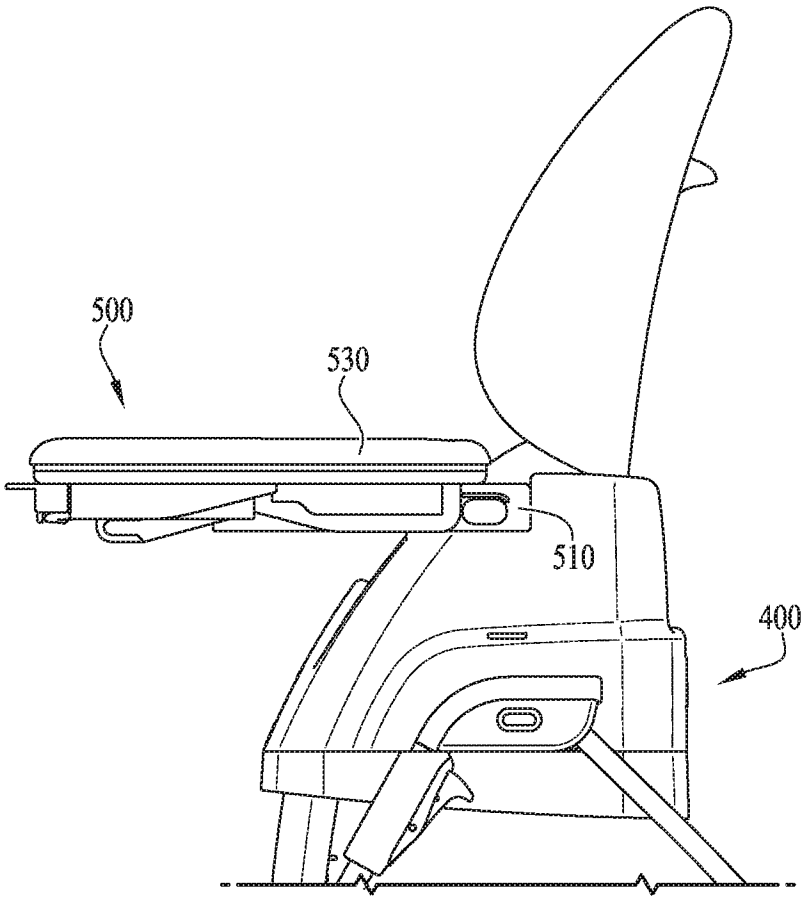
FIG. 38 shows a side view of the convertible highchair of FIG. 34 with the detachable tray in a second position.
Figure 37:
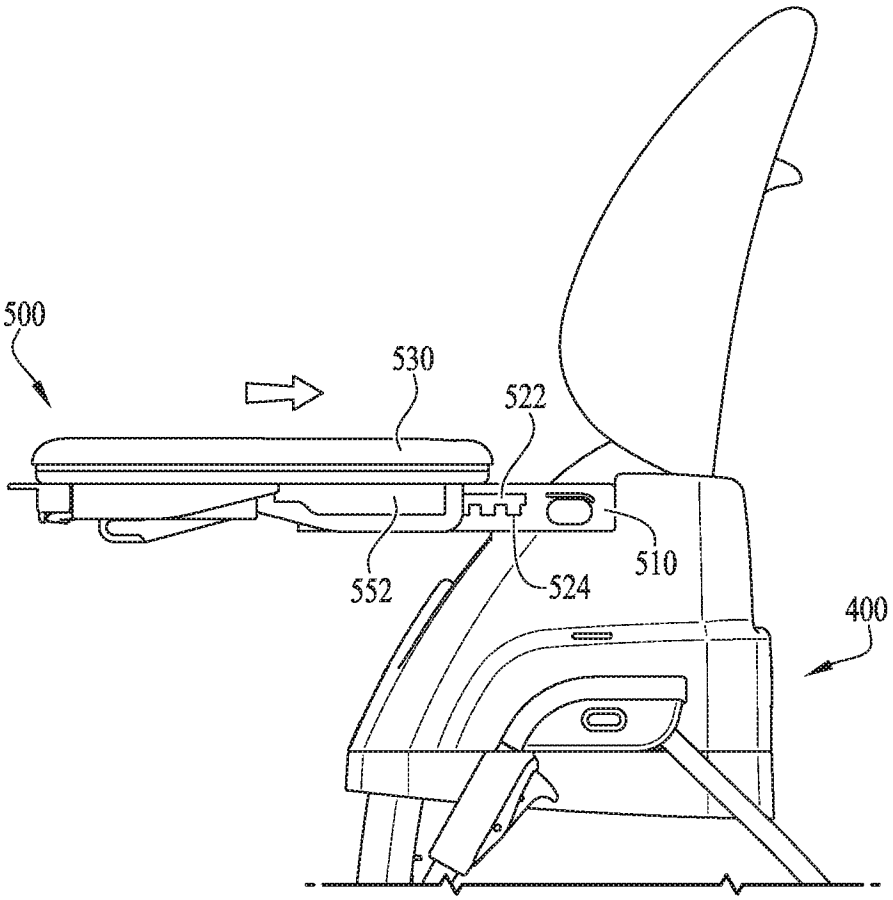
FIG. 37 shows a side view of the convertible highchair of FIG. 34 with the detachable tray in a first position.
Figure 40:
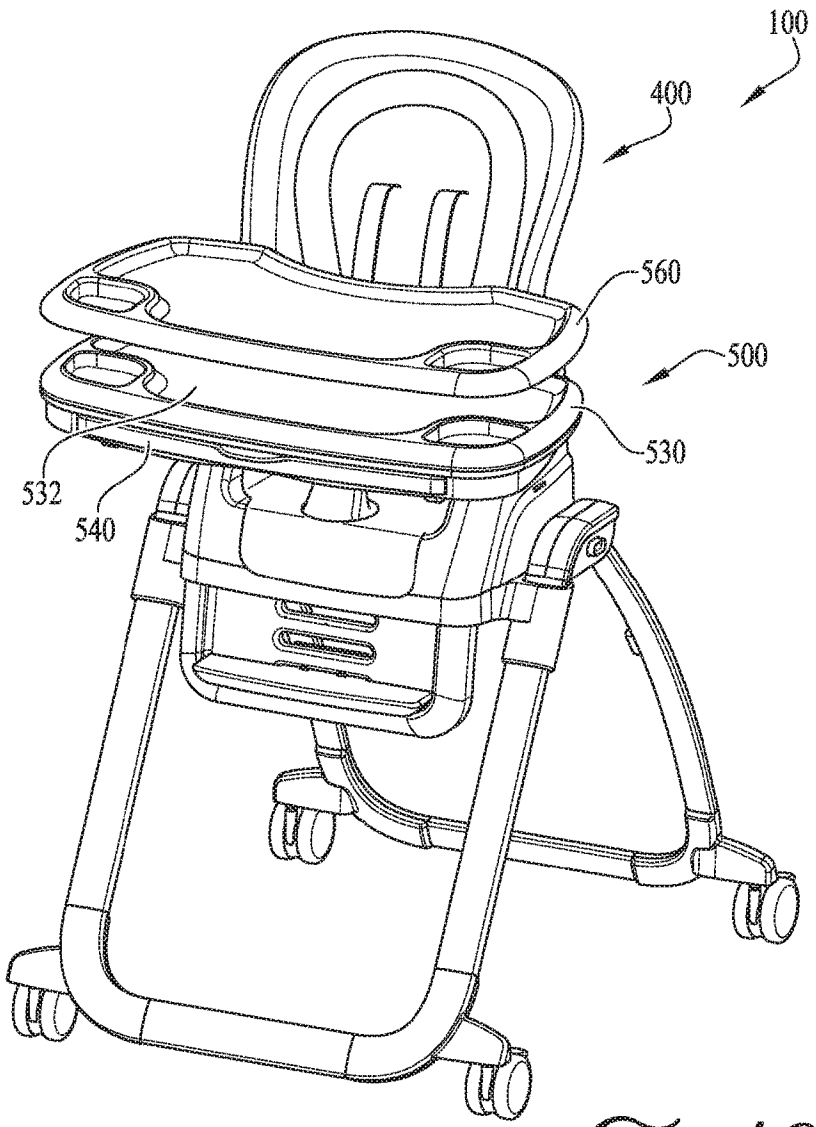
FIG. 40 shows the convertible highchair of FIG. 34 with a tray liner separated from the tray according to an example embodiment.

The detachable tray 530, shown in FIGS. 34-38, can be detachably coupled to the base tray 510. The detachable tray 530 has a generally rectangular shape with a substantially flat upper tray surface 512. The upper tray surface can include one or more partitioned sections 534 that can be used to hold food and other items, such as children's toys. The sections 534 can also be used as cup holders. In example embodiments, the cup holder 534 has a generally teardrop shape which can help prevent a square object, such as a juice box, from becoming wedged in the cup holder. The detachable tray 530 can include a lip around its periphery. In the depicted embodiment, the detachable tray 530 includes a scooped lip 536 along the portion of the tray proximal to a child seated in the second child seat. The scooped lip 536 is formed from a curved edge that forms an inward facing wave-shape designed to assist an infant in gathering and scooping objects, such as small food. The bottom surface 538 of the detachable tray 530, depicted in FIG. 35, includes two spring biased attachment ribs 550 pivotally mounted to the bottom surface for coupling the detachable tray to the base tray 510. Each attachment rib 550 includes a handle 552 for pivoting the rib out of the spring biased locked position. In the depicted embodiment, the ribs 550 are positioned such that the detachable tray 530 will be generally centered on the base tray 510. In alternate embodiments, the ribs 550 are configured such that the detachable tray 530 will be offset relative to the base tray 510. The side of each arm 512 of the base tray 510 includes a channel 522 with a plurality of notches or stop surfaces 524 configured to correspond with positions of the detachable tray 530 relative to second child seat, as shown in FIG. 36. The detachable tray 530 is coupled to the base tray 510 by fitting the attachment ribs 550 into the corresponding channels 520. The ribs 550 are configured to engage a notch 524 to lock the detachable tray 530 to the base tray 510. The user can actuate the handles 552 to move the ribs 550 out of engagement in order to remove the detachable tray 530 from the base tray 510 or adjust the position of the detachable tray relative to the second child seat 400, as shown in FIGS. 37 and 38. In alternate embodiments, another coupling mechanism can be used.

Figure 39:
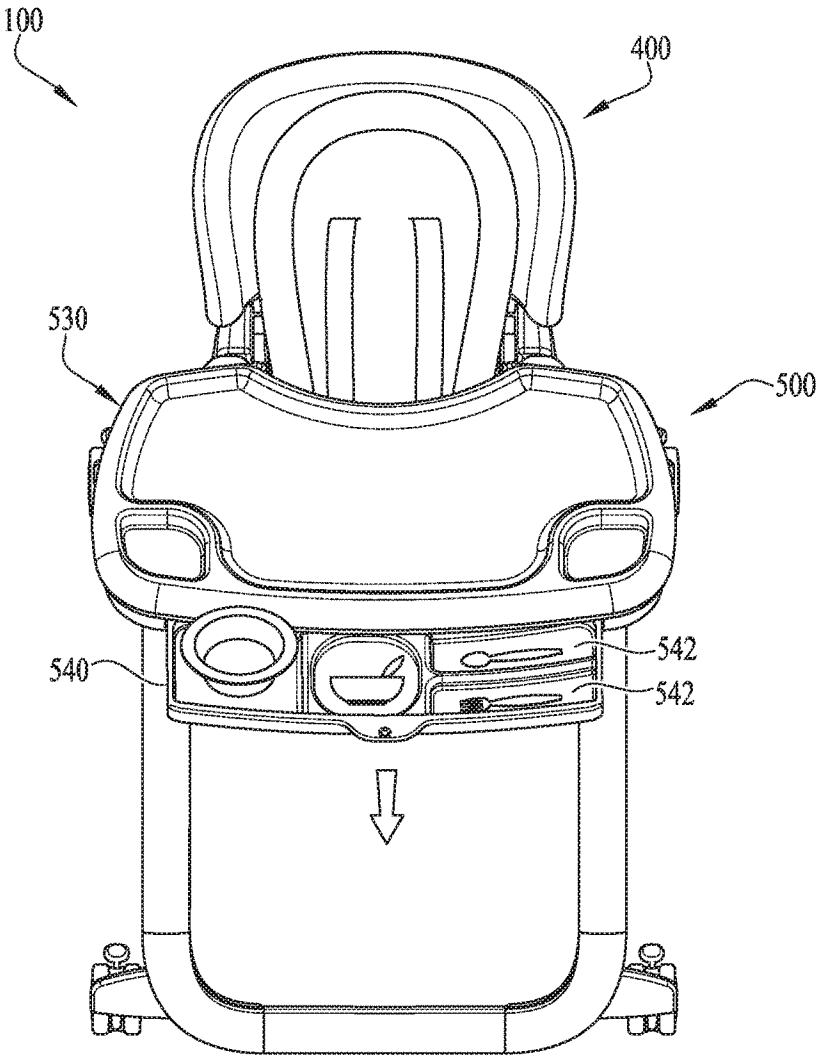
FIG. 39 shows the convertible highchair of FIG. 34 with an auxiliary tray extended according to an example embodiment.

The detachable tray 530 can optionally also include an auxiliary tray 540 positioned within the detachable tray in a drawer-like configuration that permits a user to slide the auxiliary tray into and out of view, as shown in FIG. 39. The auxiliary tray 540 is located at a distal or front end of the tray assembly 500 or is otherwise situated such that a child seated in the second child seat 400 cannot access items on the auxiliary tray. The auxiliary tray 540 is designed to provide space for a parent or other adult caregiver to store and stage items out of reach and/or view of the child or infant. The auxiliary tray 540 can include partitioned sections 542 for holding utensils, food, toys or other items. In example embodiments, the auxiliary tray 540 is detachable from the detachable tray 530 so that the caregiver can clean the tray or prepare food and drink at a different location before recoupling to the detachable tray. In other embodiments, the auxiliary tray 540 includes a liner that can be detached for cleaning. The auxiliary tray 540 can include a lip on the bottom surface to facilitate sliding the auxiliary tray away from the detachable tray 530.

Figure 41:
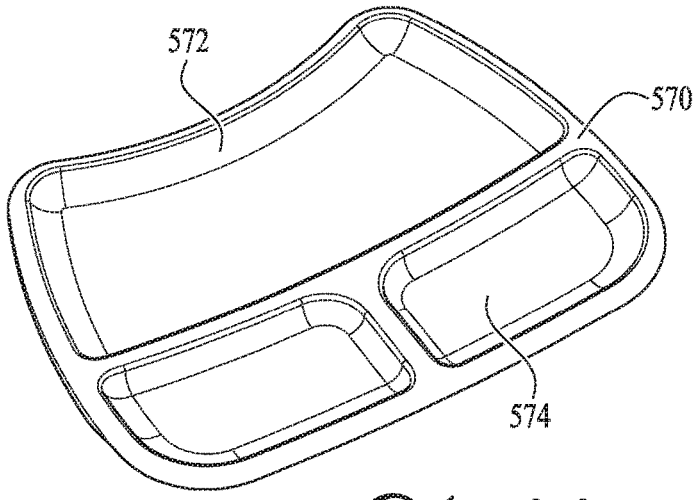
FIG. 41 is a perspective view of a tray plate accessory according to an example embodiment.
Figure 42:
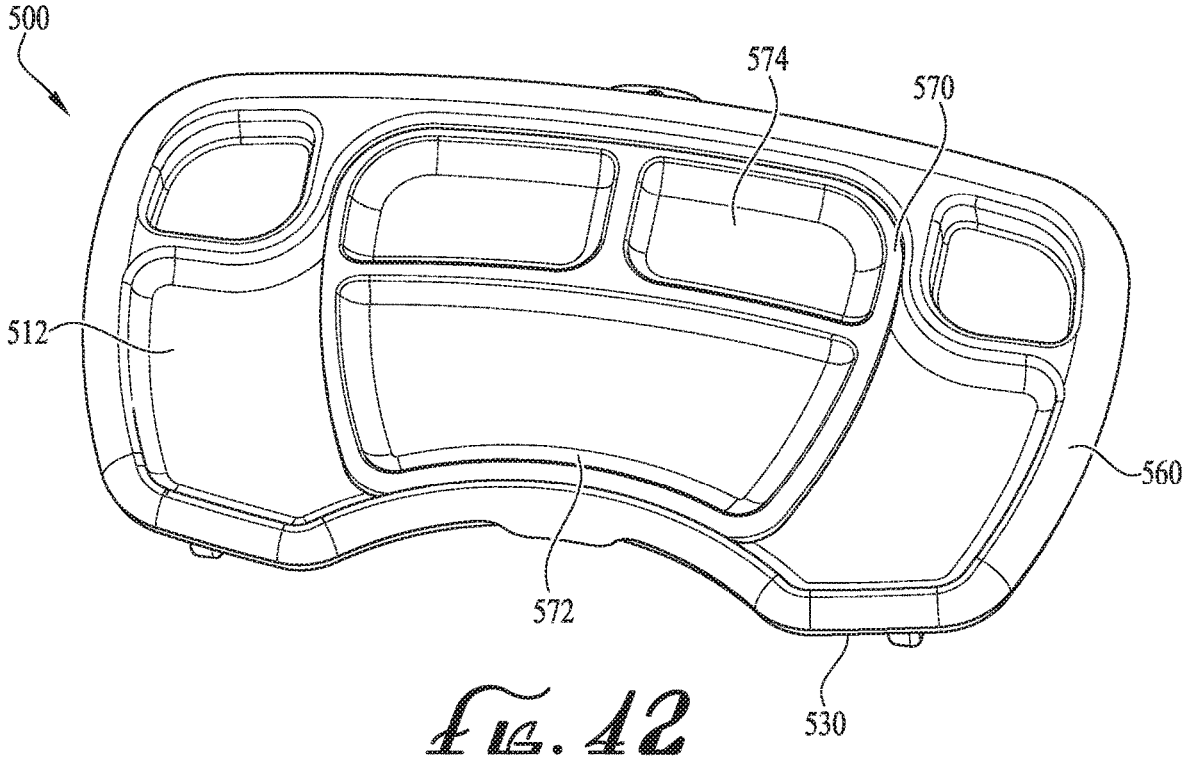
FIG. 42 is a top view of a tray assembly including the tray plate accessory according to an example embodiment.

The tray assembly 500 can optionally also include a liner 560 dimensioned to nest over the upper surface 532 of the detachable tray 530. The liner 560 can be removed from the detachable tray for cleaning and is preferably formed from a dishwasher safe material. In example embodiments, the liner 560 is formed from a translucent material. In alternate embodiments, the liner 560 can include designs or depictions of characters or objects. The tray assembly 500 can optionally also include a plate 570 configured to nest in the detachable tray 530 or detachable tray liner 560, as shown in FIGS. 41 and 42. The plate 570 can also include a scooped lip 572 designed to assist an infant in gathering and scooping object. The plate 570 can include partitioned sections 574 for holding food and other items. The plate 570 can rest on the upper or tray surface 512 or can be configured to clip or lock onto the upper tray surface.

Figure 43:
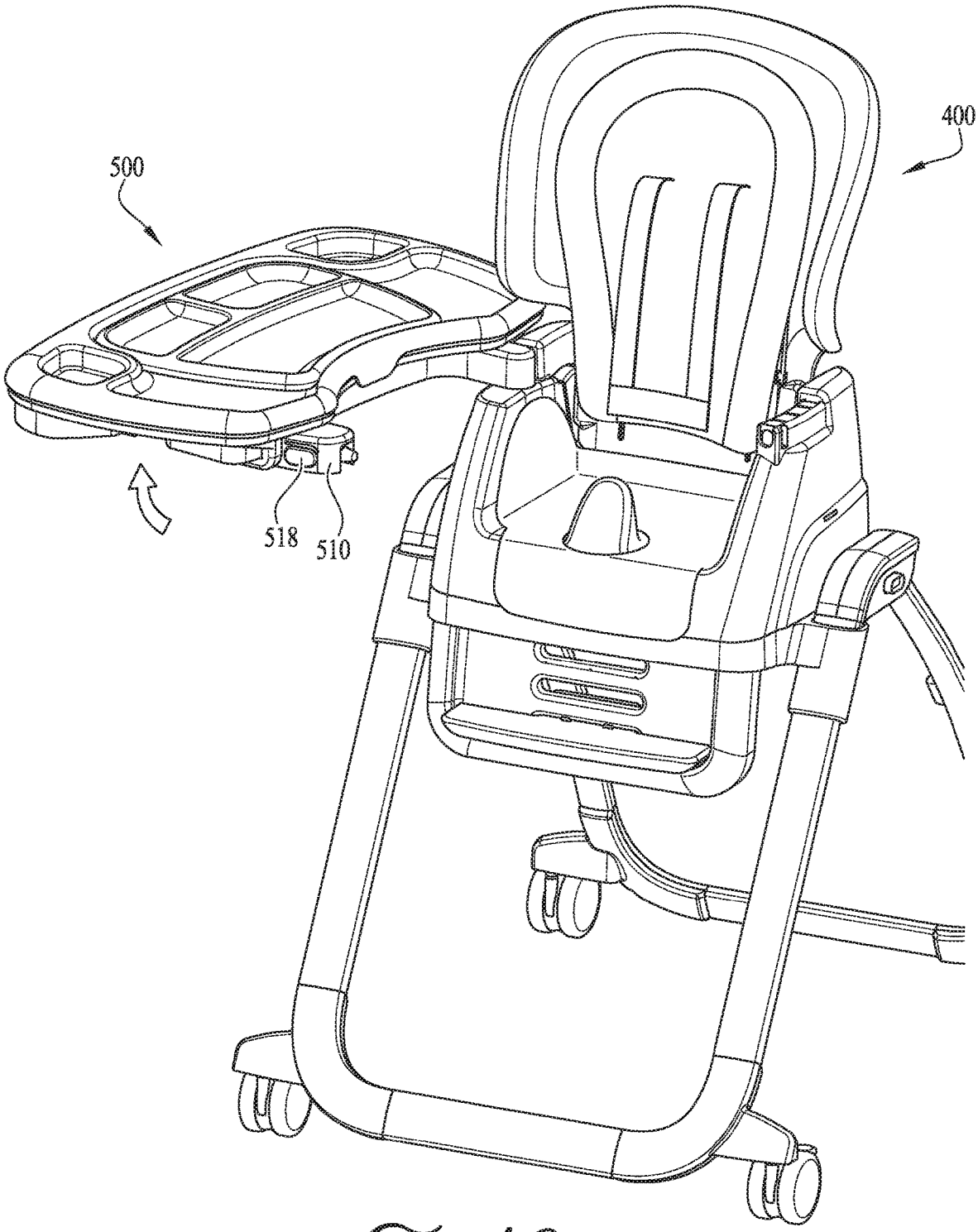
FIG. 43 is a perspective view of a convertible highchair in a first configuration with a tray assembly in a pivoted position according to example embodiments.
Figure 45:
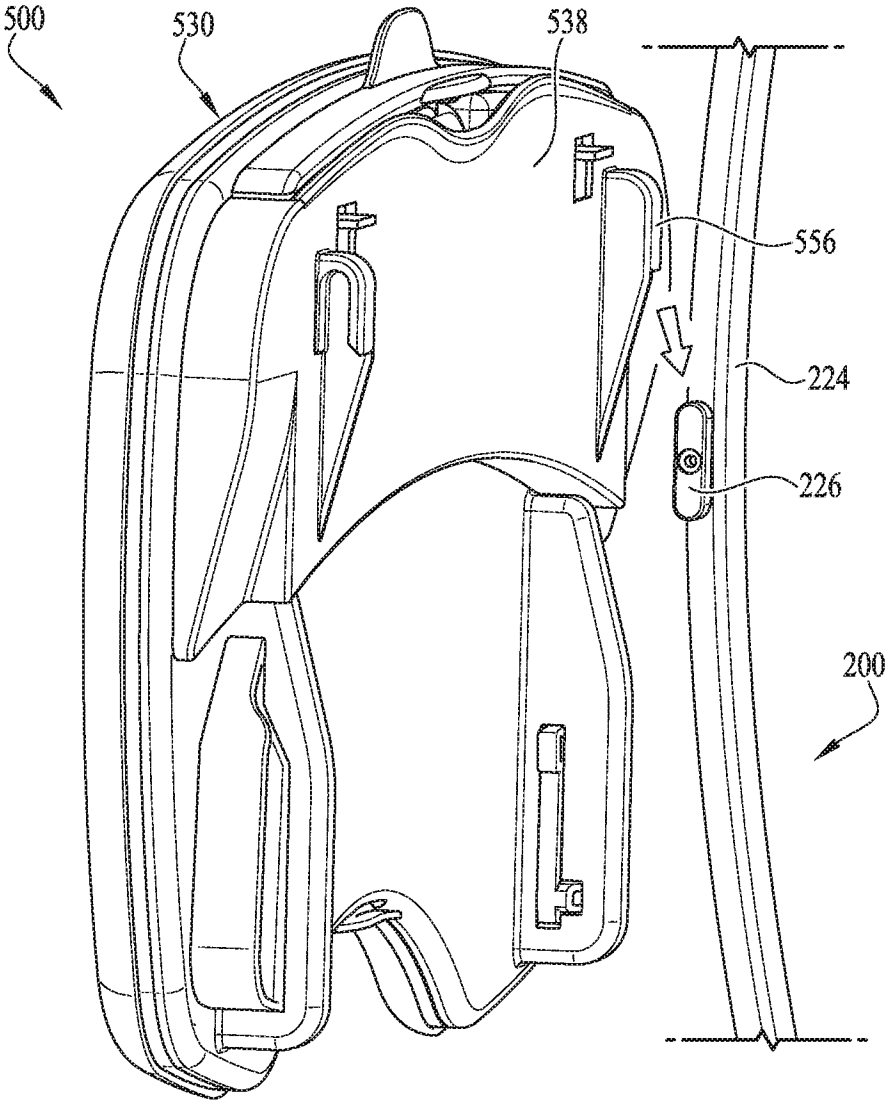
FIG. 45 shows a detailed view of the bottom of the tray assembly and back vertical frame member of FIG. 43.
Figure 44:
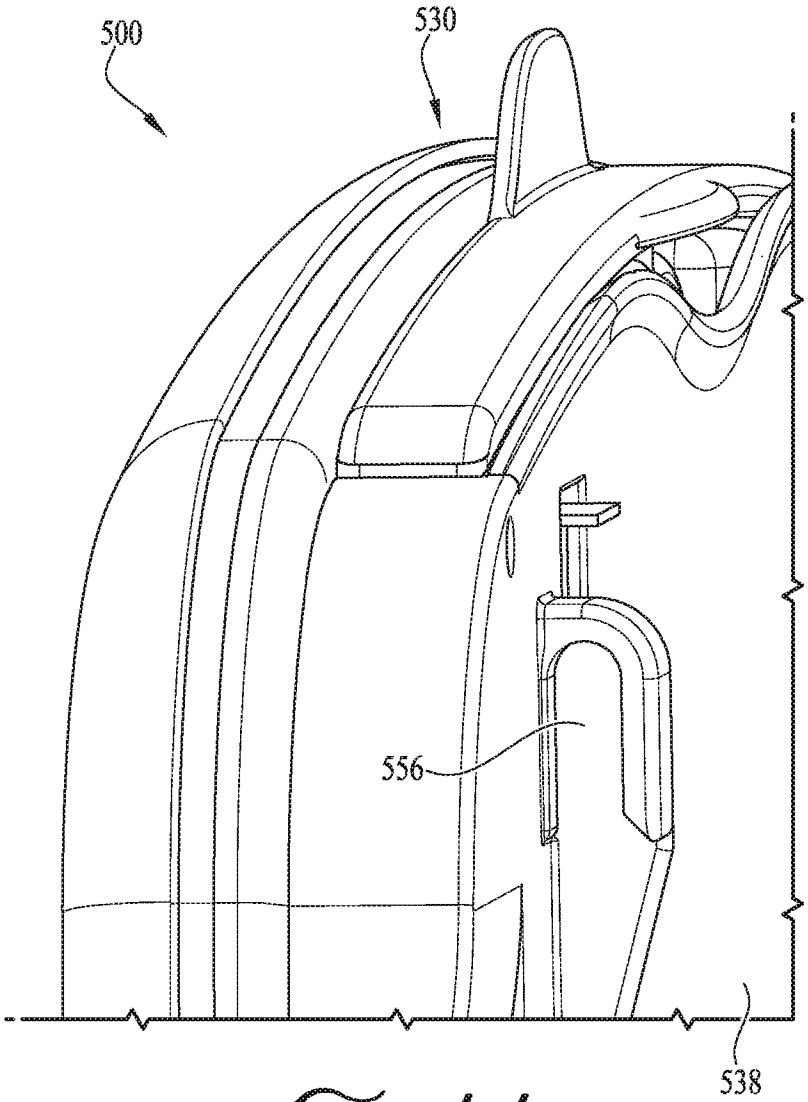
FIG. 44 shows a detailed view of the bottom of the tray assembly of FIG. 43.
Figure 47:
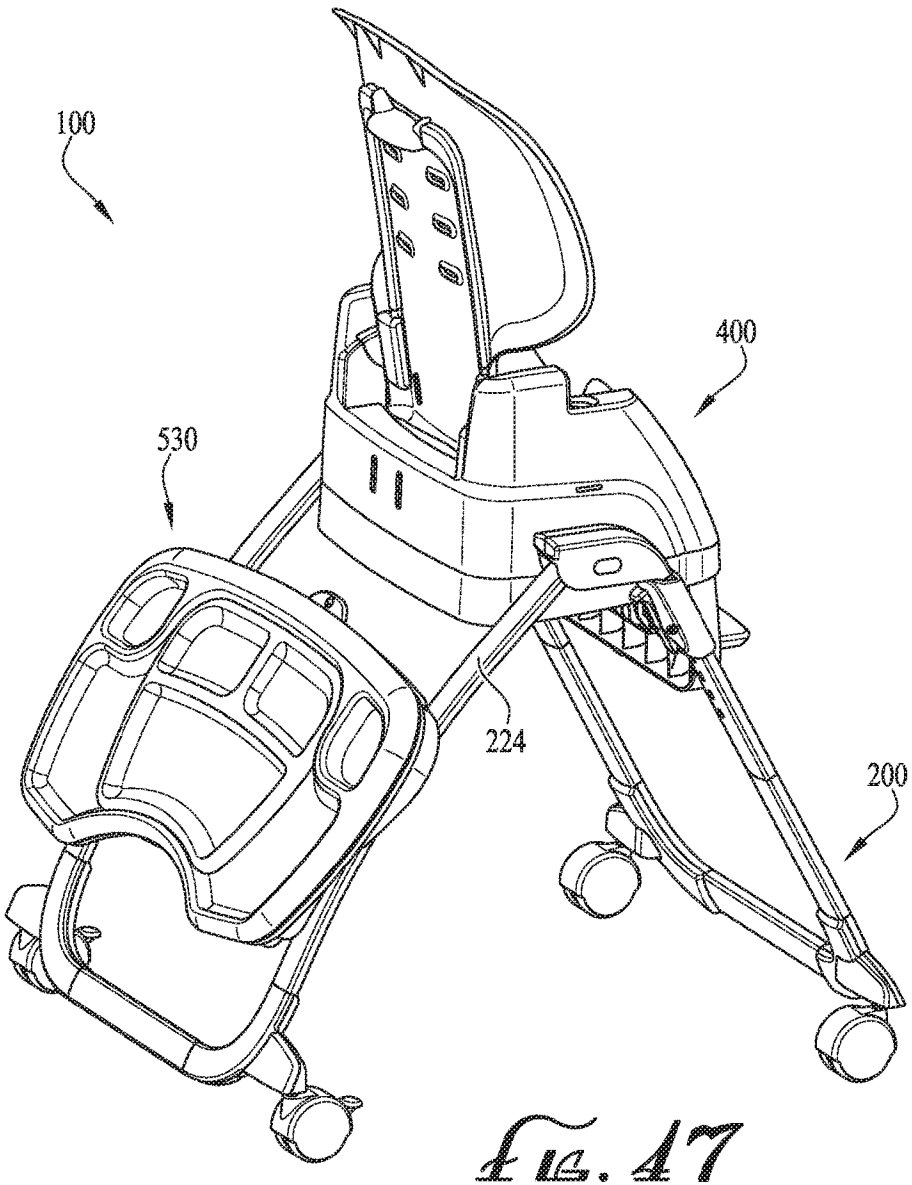
FIG. 47 is a perspective view of a convertible highchair in a first configuration with the detachable tray in a hanging storage position.
Figure 46:
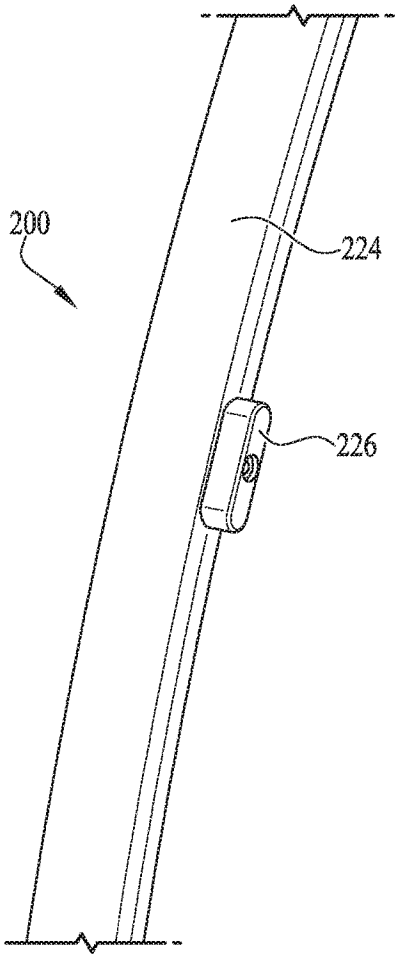
FIG. 46 shows a detailed view a back vertical frame member of FIG. 43.
Figure 19:
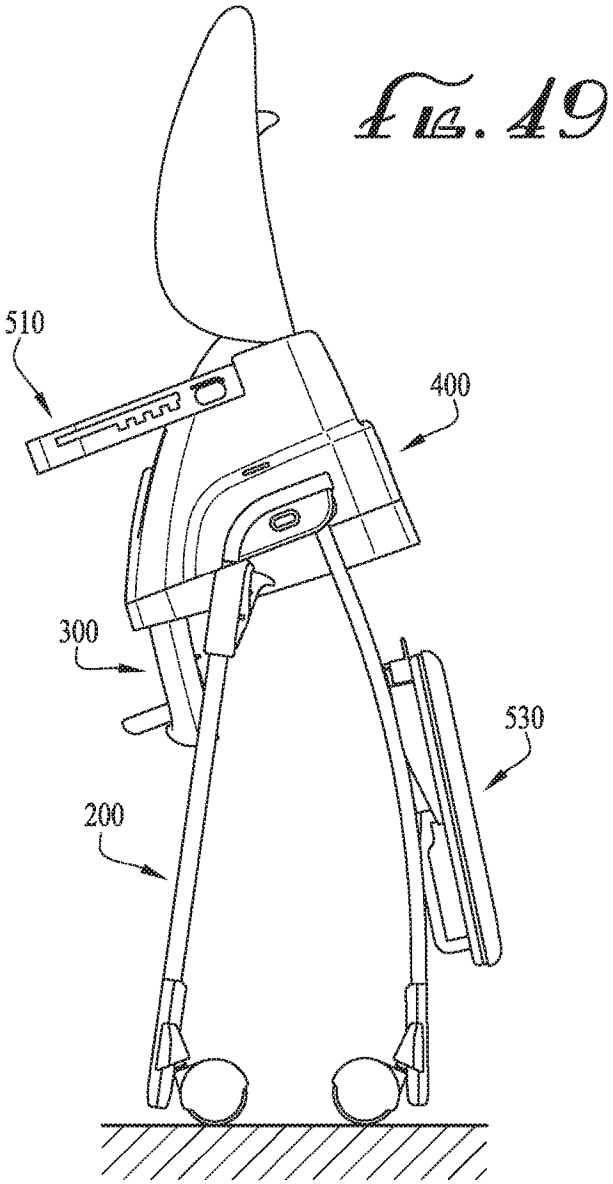
Figure 18:
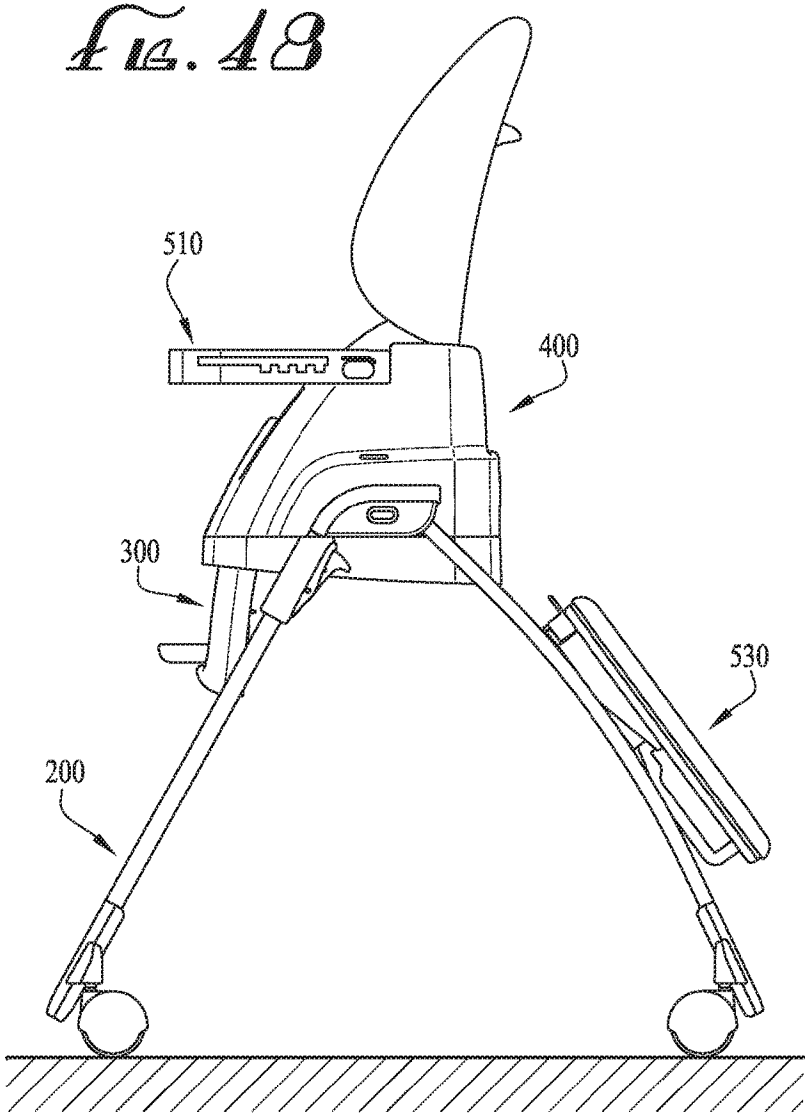

As shown in FIG. 43, the entire tray assembly 500 can be pivoted away from the second child seat 400 using the pivot function of the base tray 510 described above. In the depicted embodiment, the release button 518 on the base tray 510 is still accessible when the detachable tray 530 is coupled to the base tray. The detachable tray 530 can also be stored on the highchair frame 200 when decoupled from the base tray 510. FIGS. 44 and 45 depict hooks or notches 556 protruding from the bottom surface 538 of the detachable tray 530. FIGS. 45 and 46 depict a tab 226 positioned on the back vertical frame member 224. In the example embodiment, each back vertical frame member 224 includes a tab 226 along its inward face. The notches 556 are fitted over the tabs 226 to hang the detachable tray 530 from the back vertical frame members 224, as shown in FIG. 47. In example embodiments, as shown in FIGS. 48 and 49, the convertible highchair 100 is configured to stand upright and roll for portability with the frame 200 in the compact folded position with the second child seat 400 coupled to the first child seat 300 and the detachable tray 530 hung from the back vertical frame member 224.

Figure 56:
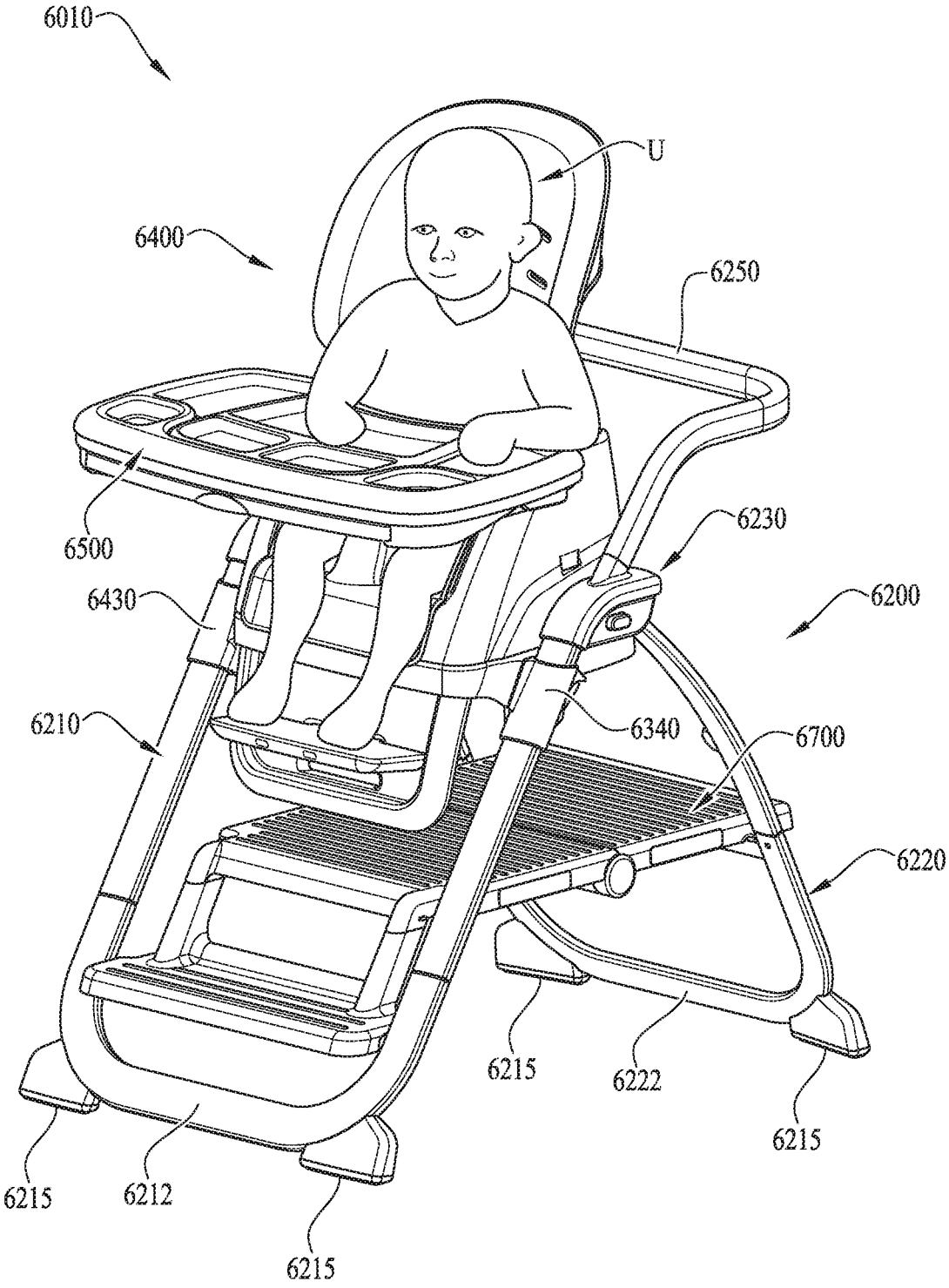
FIG. 56 is a perspective view of a convertible children's highchair and stepstool system according to another example embodiment, in use with a child in an infant highchair configuration.
Figure 57:
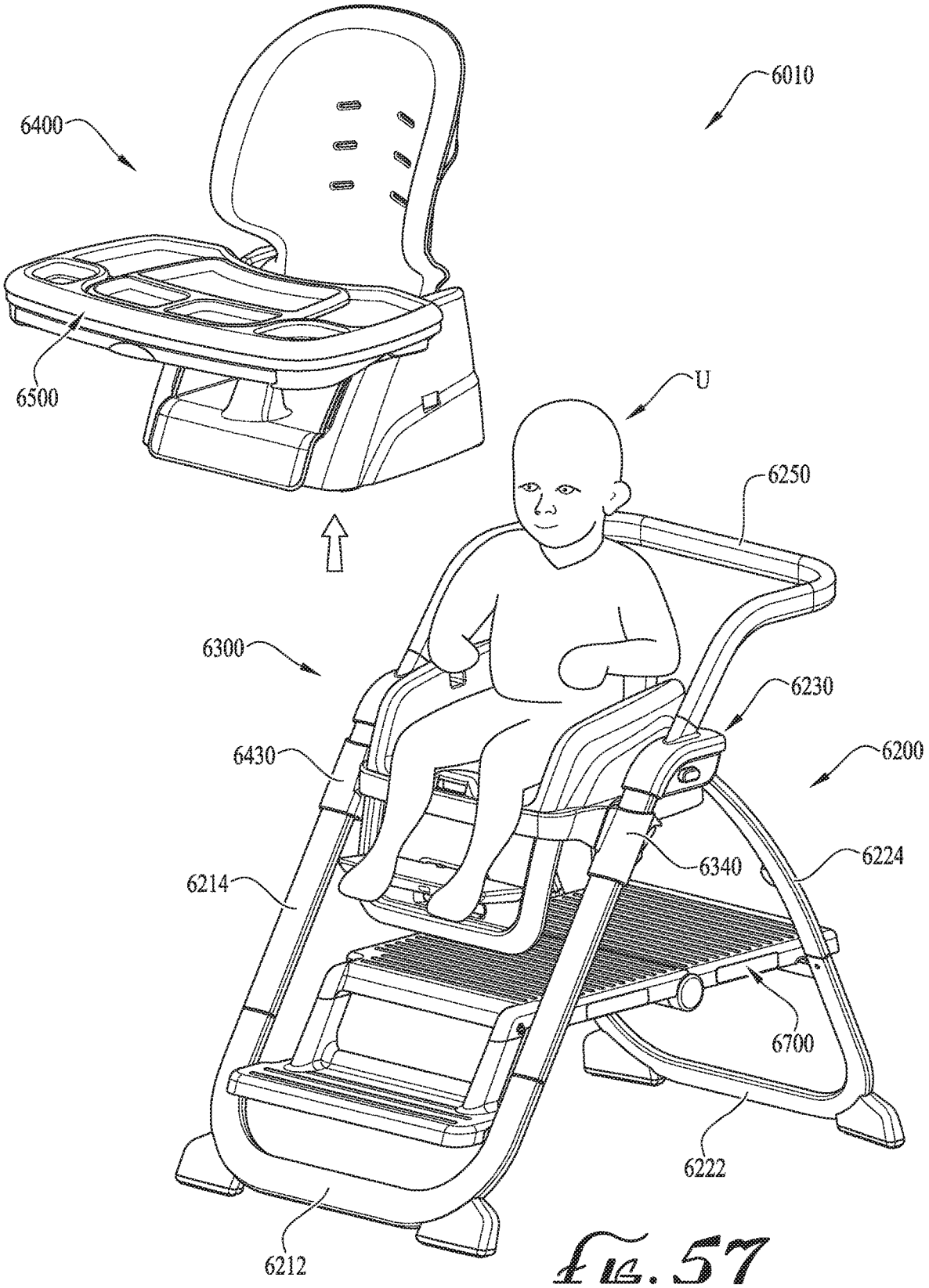
FIG. 57 shows the system of FIG. 56 with an infant seat or booster removed, and in use in a toddler highchair configuration.
Figure 58:
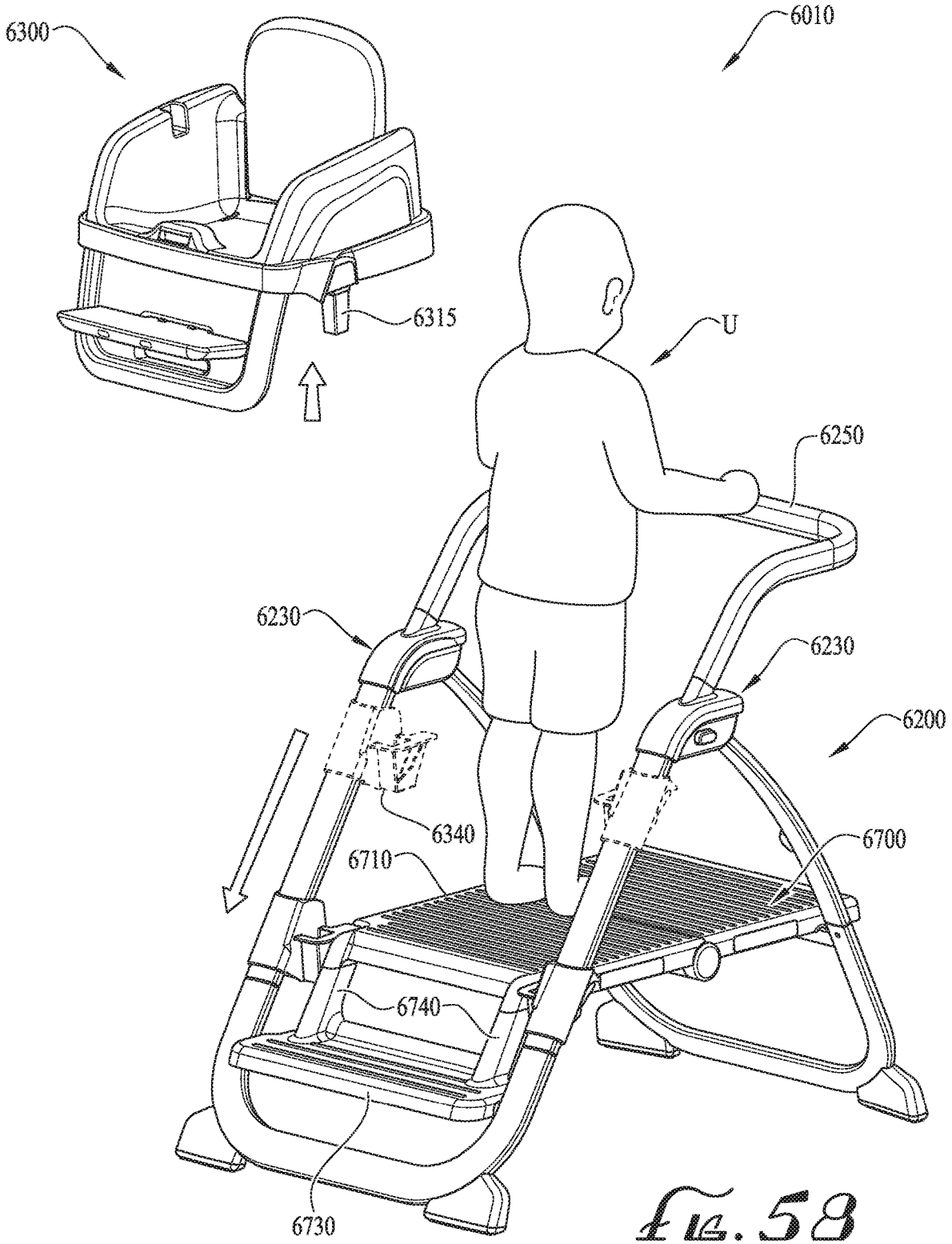
FIG. 58 shows the system of FIG. 56 with a toddler seat removed, and in use in a stepstool configuration.

FIGS. 56-61 show another example embodiment of a children's accessory system or apparatus 6010, which is convertible between one or more highchair and/or booster configuration(s) (FIGS. 56 and 57) and a stepstool configuration (FIG. 58). Aspects and elements of the highchair and booster elements of the system 6010 may be identical or substantially similar to corresponding aspects and elements of the above-described embodiments, with differences as will be described.

In example embodiments, the convertible highchair—stepstool 6010 generally includes a frame 6200, a first child seat 6300 and a second child seat 6400 that includes a tray assembly 6500, in substantially similar fashion to corresponding elements of the above-described embodiments. The frame 6200 is generally configured for resting on a floor or other support surface and includes a front U-shaped frame member 6210 and a back U-shaped frame member 6220 connected at first and second hubs 6230 positioned on either side of the frame. The frame members 6210, 6220 each include a cross frame member 6212, 6222 and opposed pairs of generally upright frame members or legs 6214, 6224 angled in the form of an A-frame support structure. The cross-frame members 6212, 6222 extend generally parallel with the support surface or floor. Non-slip feet 6215 are optionally provided at each side of the cross-frame members 6212, 6222. The upright frame members 6214, 6224 extend at an upward angle from the cross-frame members 6212, 6222 to the hubs 6230. In the depicted embodiment, the front upright frame members 6214 are attached to the hubs 6230 in a fixed position, whereas the back upright frame members 6224 are pivotally attached to the hubs. This pivotal attachment allows a user to fold the frame 6200 from an expanded in-use position, shown in FIG. 59A, to a more compact storage position, shown in FIG. 59C. The frame 6200 further comprises an upper rear cross-frame support brace or bar 6250, extending upwardly and between the first and second hubs 6230. The upper rear support bar 6250 provides a hand support and barrier for a user when used in the stepstool configuration, as shown in FIG. 58, and optionally also may help provide structural rigidity to the frame 6200, and/or serve as a handle for lifting or moving the frame when not in use. In example embodiments, the upper rear support bar 6250 is generally U-shaped, with first and second end portions extending upwardly and rearwardly from the first and second hubs 6230 at an oblique angle and in generally coaxial alignment or along generally parallel axes with the first and second front legs 6214 of the frame 6200, a generally horizontal cross-member extending transversely between one side of the frame and the other, and smoothly curved vertical and horizontal transition portions between the end portions and the cross-member.

Similar to the above-described embodiments, the system 6010 can be used in one or more highchair configurations or modes of use, for example alternatively in an infant highchair mode with the second child seat 6400 and tray 6500 installed as shown in FIG. 56, or in a toddler highchair mode with the second child seat and tray removed as shown in FIG. 57. In example embodiments, the second child seat 6400 releasably couples to the first child seat 6300 and/or to the frame 6200 in the infant highchair mode, and the tray 6500 is pivotally and/or releasably attached to the first child seat. When removed, as shown in FIG. 57, the second child seat 6400 may optionally be used as a standalone booster seat, for example, having a lower portion or surface configured to support the booster in a stable and upright position and rest directly on a substantially flat supporting surface such as the seat of a typical adult dining chair, and without the need for attachment or removal of any separate intermediate adapter or coupling structures. One or more straps or other attachment members are optionally provided for attachment of the booster to the adult chair or other supporting surface. An internal storage compartment is optionally provided within the second child seat for storage of the straps when not in use. Optionally, the seating height or elevation of the first and/or second child seats relative to the floor or other support surface is adjustable by selective adjustment of the position of attachment collars 6340, which support the child seat(s), along the length of the upright frame members 6214 of the front frame members 6210 of the frame 6200.

The system 6010 of this embodiment is further convertible to at least one stepstool configuration or mode of use, for example as shown in FIG. 58. In the stepstool configuration, the first child seat 6300 is removable from the frame 6200 as shown. At least one step or support assembly 6700 is attached to the frame 6200, providing a support surface for a child or adult user U to stand on, for providing a higher reach access or elevated position. When the first child seat 6300 is removed from the frame 6200 and the frame is extended, the support step assembly 6700 extends or expands to form a generally flat support surface that is aligned in a generally horizontal plane that is substantially parallel to the ground, floor or other surface upon which the device is supported. When configured for use, the support step assembly 6700 and the frame 6200 provide structural rigidity sufficient to stably and safely support the weight of the user and any additional intended load. In example embodiments, the support step assembly 6700 is permanently attached or affixed to the frame 6200 (i.e., not readily detachable by hand without specialized tools or without damaging the assembly). In alternate embodiments, the support step assembly 6700 may be semi-permanently attached (i.e., not readily detachable by hand without standard tools) or detachably coupled (i.e., readily detachable by hand without tools) to the frame 6200.

Figure 60A:
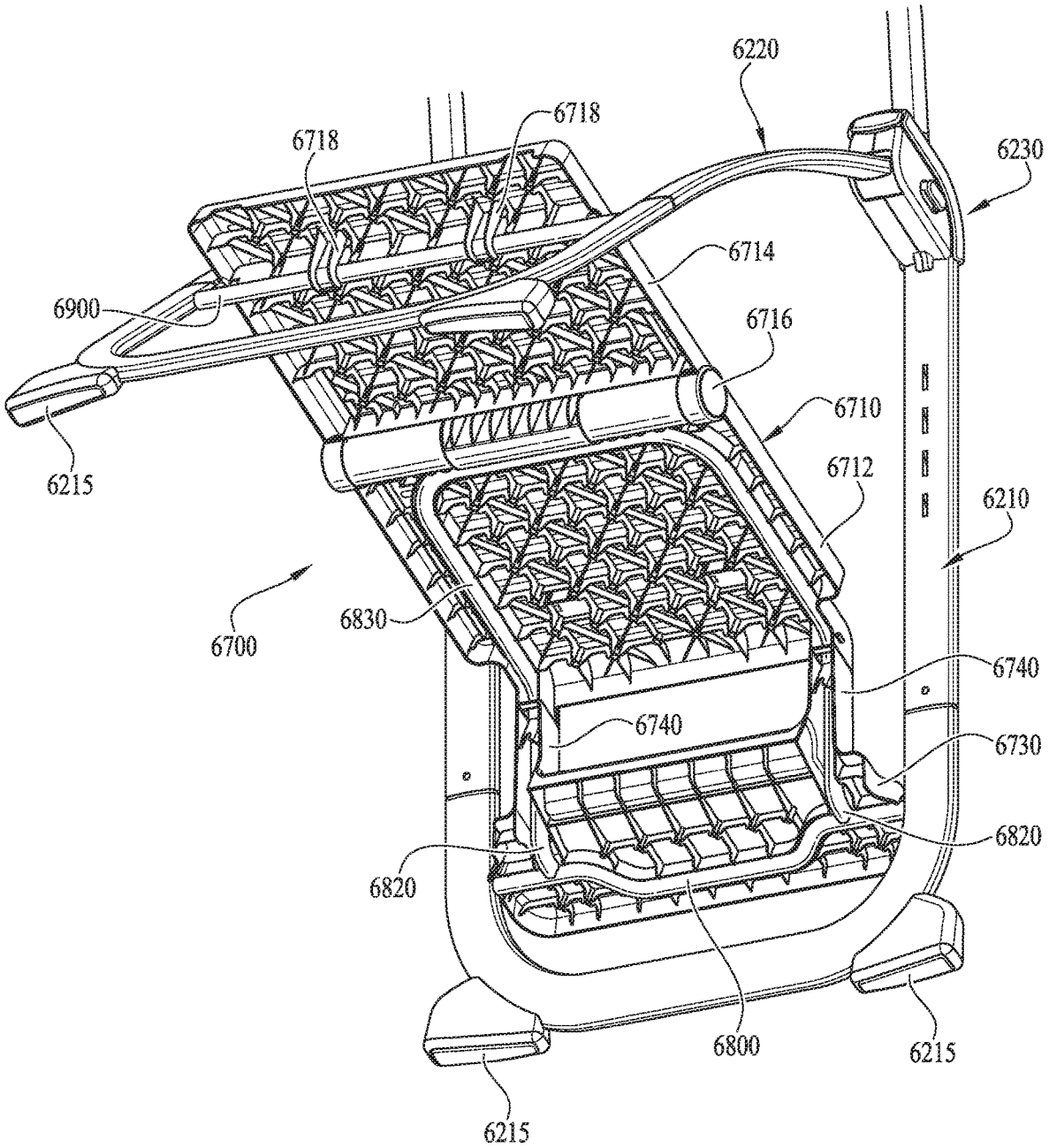
FIGS. 60A and 60B show lower perspective views of the step platform in extended and folded configurations, respectively.
Figure 60B:
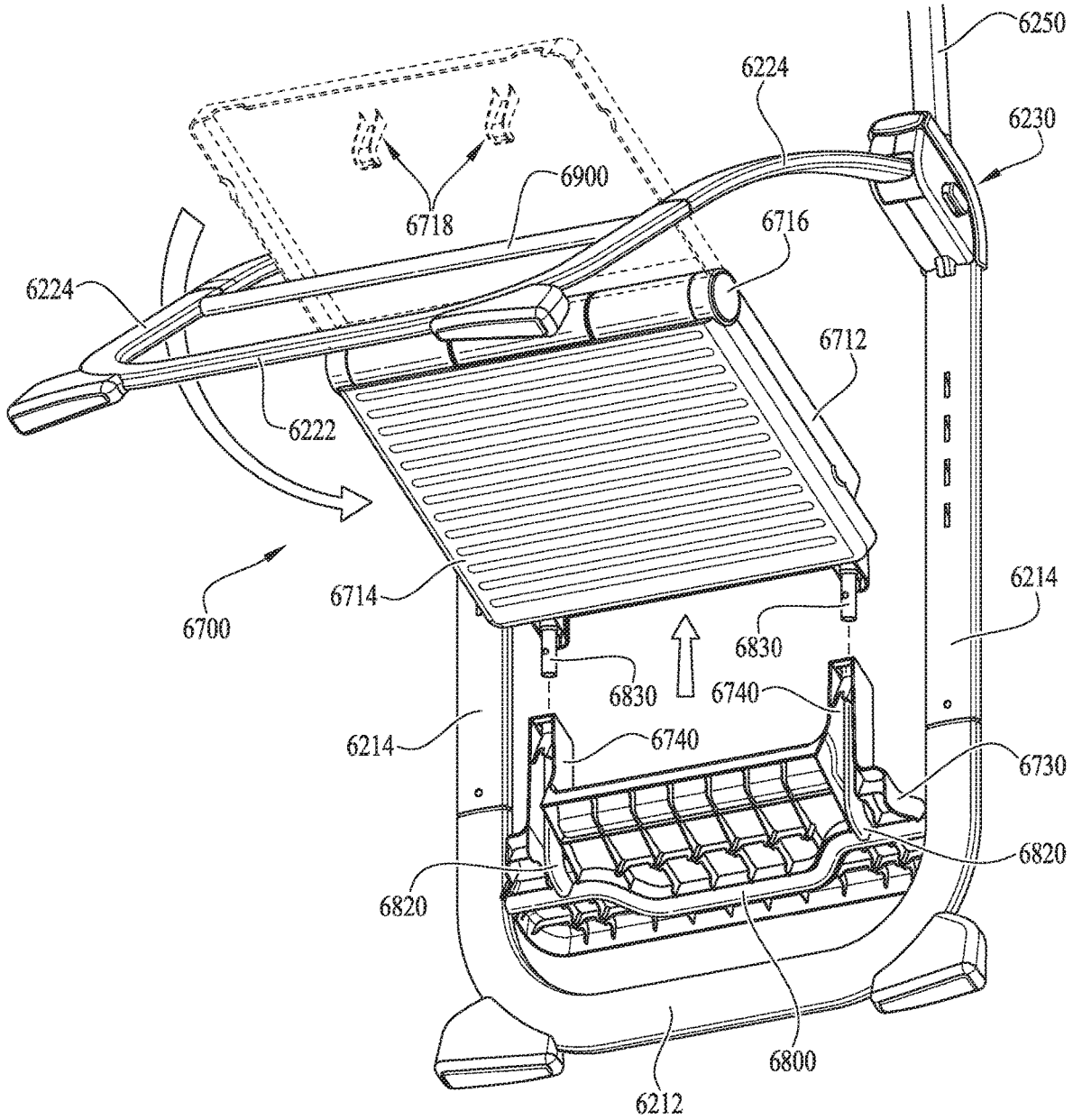

In the depicted embodiment, and as seen with reference to FIGS. 60A and 60B, the support step assembly 6700 comprises an upper support platform 6710, and a lower step 6730 connected with the support platform by a pair of connecting intermediate struts 6740. The lower step 6730 is attached to a lower front frame crossbar 6800, which extends across the front frame member 6210 between the front upright frame members 6214. In example embodiments, the lower step 6730 is permanently attached to the lower front frame crossbar 6800, for example by means of the crossbar passing through openings in the lower step. In example embodiments, the front frame crossbar 6800 comprises first and second end portions, an offset middle portion, and arcuate or angled connecting portions between the end and middle portions, with the end portions being coaxially aligned along a first axis, and the middle portion extending along a second axis generally parallel to and offset a distance from the first axis. The front frame crossbar 6800 is preferably permanently attached at each end to the front upright frame members 6214, for example by press-fit or welding. First and second upright extension bars 6820 extend upwardly from the front frame crossbar 6800 and through the intermediate struts 6740. Upper ends of the first and second upright extension bars 6820 attach to first and second ends of a U-shaped step reinforcement bar 6830 that is engaged within the underside of the upper support platform 6710. The ends of the first and second upright extension bars 6820 are preferably permanently or semi-permanently attached to the first and second ends of the step reinforcement bar 6830, for example by hidden Valco™-type snap button couplings which can be engaged by press-fitting without the need for tools, but cannot be readily disengaged without the use of a special tool. In this manner, the end user can easily assemble the device, but the support structure of the device cannot inadvertently separate. The front frame crossbar 6800, the upright extension bars 6820, and the U-shaped step reinforcement bar 6830 are optionally constructed of metal tubing, and once assembled and connected provide structural load-bearing support for the lower step 6730 and the front portion of the step support platform 6710 which may for example be constructed of plastic, metal, wood or other material. Optionally, the upper surfaces of the step support platform 6710 and/or the lower step 6730 are provided with ribs, projections and/or other non-slip surface features or surface treatments or materials, to provide more stable footing for the user.

Figure 59C:
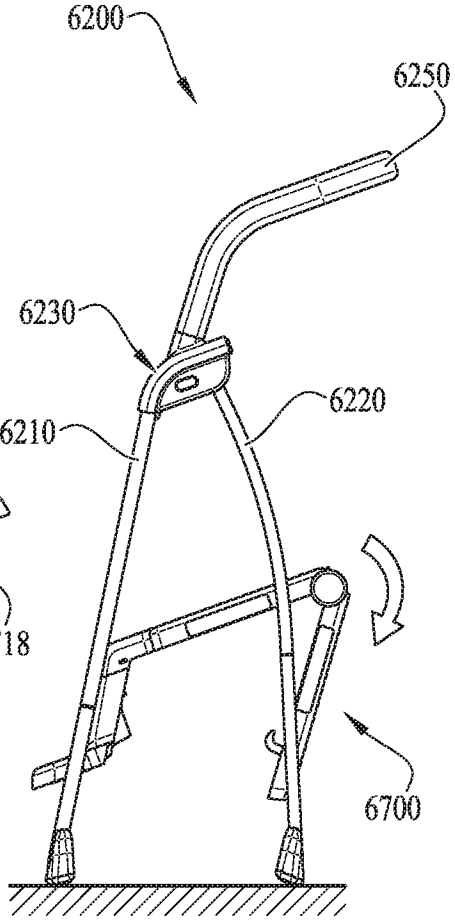
FIGS. 59A, 59B and 59C show a sequenced of folding of the frame and step platform of the system shown in FIG. 56.
Figure 59B:
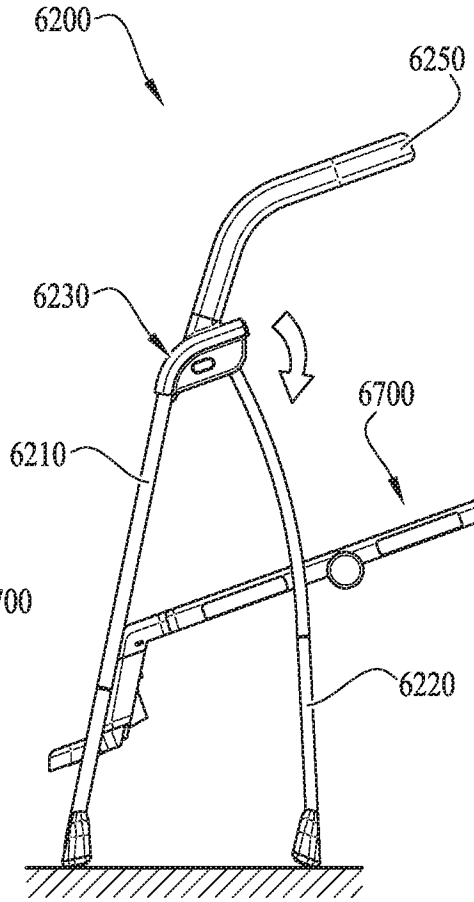

The upper support platform 6710 of the support step assembly 6700 optionally comprises two or more sections joined together by a hinge or other coupling mechanism. For example, in the depicted embodiment, the upper support platform 6710 comprises a front section 6712 and a back section 6714 coupled to one another by a butt or barrel hinge 6716. In this manner, the hinge 6716 allows the front section 6712 and the back section 6714 to fold relative to one another for compact storage when not in use (FIG. 60B), and to extend to a 180° open configuration for use (FIG. 60A). The hinge mechanism 6716 preferably includes integral stops to prevent opening past the 180° open configuration to support the weight of the user and resist collapse of the upper support platform 6710 under load. The back section 6714 of the upper support platform 6710 of the support step assembly 6700 comprises one or more features for coupling or engagement with a lower rear frame crossbar 6900 extending between the rear upright frame members 6224 of the back frame member 6220 of the frame 6200. For example, in the depicted embodiment, a pair of forwardly directed hooks 6718 extend downwardly from the lower face of the back section 6714 of the support platform 6710. When the frame 6200 and the support step assembly 6700 are extended for use (FIGS. 59A and 60A), the hooks 6718 capture and engage the lower rear frame crossbar 6900, so that the lower rear frame crossbar provides load-bearing support for the back portion of the step support platform 6710 during use in the stepstool configuration. The hooks 6718 preferably releasably engage the crossbar 6900, allowing detachment when the frame 6200 is folded for storage and permitting folding of the support step assembly 6700 independent of the frame (FIGS. 59B and 59C, and FIG. 60B). In example embodiments, a front portion of the support step assembly 6700 is permanently affixed to and supported by the front frame crossbar 6800, and a rear portion of the support step assembly is supported by detachable engagement with the rear frame crossbar 6900. In alternate embodiments, the configuration may be reversed, with the rear portion of the support step assembly being permanently affixed to and supported by the rear frame crossbar and the front portion of the support step assembly being supported by detachable engagement with the front frame crossbar. In still further alternate embodiments, both the front and rear portions of the support step assembly may be permanently or detachably engaged with the front and rear frame crossbars respectively.

In example modes or methods of use, the system 6010 of this embodiment may be used to support a child or other user U in a seated position in one or more chair configurations, as shown in FIGS. 56 and 57. Optionally the system 6010 is convertible between at least two chair configurations, for example by detachment and removal of the second seat portion 6400 from the first seat portion 6300 and support frame 6200, for example as shown in FIG. 57. The system 6010 is further convertible between at least one chair configuration for use by a seated user and a stepstool configuration for use by a standing user, for example by detachment and removal of the first seat portion 6300 from the frame 6200, as shown in FIG. 58. In example embodiments of the stepstool configuration, the upper rear cross-frame support bar 6250 is positioned generally above the back side of the support step assembly 6700, and preferably extends no further rearwardly than vertically above the rear cross-frame member 6222 of the rear leg assembly, to prevent the user's weight from extending beyond the stool's support base and potentially tipping over. Similarly, the front side of the support step assembly 6700, including the lower step 6730 if provided, preferably extends no further in the forward direction than generally vertically above the front cross-frame member 6212 of the front leg assembly for stability in use. The system 6010 is optionally further reconfigurable between an expanded configuration for use (FIG. 59A) and a folded configuration for storage and transport (FIGS. 59B and 59C). The system 6010 is optionally further reconfigurable to adjust one or more seating portions between raised and lowered positions with respect to the frame.

Figure 61A:
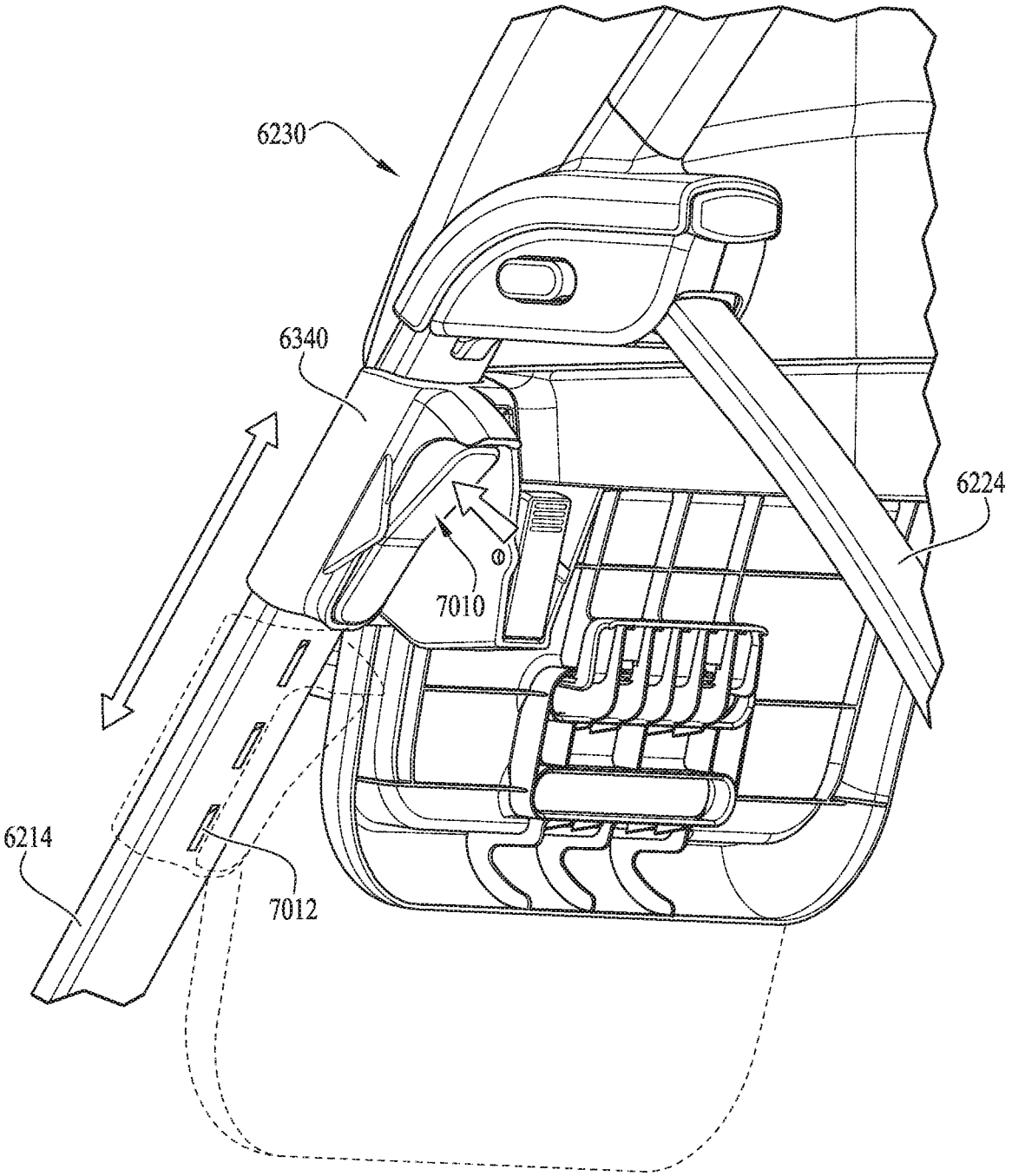
FIGS. 61A, 61B and 61C show the operation of adjustment and release actuators for positional adjustment and reconfiguration of elements of the system of FIG. 56.
Figure 61B:
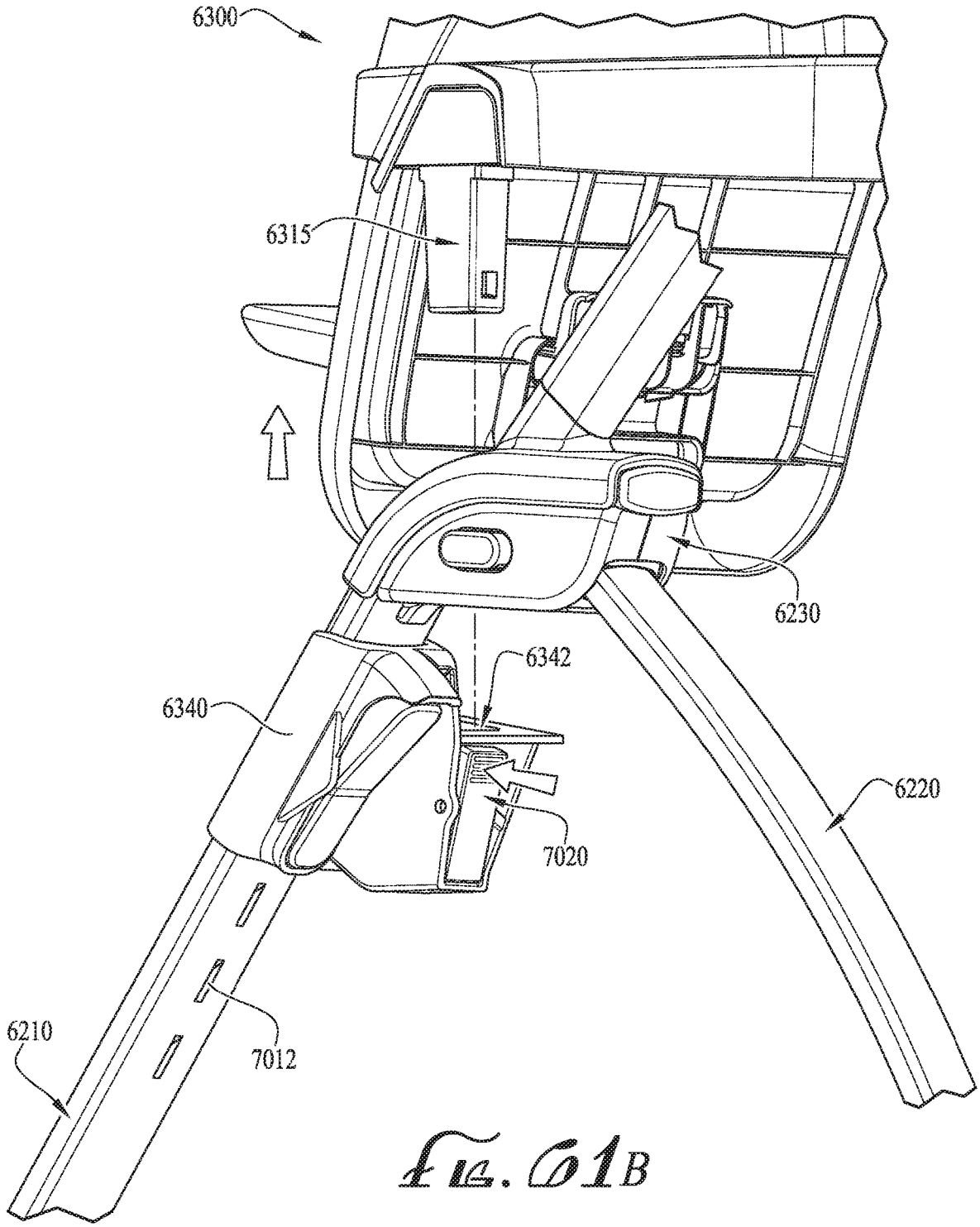
Figure 61C:
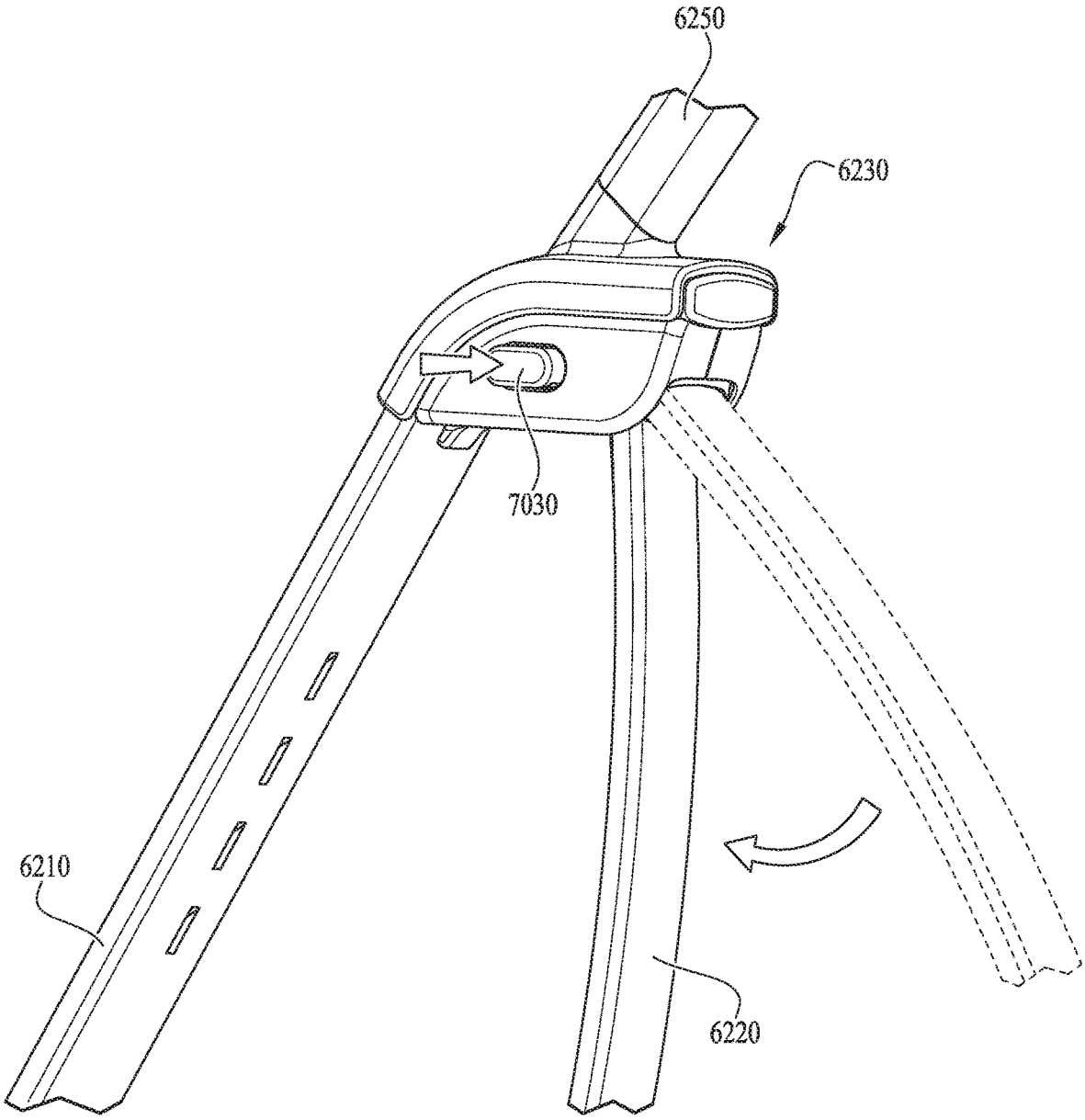

FIGS. 61A, 61B and 61C show operation of lock and release actuators according to example forms, to allow various reconfigurations of portions of the system 6010. For example, pressing the height adjustment actuator 7010 as shown in FIG. 61A, releases an elevational locking and release mechanism and allows a caregiver or adult user to slide the attachment collars 6340 up and down along the length of the front frame legs 6214 to selectively adjust the seat elevation or height in similar fashion to described above with reference to FIGS. 13-15. Releasing the height adjustment actuator 7010 reengages the elevational locking and release mechanism with a selected positional recess 7012 to retain the seat at the selected elevation. As shown in FIG. 58, the attachment collars 6340 can be lowered into alignment with the support platform 6710 of the support step assembly 6700 in the stepstool configuration to avoid user interference and/or fill the gap between the frame and the support step.

Pressing the seat release actuator 7020 as shown in FIG. 61B allows removal of the first seat 6300 as shown in FIG. 58. In the example embodiment depicted, the first seat 6300 includes one or more posts 6315, for example a pair of posts with one on each side, extending downwardly from the bottom of the seat, which are releasably engaged within cooperatively configured channels or receivers 6342 in the tops of the attachment collars 6340. Pressing the seat release actuator 7020 releases the post 6315 from an engagement mechanism within the receiver 6342 and allows the seat 6300 to be lifted away from the frame 6200, for use of the system 6010 in its stepstool configuration. The seat 6300 may be reinstalled by insertion of the posts 6315 back into engagement in the receivers 6342.

Figure 59A:
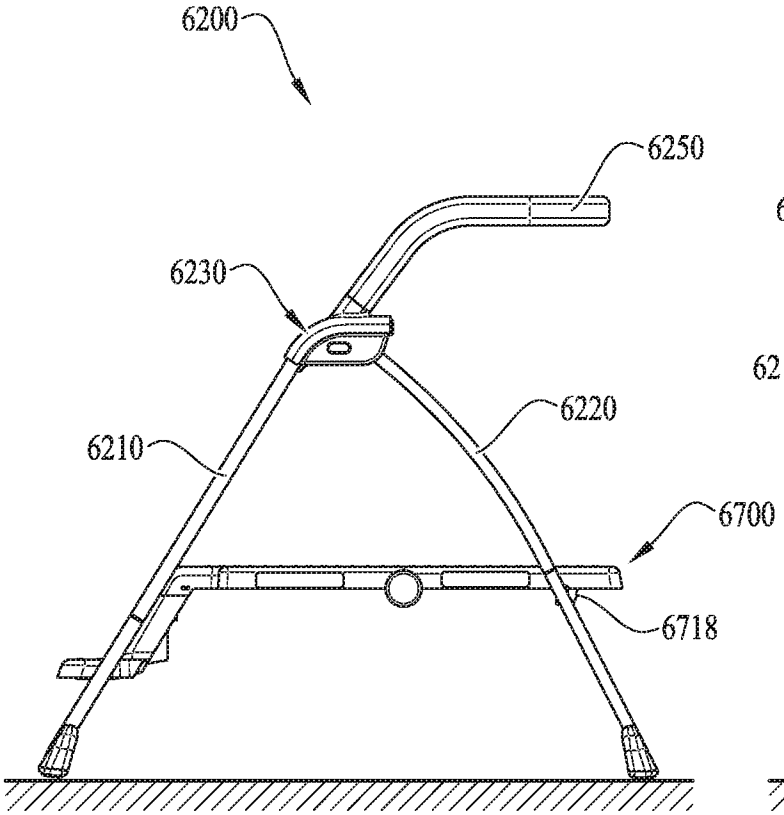

Pressing the frame fold release actuator 7030 as shown in FIG. 61C releases a frame locking mechanism within the hub 6230, allowing the rear frame legs 6220 to fold toward the front frame legs 6210 (see FIGS. 59B and 59C), in similar fashion to described above with reference to FIGS. 5 and 6. Optionally the frame may lock in the folded configuration when the actuator 7030 is released, and the user presses the actuator again to re-open the frame. Alternatively, the frame does not lock in the folded configuration, and reopening the frame reengages the frame locking mechanism to retain the frame in the open configuration (FIG. 59A).

While the invention has been described with reference to example embodiments, it will be understood by those skilled in the art that a variety of modifications, additions and deletions are within the scope of the invention, as defined by the following claims.

What is claimed is:

1. A convertible seating and stepstool system comprising:

a support frame;

at least one seat configured for removable attachment to the support frame; and a support step assembly affixed to the support frame;

wherein the convertible seating and stepstool system is convertible between a seating configuration with the at least one seat attached to the support frame, and a stepstool configuration with the at least one seat removed from the support frame, and wherein the support step assembly is affixed to the support frame at a same location in both the seating configuration and the stepstool configuration;

wherein the support frame comprises first and second front legs and first and second back legs, a front frame crossbar permanently affixed between the first and second front legs, and a lower rear frame crossbar extending between the first and second back legs; and further comprising a step reinforcement bar extending through the support step assembly and coupled to the front frame crossbar, wherein the support step assembly comprises a lower step permanently attached to the front frame crossbar and an upper support platform in engagement with the step reinforcement bar, and at least one intermediate strut extending between the lower step and the upper support platform.

2. The convertible seating and stepstool system of claim 1, wherein the step reinforcement bar is coupled to the front frame crossbar by at least one coupling element that is engageable manually without tools but cannot be readily disengaged without use of a tool.

3. The convertible seating and stepstool system of claim 2, wherein the at least one coupling element comprises a hidden snap-button coupling.

4. The convertible seating and stepstool system of claim 1, further comprising an upright extension bar coupled between the front frame crossbar and the step reinforcement bar and extending along the at least one intermediate strut.

5. The convertible seating and stepstool system of claim 1, wherein the support step assembly comprises a support platform having a front section and a back section, the front section and the back section being pivotally coupled to one another by a hinge.

6. The convertible seating and stepstool system of claim 1, further comprising at least one hub pivotally coupling the first and second front legs with the first and second back legs.

7. The convertible seating and stepstool system of claim 1, further comprising an upper cross-frame support bar extending transversely at an upper portion of the frame between a first side of the support frame and an opposite second side of the support frame.

8. The convertible seating and stepstool system of claim 7, wherein the upper cross-frame support bar comprises first and second end portions extending upwardly and rearwardly from the first and second sides of the support frame at an oblique angle and in generally coaxial alignment or along generally parallel axes with the first and second front legs.

9. The convertible seating and stepstool system of claim 1, wherein the at least one seat comprises a first seat assembly configured for removable attachment to the support frame, and a second seat assembly configured for removable attachment to the first seat assembly when the first seat assembly is attached to the support frame.

10. The convertible seating and stepstool system of claim 9, wherein the second seat assembly comprises a base portion configured for direct attachment to the first seat assembly in a first seating configuration, and for supporting the second seat assembly in a stable and upright position with the base portion resting directly on a substantially flat supporting surface in a second seating configuration separated from the first seat assembly.

11. The convertible seating and stepstool system of claim 1, wherein the at least one seat is movably coupled to the support frame to allow selective repositioning of the at least one seat between a first elevational position and a different second elevational position.

12. The convertible seating and stepstool system of claim 1, wherein the convertible seating and stepstool system comprises a children's highchair in the seating configuration.

13. The convertible seating and stepstool system of claim 12, wherein the at least one seat further comprises a feeding tray.

14. A convertible seating and stepstool system comprising:

a support frame comprising first and second front legs, first and second back legs, a first hub pivotally coupling the first front leg and the first back leg, a second hub pivotally coupling the second front leg and the second back leg, a front frame crossbar extending between the first and second front legs, a rear frame crossbar extending between the first and second back legs, and an upper cross-frame support bar extending between the first hub and the second hub;

at least one seat configured for removable attachment to the support frame;

a support step assembly having a first portion affixed to one of the front frame crossbar and the rear frame crossbar, and a second portion configured for supporting engagement with the other of the front frame crossbar and the rear frame crossbar; and a step reinforcement bar extending through the support step assembly and coupled to the front frame crossbar, wherein the support step assembly comprises a lower step permanently attached to the front frame crossbar and an upper support platform in engagement with the step reinforcement bar, and at least one intermediate strut extending between the lower step and the upper support platform.

15. The convertible seating and stepstool system of claim 14, wherein the first portion of the support step assembly is permanently affixed to one of the front frame crossbar and the rear frame crossbar, and wherein the second portion of the support step assembly is configured for detachable supporting engagement with the other of the front frame crossbar and the rear frame crossbar.

16. The convertible seating and stepstool system of claim 14, wherein the step reinforcement bar is coupled to the front frame crossbar by at least one coupling element that is engageable manually without tools but cannot be readily disengaged without use of a tool.

17. The convertible seating and stepstool system of claim 16, wherein the at least one coupling element comprises a hidden snap-button coupling.

18. The convertible seating and stepstool system of claim 14, further comprising an upright extension bar coupled between the front frame crossbar and the step reinforcement bar and extending along the at least one intermediate strut.

19. The convertible seating and stepstool system of claim 14, wherein the support step assembly further comprises a hinge coupling between the first and second portions.

20. The convertible seating and stepstool system of claim 14, wherein the at least one seat comprises a first seat assembly configured for removable attachment to the support frame, and a second seat assembly configured for removable attachment to the first seat assembly when the first seat assembly is attached to the support frame.

21. The convertible seating and stepstool system of claim 20, wherein the second seat assembly comprises a base portion configured for direct attachment to the first seat assembly in a first seating configuration, and for supporting the second seat assembly in a stable and upright position with the base portion resting directly on a substantially flat supporting surface in a second seating configuration separated from the first seat assembly.

22. The convertible seating and stepstool system of claim 14, wherein the at least one seat is movably coupled to the support frame to allow selective repositioning of the at least one seat between a first elevational position and a different second elevational position.

23. The convertible seating and stepstool system of claim 14, further comprising a feeding tray.

* * * * *